US012196218B2

(12) United States Patent
Teramoto et al.

(10) Patent No.: US 12,196,218 B2
(45) Date of Patent: Jan. 14, 2025

(54) IMPELLER, MULTI-BLADE FAN, AND AIR-CONDITIONING APPARATUS

(71) Applicant: Mitsubishi Electric Corporation, Tokyo (JP)

(72) Inventors: Takuya Teramoto, Tokyo (JP); Hiroyasu Hayashi, Tokyo (JP); Ryo Horie, Tokyo (JP); Takashi Yamaguchi, Tokyo (JP); Tomohiro Nagano, Tokyo (JP); Kazuya Michikami, Tokyo (JP); Takahiro Yamatani, Tokyo (JP); Hiroshi Tsutsumi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 5 days.

(21) Appl. No.: 17/771,056

(22) PCT Filed: Dec. 23, 2019

(86) PCT No.: PCT/JP2019/050392

§ 371 (c)(1),
(2) Date: Apr. 22, 2022

(87) PCT Pub. No.: WO2021/130821

PCT Pub. Date: Jul. 1, 2021

(65) Prior Publication Data

US 2022/0372990 A1 Nov. 24, 2022

(51) Int. Cl.

| | |
|---|---|
| ***F04D 29/28*** | (2006.01) |
| ***F04D 17/16*** | (2006.01) |
| ***F04D 29/30*** | (2006.01) |
| ***F04D 29/42*** | (2006.01) |
| ***F24F 1/0047*** | (2019.01) |
| ***F24F 1/0317*** | (2019.01) |

(52) U.S. Cl.

CPC ..... *F04D 29/281* (2013.01); *F04D 17/162* (2013.01); *F04D 29/30* (2013.01);
(Continued)

(58) Field of Classification Search

CPC ..... F04D 29/281; F04D 17/162; F04D 29/30; F04D 29/4213; F04D 29/282;
(Continued)

(56) References Cited

U.S. PATENT DOCUMENTS

| | | | |
|---|---|---|---|
| 2017/0234323 | A1 | 8/2017 | Pirouzpanah et al. |
| 2021/0033104 | A1 | 2/2021 | Teramoto et al. |

FOREIGN PATENT DOCUMENTS

| | | | |
|---|---|---|---|
| CN | 201934377 | U | 8/2011 |
| CN | 109219703 | A | 1/2019 |

(Continued)

OTHER PUBLICATIONS

Machine Translation of JP2011226410A PDF File Name: "JP2011226410A_Machine_Translation.pdf".*

(Continued)

*Primary Examiner* — Grant Moubry
*Assistant Examiner* — Ruben Picon-Feliciano
(74) *Attorney, Agent, or Firm* — Posz Law Group, PLC

(57) ABSTRACT

An impeller includes a main plate, an annular side plate and blades. The blades each have: an inner circumferential end; an outer circumferential end; a sirocco blade portion formed as a forward-swept blade portion, and having an outlet angle that is greater than 90 degrees; and a turbo blade portion formed as a swept-back blade portion and including the inner circumferential end. The blades include a first blade portion and a second blade portion that are provided on respective sides of the main plate. The impeller including a region in which a first inter-blade distance is greater than a second inter-blade distance, where an inlet-blade distance is a distance between any adjacent two of the blades in the circumferential direction, the first inter-blade distance is the
(Continued)

inter-blade distance of the first blade portion, and the second inter-blade distance is the inter-blade distance of the second blade portion.

40 Claims, 28 Drawing Sheets

(52) U.S. Cl.
CPC ..... *F04D 29/4213* (2013.01); *F24F 1/0047* (2019.02); *F24F 1/0317* (2019.02); *F24F 2221/14* (2013.01)

(58) Field of Classification Search
CPC .... F04D 29/288; F04D 29/666; F24F 1/0047; F24F 1/0317; F24F 2221/14; F05D 2240/301; F05D 2240/303; F05D 2240/304
See application file for complete search history.

(56) References Cited

FOREIGN PATENT DOCUMENTS

| | | | | |
|---|---|---|---|---|
| JP | 2000-240590 | A | | 9/2000 |
| JP | 2001-329994 | A | | 11/2001 |
| JP | 2005-069183 | A | | 3/2005 |
| JP | 2011226410 | A | * | 11/2011 |
| JP | 3179754 | U | | 11/2012 |
| WO | 2019/082378 | A1 | | 5/2019 |
| WO | 2019/082392 | A1 | | 5/2019 |

OTHER PUBLICATIONS

Office Action dated Jan. 24, 2023 issued in corresponding JP Patent Application No. 2021-566401 (and English machine translation).
Extended European Search Report dated Nov. 23, 2022 issued in corresponding European Patent Application No. 19958019.2.
International Search Report dated Mar. 10, 2020, issued in corresponding International Application No. PCT/JP2019/050392 (and English translation).
Office Action dated Jul. 11, 2023 issued in corresponding JP patent application No. 2021-566401 (and English translation).
Office Action dated Oct. 28, 2023 issued in corresponding CN patent application No. 201980103132.8 (and English translation).
Office Action dated Jun. 21, 2024 issued in corresponding Chinese Patent Application No. 201980103132.8 (and English machine translation).
Office Action dated Oct. 22, 2024 issued in corresponding Chinese Patent Application No. 201980103132.8 (and English machine translation).

* cited by examiner

Comparative Example

IMPELLER, MULTI-BLADE FAN, AND AIR-CONDITIONING APPARATUS

CROSS REFERENCE TO RELATED APPLICATION

This application is a U.S. national stage application of PCT/JP2019/050392 filed on Dec. 23, 2019, the contents of which are incorporated herein by reference.

TECHNICAL FIELD

The present disclosure relates to an impeller, a multi-blade fan including the impeller, and an air-conditioning apparatus including the multi-blade fan.

BACKGROUND ART

An existing multi-blade fan includes a volute scroll casing and an impeller that is housed in the scroll casing and is rotated around an axis (see, for example, Patent Literature 1). The impeller of the multi-blade fan of Patent Literature 1 includes a discoid main plate, an annular side plate, and blades that are arranged radially. The blades of the impeller are provided such that main blades and intermediate blades are alternately arranged, and the inside diameters of the main and intermediate blades increase from the main plate toward the side plate. Furthermore, each of the blades of the impeller is a sirocco blade (forward-swept blade) whose outlet angle is greater than or equal to 100 degrees, includes an inducer portion of a turbo blade (swept-back blade) on an inner circumferential side of the blade, and is configured such that at portion of the main blades that are closer to the main plate, the ratio of the blade inside diameter to the blade outside diameter of the main blades is lower than or equal to 0.7.

CITATION LIST

Patent Literature

Patent Literature 1: Japanese Unexamined Patent Application Publication No. 2000-240590

SUMMARY OF INVENTION

Technical Problem

The multi-blade fan of Patent Literature 1 includes a single-suction impeller configured to suck air into the impeller from one side of the impeller in an axial direction of the impeller. On the other hand, in a double-suction impeller configured to suck air into the impeller from both sides of the impeller in an axial direction of the impeller, the flow of sucked air may vary between the both sides of the impeller, depending on the type of usage, the environment of usage, or other conditions. For example, in the case where a motor is provided on one of the both sides of the impeller, the area where air is sucked is substantially reduced, thus causing a loss.

The present disclosure is applied to solve the above problem, and relates to an impeller that is of a double-suction type and reduces a loss that would be caused in the case where the of sucked air varies between both sides of the impeller because of the type of usage, the environment of usage, or other conditions, and also relates to a multi-blade fan including the impeller, and an air-conditioning apparatus including the multi-blade fan.

Solution to Problem

An impeller according to an embodiment of the present disclosure includes: a main plate configured to be driven to rotate; an annular side plate provided opposite to the main plate; and a plurality of blades connected to the main plate and the side plate and arranged in a circumferential direction with respect to a rotation axis of the main plate. Each of the plurality of blades has an inner circumferential end located closer to the rotation axis in a radial direction from the rotation axis, an outer circumferential end located closer to an outer circumferential side than the inner circumferential end in the radial direction, a sirocco blade portion formed as a forward-swept blade portion, including the outer circumferential end, and having an outlet angle that is greater than 90 degrees, and a turbo blade portion formed as a swept-back blade portion and including the inner circumferential end. The plurality of blades include a first blade portion provided on one plate side of the main plate, and a second blade portion provided on an other plate side of the main plate. The impeller includes a region in which a first inter-blade distance is greater than a second inter-blade distance, where an inter-blade distance is a distance between any adjacent two of the plurality of blades in the circumferential direction, the first inter-blade distance is the inter-blade distance of the first blade portion, and the second inter-blade distance is the inter-blade distance of the second blade portion.

A multi-blade fan according to another embodiment of the present disclosure includes the impeller; and a scroll casing housing the impeller, and having a peripheral wall formed into a volute shape and a side wall including a bellmouth that forms an air inlet communicating with a space defined by the main plate and the plurality of blades.

An air-conditioning apparatus according to still another embodiment of the present disclosure includes the multi-blade fan having the above configuration.

Advantageous Effects of Invention

According to the embodiments of the present disclosure, the plurality of blades include a first blade portion formed on one plate side of the main plate and a second blade portion formed on the other plate side of the main plate, and the impeller includes a region in which a first inter-blade distance of the first blade portion is greater than a second inter-blade distance of the second blade portion. Therefore, even in the case where the impeller is of a double-suction type and the flow of sucked air varies between one suction side and the other suction side, depending on the type of usage, the environment of usage, or other conditions, by providing the first blade portion whose inter-blade distance is greater than that of the second blade portion, on a side through which a smaller amount of sucked air flows, it is possible to increase the flow rate of air that is sucked on the side where the first blade portion is located. As a result, the impeller can reduce a loss of suction.

DESCRIPTION OF EMBODIMENTS

In the following, an impeller, a multi-blade fan, and an air-conditioning apparatus according to embodiments are described, for example, with reference to the drawings. It should be noted that in figures including FIG. 1 that will be referred to below, relative relationships in size and shape between components or other features of the components may be different from those of actual components. Furthermore, in each of the figures, components that are the same as or equivalent to those in a previous figure or previous figures are denoted by the same reference signs. The same is true of the entire text of the present specification. In addition, terms related to directions (for example, "upper", "lower", "right", "left", "front", and "rear") are used as appropriate; however, these terms are used only for explanation, that is, they do not limit the location and orientation of each of devices or components.

Embodiment 1

[Multi-Blade Fan 100]

Figure 1:
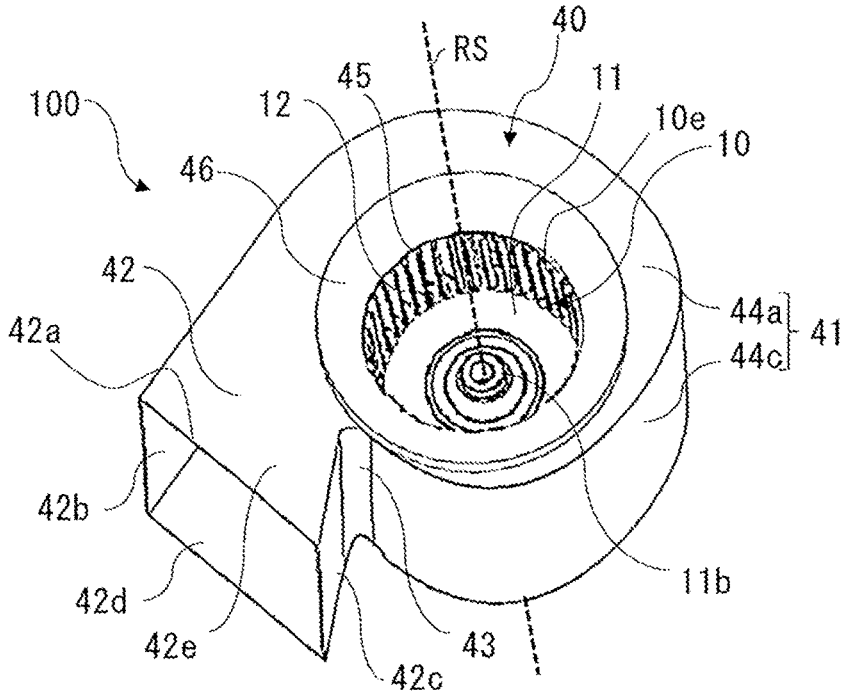
FIG. 1 is a perspective view schematically illustrating a multi-blade fan according to Embodiment 1.
Figure 2:
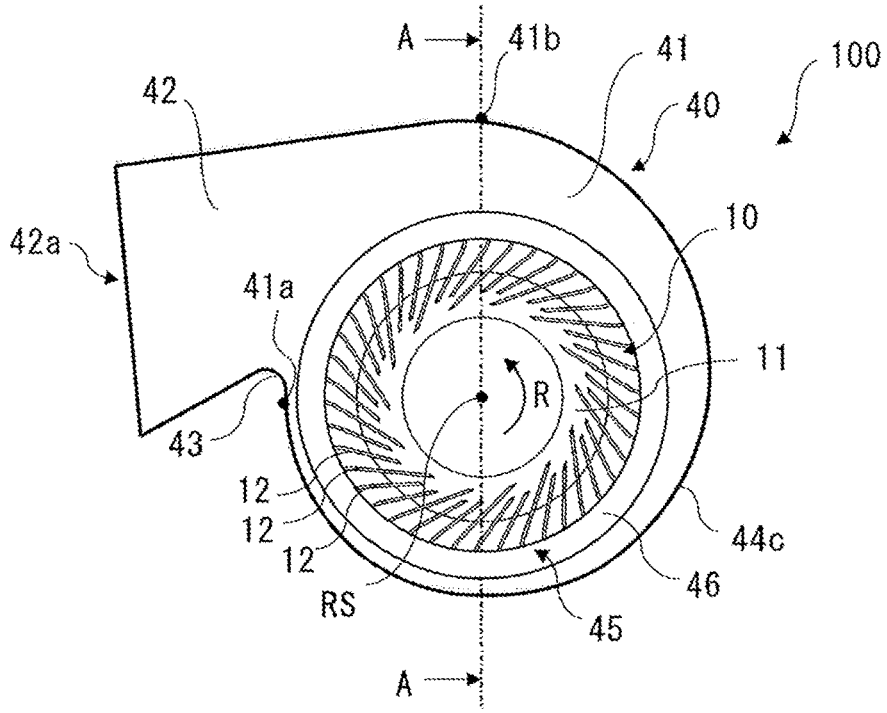
FIG. 2 is an external view schematically illustrating a configuration of the multi-blade fan according to Embodiment 1 as viewed in a direction parallel to a rotation axis.
Figure 3:
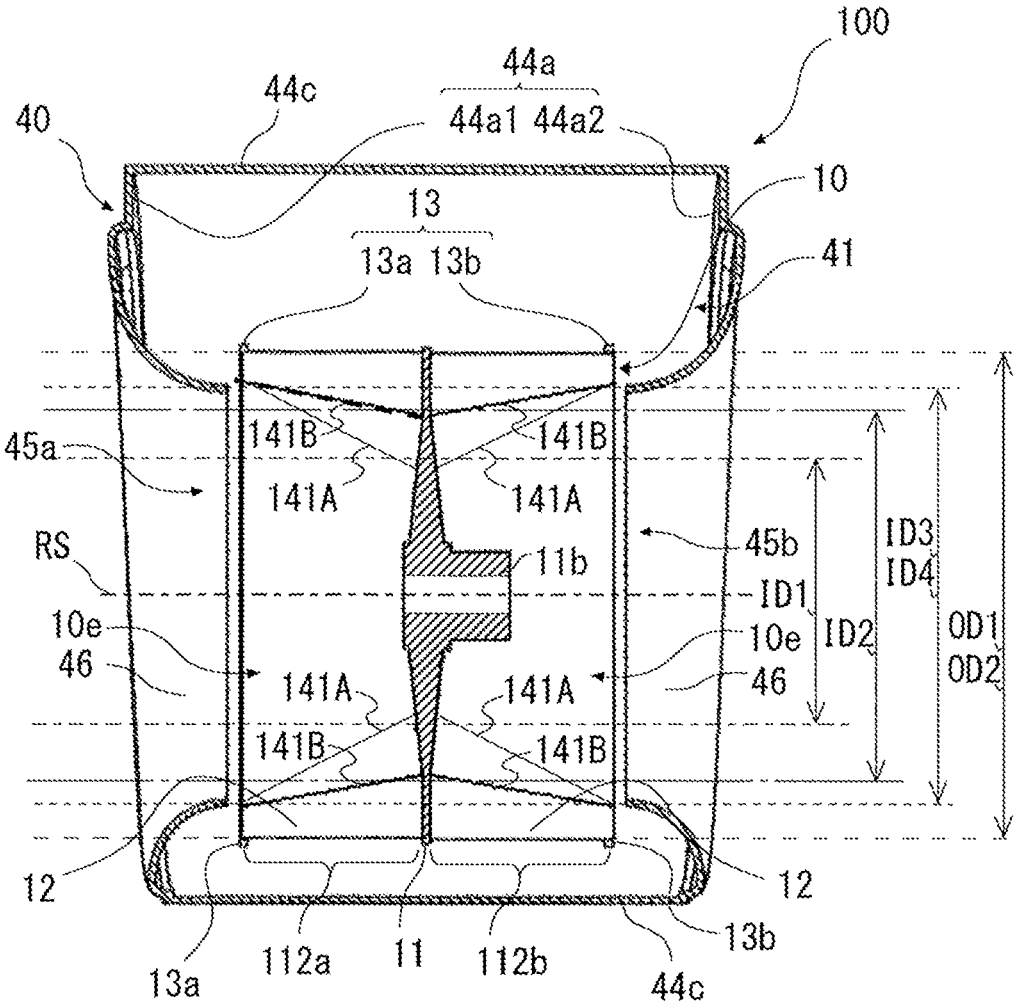
FIG. 3 is a schematic sectional view of the multi-blade fan that is taken along line A-A in FIG. 2.

FIG. 1 is a perspective view schematically illustrating a multi-blade fan 100 according to Embodiment 1. FIG. 2 is an external view schematically illustrating a configuration of the multi-blade fan 100 according to Embodiment 1 as viewed in a direction parallel to a rotation axis RS. FIG. 3 is a schematic sectional view of the multi-blade fan 100 that is taken along line A-A in FIG. 2. A basic configuration of the multi-blade fan 100 will be described with reference to FIGS. 1 to 3. It should be noted that FIGS. 1 to 3 schematically illustrate an overall configuration of the multi-blade fan 100, and a characteristic configuration of blades 12 in the multi-blade fan 100, is described in detail with reference to other figures. The multi-blade fan 100 is a multi-blade centrifugal fan, and has an impeller 10 that produces an air current and a scroll casing 40 that houses the impeller 10 therein. The multi-blade fan 100 is a double-suction centrifugal fan into which air is sucked through both sides of the scroll casing 40 in an axial direction of an imaginary rotation axis RS of the impeller 10.

(Scroll Casing 40)

The scroll casing 40 houses the impeller 10 for use in the multi-blade fan 100, and rectifies air that is blown from the impeller 10. The scroll casing 40 has a scroll portion 41 and a discharge portion 42.

(Scroll Portion 41)

The scroll portion 41 forms an air passage through which a dynamic pressure of an air current produced by the impeller 10 is converted into a static pressure. The scroll portion 41 has a side wall 44*a* and a peripheral wall 44*c*. The side wall 44*a* covers the impeller 10 in an axial direction of a rotation axis RS of a shaft portion 11*b* of the impeller 10 and has a suction port 45 through which air is taken in. The peripheral wall 44*c* surrounds the impeller 10 in such a manner as to cover the impeller 10 in a radial direction of the rotation axis RS of the shaft portion 11*b* of the impeller 10. Furthermore, the scroll portion 41 has a tongue portion 43 that is located between the discharge portion 42 and a scroll start portion 41*a* of the peripheral wall 44*c* to form a curved surface and that guides the air current produced by the impeller 10 to a discharge port 42*a* via the scroll portion 41. It should be noted that the radial direction of the rotation axis RS is a direction perpendicular to the axial direction of the rotation axis RS. An internal space of the scroll portion 41 that is defined by the peripheral wall 44*c* and the side wall 44*a* serves as a space in which air blown from the impeller 10 flows along the peripheral wall 44*c*.

(Side Wall 44*a*)

Side walls 44*a* are provided on the both sides of the impeller 10 in the axial direction of the rotation axis RS of the impeller 10. In each of the side walls 44*a* of the scroll casing 40, the suction port 45 is formed such that air can flow between the impeller 10 and the outside of the scroll casing 40. The suction port 45 is formed in a circular shape, and is provided such that the center of the suction port 45 and the center of the shaft portion 11*b* of the impeller 10 substantially coincide with each other. It should be noted that the shape of the suction port 45 is not limited to the circular shape, and may be another shape such as an elliptical shape. The scroll casing 40 of the multi-blade fan 100 is a double-suction casing in which the side walls 44*a* are provided on both sides of the main plate 11 in the axial direction of the rotation axis RS of the shaft portion 11*b*, the side walls 44*a* having respective air inlets 45.

The multi-blade fan 100 has two side walls 44*a* in the scroll casing 40. The two side walls 44*a* are provided opposite to each other, with the peripheral wall 44*c* interposed between the side walls 44*a*. More specifically, as illustrated in FIG. 3, the scroll casing 40 has a first side wall 44*a*1 and a second side wall 44*a*2 as the side walls 44*a*. The first side wall 44*a*1 forms a first suction port 45*a* that faces a plate surface of the main plate 11 on which a first side plate 13*a* to be described later is provided. The second side wall 44*a*2 forms a second suction port 45*b* that faces a plate surface of the main plate 11 on which a second side plate 13*b* to be described later is provided. It should be noted that the above suction port 45 is a generic name for the first suction port 45*a* and the second suction port 45*b*.

The suction port 45 provided in the side wall 44*a* is defined by a bellmouth 46. That is, the bellmouth 46 forms an suction port 45 that communicates with a space defined by the main plate 11 and a plurality of blades 12. The bellmouth 46 rectifies an air current to be sucked into the impeller 10 and causes the air current to flow into an air inlet 10*e* of the impeller 10. The bellmouth 46 is formed to have an opening whose diameter gradually decreases from the outside of the scroll casing 40 toward the inside of the scroll casing 40. Because of such a configuration of the side wall 44*a*, air in the vicinity the suction port 45 smoothly flows along the bellmouth 46 and efficiently flow into the impeller 10 through the suction port 45.

(Peripheral Wall 44*c*)

The peripheral wall 44*c* guides the air current produced by the impeller 10 toward the discharge port 42*a* along a curved wall surface. The peripheral wall 44*c* is a wall provided between side walls 44*a* that face each other, and has a curved surface along a rotation direction R of the impeller 10. The peripheral wall 44*c* is, for example, provided parallel to the axial direction of the rotation axis RS of the impeller 10 to cover the impeller 10; however, the location of the peripheral wall 44*c* is not limited to this. The peripheral wall 44*c* may be inclined relative to the axial direction of the rotation axis RS of the impeller 10. The peripheral wall 44*c* has an inner circumferential surface that covers the impeller 10 in the radial direction of the shaft portion 11*b* and faces the plurality of blades 12, which will be described later. The peripheral wall 44*c* faces a side of each of the blades 12 through which air is blown from the impeller 10. As illustrated in FIG. 2, the peripheral wall 44*c* is provided over an area from the scroll start portion 41*a*, which is located at a boundary between the peripheral wall 44*c* and the tongue portion 43, to a scroll end portion 41*b*, which is located at a boundary between the discharge portion 42 and the scroll portion 41 on a side located apart from the tongue portion 43, along the rotation direction R of the impeller 10. The scroll start portion 41*a* is an end portion of the peripheral wall 44*c* having the curved surface that is located on an upstream side of an air current produced by rotation of the impeller 10, and the scroll end portion 41*b* is an end portion of the peripheral wall 44*c* that is located on a downstream side of the air current produced by rotation of the impeller 10.

The peripheral wall 44*c* is formed in a volute shape. An example of the volute shape is a shape based on a logarithmic spiral, a spiral of Archimedes, or an involute curve. An inner peripheral surface of the peripheral wall 44*c* constitutes a curved surface that is smoothly curved along a circumferential direction of the impeller 10 from the scroll start portion 41*a*, which is the start of the scroll of the volute shape, to the scroll end portion 41*b*, air sent out from the impeller 10 smoothly flows through the space between the impeller 10 and the peripheral wall 44*c* in a direction toward the discharge portion 42. Thus, in the scroll casing 40, the static pressure of air from the tongue portion 43 toward the discharge portion 42 in the scroll casing 40 efficiently rises.

(Discharge Portion 42)

The discharge portion 42 forms a discharge port 42*a* through which an air current produced by the impeller 10 is discharged after passing through the scroll portion 41. The discharge portion 42 is a hollow pipe having a rectangular cross section orthogonal to the flow direction of air that flows along the peripheral wall 44*c*. It should be noted that the cross-sectional shape of the discharge portion 42 is not limited to a rectangle. The discharge portion 42 forms a flow passage through which air sent out from the impeller 10 and flowing through a gap between the peripheral wall 44*c* and the impeller 10 is guided to be let out of the scroll casing 40.

As illustrated in FIG. 1, the discharge portion 42 includes an extension plate 42*b*, a diffuser plate 42*c*, a first side plate portion 42*d*, a second side plate portion 42*e*, or other components. The extension plate 42*b* is formed integrally with the peripheral wall 44*c* such that the extension plate 42*b* is smoothly continuous with the scroll end portion 41*b*, which is located downstream of the peripheral wall 44*c*. The diffuser plate 42*c* is formed integrally with the tongue portion 43 of the scroll casing 40 and faces the extension plate 42*b*. The diffuser plate 42*c* is formed at a predetermined angle relative to the extension plate 42*b* so that the cross-sectional area of the flow passage gradually increases in the flow direction of air in the discharge portion 42. The first side plate portion 42*d* is formed integrally with the first side wall 44*a*1 of the scroll casing 40, and the second side plate portion 42*e* is formed integrally with the opposite second side wall 44*a*2 of the scroll casing 40. The first side plate portion 42*d* and the second side plate portion 42*e* are formed between the extension plate 42*b* and the diffuser plate 42*c*. Thus, the discharge portion 42 has a flow passage having a rectangular cross-section and defined formed by the extension plate 42*b*, the diffuser plate 42*c*, the first side plate portion 42*d*, and the second side plate portion 42*e*.

(Tongue Portion 43)

In the scroll casing 40, the tongue portion 43 is formed between the diffuser plate 42*c* of the discharge portion 42 and the scroll start portion 41*a* of the peripheral wall 44*c*. The tongue portion 43 is formed to have a predetermined radius of curvature, and the peripheral wall 44*c* is smoothly connected to the diffuser plate 42*c*, with the tongue portion 43 interposed between the peripheral wall 44*c* and the diffuser plate 42*c*. The tongue portion 43 reduces inflow of air from the start to the end of the scroll of a volute flow passage. The tongue portion 43 is provided at upstream part of a ventilation flue, and has a role to divert the flow of air in the rotation direction R of the impeller 10 and the flow of air in a discharge direction from downstream part of the ventilation flue toward the discharge port 42*a* from each other. Furthermore, the static pressure of air that is to flow into the discharge portion 42 rises while the air is passing through the scroll casing 40 and becomes higher than in the scroll casing 40. Therefore, the tongue portion 43 has a function of isolating different pressures from each other.

(Impeller 10)

The impeller 10 is a centrifugal fan. The impeller 10 is driven to rotate, for example, by a motor (not illustrated), and forcibly sends out air outwards in the radial direction of the impeller 10 with a centrifugal force generated by the rotation of the impeller 10. The impeller 10 is rotated, for example, by the motor in the rotation direction R, which is indicated by an arrow. As illustrated in FIGS. 1 to 3, the impeller 10 has a main plate 11 that is discoid, an annular side plate 13, and a plurality of blades 12 that are arranged radially in a circumferential direction of the main plate 11 on a peripheral edge of the main plate 11.

Regarding the shape of the main plate 11, it suffices that the main plate 11 is formed in the shape of a plate. The main plate may, for example, have a shape other than a discoid shape, for example, a polygonal shape. Furthermore, the main plate 11 may be formed such that as illustrated in FIG. 3, the thickness of the main plate 11 increases toward the center in the radial direction around the rotation axis RS, or may be formed such that the thickness is constant in the radial direction around the rotation axis RS. At central part of the main plate 11, a shaft portion 11*b* is provided to which the motor (not illustrated) is connected. The main plate 11 is driven to rotate by the motor via the shaft portion 11*b*. It should be noted that the main plate 11 may be not only a single plate-like member, but also a combination of a plurality of plate-like members formed integrally with each other.

The plurality of blades 12 are arranged in the circumferential direction around the imaginary rotation axis RS of the main plate 11. One end of each of the plurality of blades 12 is connected to the main plate 11, and the other end of each of the plurality of blades 12 is connected to the side plate 13. Each of the plurality of blades 12 is provided between the main plate 11 and the side plate 13. The plurality of blades 12 are provided on both sides of the main plate 11 in the axial direction of the rotation axis RS of the shaft portion 11*b*. The blades 12 are arranged at regular intervals on the peripheral edge of the main plate 11. A configuration of each of the blades 12 will be described in detail later.

The annular side plate 13 of the impeller 10 is attached to ends of the plurality of blades 12 that are opposite to the main plate 11 in the axial direction of the rotation axis RS of the shaft portion 11*b*. In the impeller 10, the side plate 13 is provided opposite to the main plate 11. The side plate 13 couples the plurality of blades 12 with each other, thereby maintaining a positional relationship between a distal end of each blade 12 and the distal end of the other blade 12 and reinforcing the plurality of blades 12.

As illustrated in FIG. 3, the impeller 10 includes the main plate 11, a first blade portion 112*a*, and a second blade portion 112*b*. The first blade portion 112*a* and the second blade portion 112*b* each include a plurality of blades 12 and a side plate 13. More specifically, the first blade portion 112*a* includes an annular first side plate 13*a* provided opposite to the main plate 11 and a plurality of blades 12 provided between the main plate 11 and the first side plate 13*a*. The second blade portion 112*b* includes an annular second side plate 13*b* provided opposite to the main plate 11 at a side of the main plate 11 that is located opposite to the first side plate 13*a* and a plurality of blades 12 provided between the main plate 11 and the second side plate 13*b*. It should be noted that the side plate 13 is a generic name for the first side plate 13*a* and the second side plate 13*b*, and the impeller 10 includes the first side plate 13*a* on one side of the main plate 11 in the axial direction of the rotation axis RS, and includes the second side plate 13*b* on the other side of the main plate 11.

The first blade portion 112*a* is provided on one plate side of the main plate 11, and the second blade portion 112*b* is provided on the other plate side of the main plate 11. That is, the plurality of blades 12 are provided on both sides of the main plate 11 in the axial direction of the rotation axis RS, and the first blade portion 112*a* and the second blade portion 112*b* are provided opposite to each other, with the main plate 11 interposed between the first blade portion 112*a* and the second blade portion 112*b*. It should be noted that referring to FIG. 3, the first blade portion 112*a* is provided on the left side of the main plate 11, and the second blade portion 112*b* is provided on the right side of the main plate 11. However, it suffices that the first blade portion 112*a* and the second blade portion 112*b* are provided opposite to each other, with the main plate 11 interposed between the first blade portion 112*a* and the second blade portion 112*b*. The first blade portion 112*a* may be provided on the right side of the main plate 11, and the second blade portion 112*b* may be provided on the left side of the main plate 11. In the following description, blades 12 included in the first blade portion 112*a* and those blades 12 included in the second blade portion 112*b* are collectively referred to as "blades 12" unless noted otherwise.

The plurality of blades 12 of the impeller 10 are arranged on the main plate 11 such that the impeller 10 is formed in a tubular shape. Moreover, the impeller 10 has an air inlet 10*e* formed on a side of the side plate 13 that is opposite to the main plate 11 in the axial direction of the rotation axis RS of the shaft portion 11*b* and configured to cause gas to flow into a space surrounded by the main plate 11 and the plurality of blades 12. In the impeller 10, the blades 12 and side plates 13 are provided on plate sides of the main plate 11, and air inlets 10*e* are formed on the plate sides of the main plate 11.

The impeller 10 is driven to rotate around the rotation axis RS by driving of the motor (not illustrated). When the impeller 10 is rotated, air that flows at the outside of the multi-blade fan 100 is sucked into the space surrounded by the main plate 11 and the plurality of blades 12 through the suction port 45 formed in the scroll casing 40 and the air inlet 10*e* of the impeller 10. Further, when the impeller 10 is rotated, the air sucked into the space surrounded by the main plate 11 and the plurality of blades 12 is sent out outward in the radial direction of the impeller 10 through spaces between adjacent ones of the blades 12.

(Detailed Configuration of Blade 12)

Figure 4:
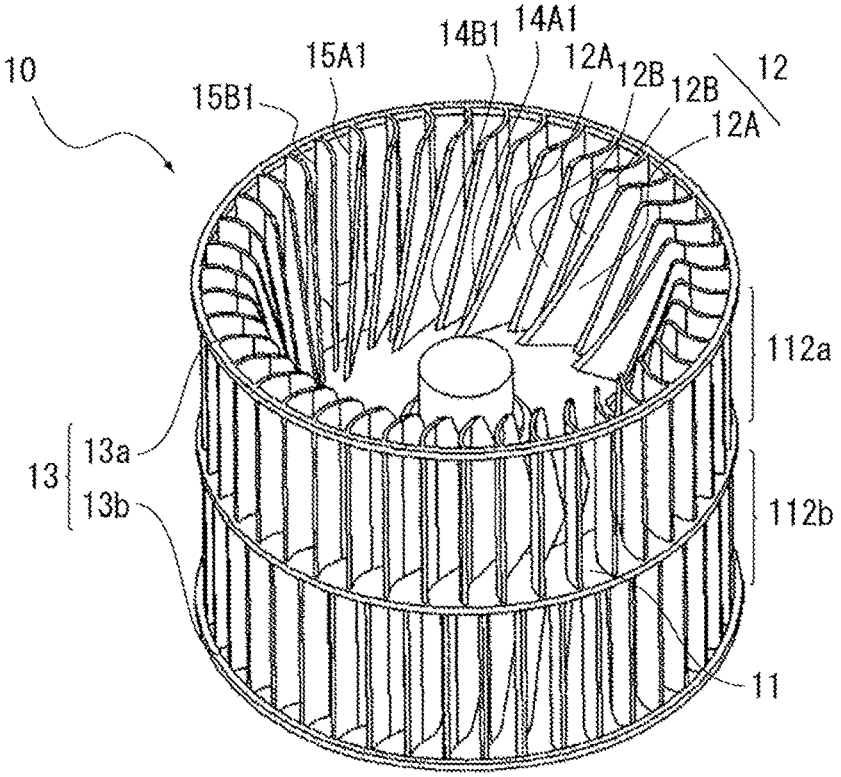
FIG. 4 is a perspective view of an impeller of the multi-blade fan according to Embodiment 1.
Figure 5:
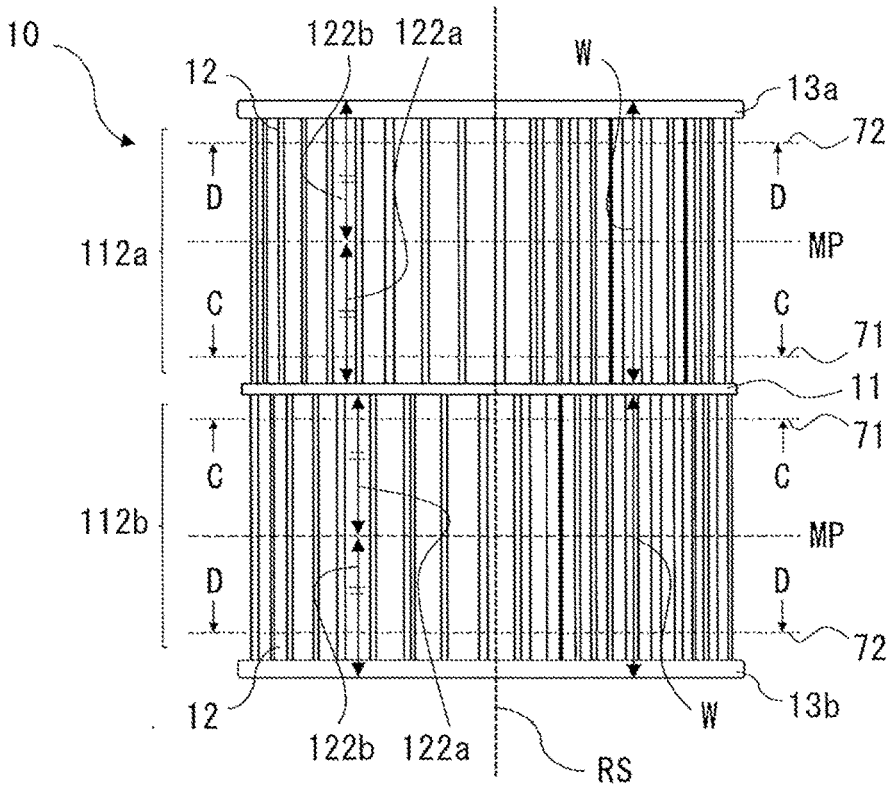
FIG. 5 is a side view of the impeller as illustrated in FIG. 4.
Figure 6:
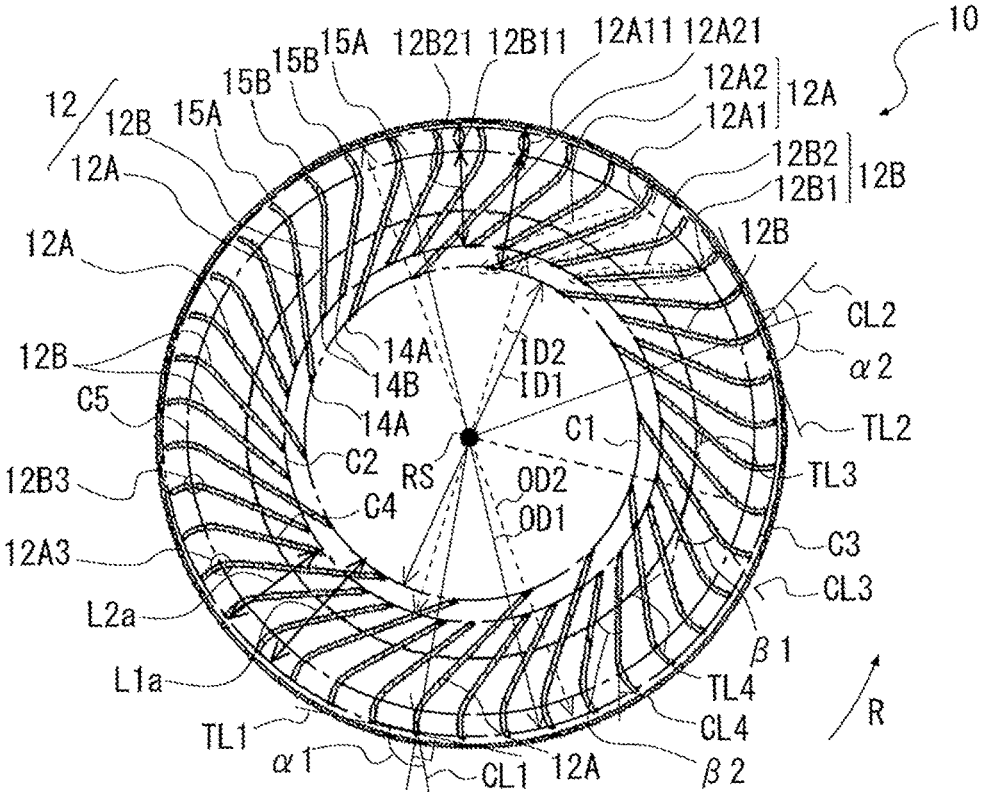
FIG. 6 is a schematic view of blades in a section of the impeller that is taken along line C-C in FIG. 5.
Figure 7:
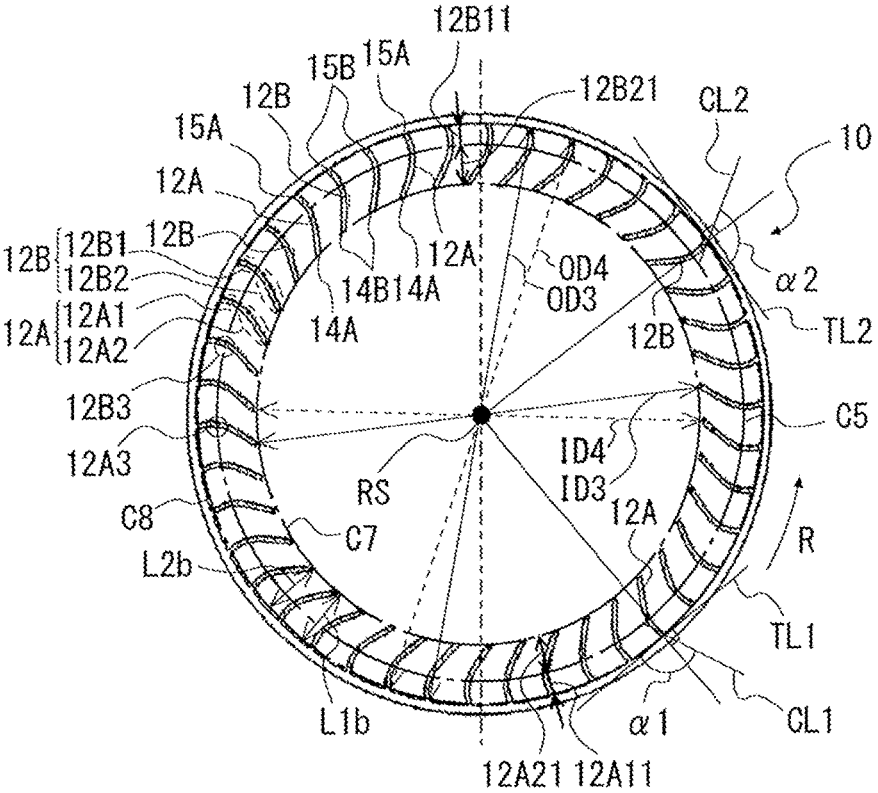
FIG. 7 is a schematic view of the blades in a section of the impeller that is taken along line D-D in FIG. 5.

FIG. 4 is a perspective view of the impeller 10 of the multi-blade fan 100 according to Embodiment 1. FIG. 5 is a side view of the impeller 10 as illustrated in FIG. 4. FIG. 6 is a schematic view of the blades 12 in a section of the impeller 10 that is taken along line C-C in FIG. 5. FIG. 7 is a schematic view of the blades 12 in a section of the impeller 10 that is taken along line D-D in FIG. 5. In FIG. 5, a middle position MP of the impeller 10 indicates a middle position in the axial direction of the rotation axis RS in each of the plurality of blades 12 included in the first blade portion 112*a*. Moreover, in the plurality of blades 12 included in the first blade portion 112*a*, a region from the middle position MP to the main plate 11 in the axial direction of the rotation axis RS is a main-plate-side blade region 122*a* that is a first region of the impeller 10. In the plurality of blades 12 included in the first blade portion 112*a*, a region from the middle position MP to an end portion of the side plate 13 in the axial direction of the rotation axis RS is a side-plate-side blade region 122*b* that is a second region of the impeller 10. That is, each of the plurality of blades 12 has a first region located closer to the main plate 11 than the middle position MP in the axial direction of the rotation axis RS and a second region located closer to the side plate 13 than the first region.

As illustrated in FIG. 6, the section taken along line C-C in FIG. 5 is a section of part of the blades 12 that is closer to the main plate 11 of the impeller 10, that is, a section of part of the blades 12 that is located in the main-plate-side blade region 122*a* corresponding to the first region. This section of the part of the blades 12 that is closer to the main plate 11 is a first plane 71 perpendicular to the rotation axis RS and a first section of the impeller 10 that is taken by cutting part of the impeller 10 that is closer to the main plate 11. It should be noted that the above part of the impeller 10 that is closer to the main plate 11 is, for example, part of the impeller 10 that is closer to the main plate 11 than the middle position of the main-plate-side blade region 122*a* in the axial direction of the rotation axis RS or part of the impeller 10 in which end portions of the blades 12 that are closer the main plate 11 are located in the axial direction of the rotation axis RS.

As illustrated in FIG. 7, the section taken along line D-D in FIG. 5 is a section of part of the blades 12 that is closer to the side plate 13 of the impeller 10, that is, a section of the blades 12 that is located in the side-plate-side blade region 122*b* corresponding to the second region. The section of the part of the blades 12 that is closer to the side plate 13 is a second plane 72 perpendicular to the rotation axis RS and a second section of the impeller 10 that is taken by cutting part of the impeller 10 that is closer to the side plate 13. It should be noted that that the part of the impeller 10 that is closer to the side plate 13 is, for example, part of the impeller 10 that is closer to the side plate 13 than the middle position of the side-plate-side blade region 122*b* in the axial direction of the rotation axis RS or part of the impeller 10 in which end portions of the blades 12 that are closer to the side plate 13 are located in the axial direction of the rotation axis RS.

A basic configuration of the blades 12 in the second blade portion 112*b* is similar to a basic configuration of the blades 12 in the first blade portion 112*a*. That is, the middle position MP of the impeller 10 as indicated in FIG. 5 is a middle position of each of the plurality of blades 12 included in the second blade portion 112*b* in the axial direction of the rotation axis RS. Moreover, in the plurality of blades 12 included in the second blade portion 112*b*, a region from the middle position MP to the main plate 11 in the axial direction of the rotation axis RS is a main-plate-side blade region 122*a* that is a first region of the impeller 10. Furthermore, in the plurality of blades 12 included in the second blade portion 112*b*, a region from the middle position MP to an end portion of the second side plate 13*b* in the axial direction of the rotation axis RS is a side-plate-side blade region 122*b* that is a second region of the impeller 10. Although it is described above that the basic configuration of the first blade portion 112*a* and the basic configuration of the second blade portion 112*b* are similar to each other, the configuration of the impeller 10 is not limited to such a configuration, and the first blade portion 112*a* and the second blade portion 112*b* may have different configurations. That is, both or one of the first blade portion 112*a* and the second blade portion 112*b* may have the configuration of the blades 12 that will be described below. The configuration of the blades 12 will be described detail with reference to FIGS. 4 to 7.

As illustrated in FIGS. 4 to 7, the plurality of blades 12 include a plurality of first blades 12A and a plurality of second blades 12B. To be more specific, in the plurality of blades 12, the first blades 12A and the second blades 12B are alternately arranged in the circumferential direction of the impeller 10. In the rotation direction R, between any adjacent two of the first blades 12A, two second blades 12B are provided in the rotation direction R as illustrated in FIGS. 4 and 6. However, the number of second blades 12B that are provided between any adjacent two of the first blades 12A in the rotation direction R is not limited to 2, but may be 1 or larger than or equal to 3. That is, between any adjacent two of the first blades 12A in the circumferential direction, at least one second blade 12B is provided.

In the first section of the impeller 10 that is taken along the first plane 71 perpendicular to the rotation axis RS, each of the first blades 12A has an inner circumferential end 14A located closer to the rotation axis RS in a radial direction around the rotation axis RS and an outer circumferential end 15A located closer to an outer circumferential side than the inner circumferential end 14A in the radial direction. In each of the first blades 12A, the inner circumferential end 14A is provided more forward than the outer circumferential end 15A in the rotation direction R of the impeller 10. As illustrated in FIG. 4, the inner circumferential end 14A serves as a leading edge 14A1 of the first blade 12A, and the outer circumferential end 15A serves as a trailing edge 15A1 of the first blade 12A. As illustrated in FIG. 6, in the impeller 10, fourteen first blades 12A are provided. However, the number of first blades 12A is not limited to 14 but may be smaller or larger than 14.

In the first section of the impeller 10 that is taken along the first plane 71 perpendicular to the rotation axis RS, each of the second blades 12B has an inner circumferential end 14B located closer to the rotation axis RS in the radial direction around the rotation axis RS and an outer circumferential end 15B located closer to an outer circumferential side than the inner circumferential end 14B in the radial direction. In each of the plurality of second blades 12B, the inner circumferential end 14B is provided more forward than the outer circumferential end 15B in the rotation direction R of the impeller 10. As illustrated in FIG. 4, the inner circumferential end 14B serves as a leading edge 14B1 of the second blade 12B, and the outer circumferential end 15B serves as a trailing edge 1511 of the second blade 12B. As illustrated in FIG. 6, in the impeller 10, twenty-eight second blades 12B are provided. However, the number of second blades 12B is not limited to 28, but may be smaller or larger than 28.

Next, a relationship between the first blades 12A and the second blades 12B will be described. As illustrated in FIGS. 4 and 7, the blade length of part of each of the first blades 12A that is closer to the first side plate 13*a* and the second side plate 13*b* than the middle positions MP in the direction along the rotation axis RS is equal to the blade length of each of part of each of the second blades 12B that is closer to the first side plate 13*a* and the second side plate 13*b* than the middle positions MP in the direction along the rotation axis RS. On the other hand, as illustrated in FIGS. 4 and 6, the blade length of part of each of the first blades 12A that is closer to the main plate 11 than the middle position MP in the direction along the rotation axis RS is greater than the blade length of part of each of the second blades 12B that is closer to the main plate 11 than the middle position MP in the direction along the rotation axis RS, and the closer the above part of the first blade 12A to the main plate 11, the greater the blade length of the part of the first blade 12A. Thus, in the present embodiment, the blade length of at least part of the first blade 12A in the direction along the rotation axis RS is greater than the blade length of at least part of the second blade 12B in the direction along the rotation axis RS. It should be noted that the above term "blade length" means the length of the first blade 12A in the radial direction of the impeller 10 and the length of the second blade 12B in the radial direction of the impeller 10.

It is assumed that as illustrated in FIG. 6, in the first section closer to the main plate 11 than the middle position MP indicated in FIG. 5, the diameter of a circle C1 drawn through the inner circumferential ends 14*a* of the first blades 12A around the rotation axis RS, that is, the inside diameter of the first blades 12A, is an inside diameter ID1; the diameter of a circle C3 drawn through outer circumferential ends 15A of the first blades 12A around the rotation axis RS, that is, the outside diameter of the first blades 12A, is an outside diameter OD1. Half of the difference between the outside diameter OD1 and the inside diameter ID1 is equal to blade length L1*a* of each of the first blades 12A in the first section (blade length L1*a*=[outside diameter OD1−inside diameter ID1]/2). It should be noted that the ratio of the inside diameter of the first blades 12A to the outside diameters of the first blades 12A is lower than or equal to 0.7. That is, in the first blades 12A, the ratio of the inside diameter ID1 of the circle drawn through the inner circumferential ends 14A of the first blades 12A to the outside diameter OD1 of the circle drawn through the outer circumferential ends 15A of the first blades 12A is lower than or equal to 0.7. It should be noted that in a common multi-blade fan, the blade length of a blade in a section perpendicular to a rotation axis is smaller than the width of a blade in a direction parallel to the rotation axis. In the present embodiment also, the maximum blade length of each of the first blades 12A, that is, the blade length of one of ends of each of the first blades 12A that is closer to the main plate 11 is shorter than the width W (see FIG. 5) of each of the first blades 12A in the direction parallel to the rotation axis.

Furthermore, it is also assumed that in the first section, the diameter of a circle C2 drawn through the inner circumferential ends 14B of the second blades 12B around the rotation axis RS, that is, the inside diameter of the second blades 12B, is an inside diameter ID2 that is larger than the inside diameter ID1 (inside diameter ID2>inside diameter ID1); and the diameter of the circle C3 drawn through the outer circumferential ends 15B of the second blades 12B around the rotation axis RS, that is, the outside diameter of the second blades 12B, is an outside diameter OD2 that is equal to the outside diameter OD1 (outside diameter OD2=outside diameter OD1). Half of the difference between the outside diameter OD2 and the inside diameter ID2 is equal to the blade length L2*a* of each of the second blades 12B in the first section (blade length L2*a*=[outside diameter OD2−inside diameter ID2]/2). In the first section, the blade length L2*a* of each of the second blades 12B is smaller than the blade length L1*a* of each of the first blades 12A (blade length L2*a*<blade length L1*a*). It should be noted that the ratio of the inside diameter of the second blades 12B to the outside diameter of the second blades 12B is lower than or equal to 0.7. That is, in the second blades 12B, the ratio of the inside diameter ID2 of the circle drawn through the inner circumferential ends 14B of the second blades 12B to the outside diameter OD2 of the circle drawn through the outer circumferential ends 15B of the second blades 12B is lower than or equal to 0.7.

Furthermore, it is assumed that as illustrated in FIG. 7, in the second section closer to the side plate 13 than the middle position MP indicated in FIG. 5, the diameter of a circle C7 drawn through the inner circumferential ends 14A of the first blades 12A around the rotation axis RS is an inside diameter ID3. The inside diameter ID3 is larger than the inside diameter ID1 of the first section (inside diameter ID3>inside diameter ID1). It is assumed that the diameter of a circle C8 drawn through the outer circumferential ends 15A of the first blades 12A around the rotation axis RS is an outside diameter OD3. Half of the difference between the outside diameter OD3 and the inside diameter ID1 is equal to the blade length L1*b* of each of the first blades 12A in the second section (blade length Lib=[outside diameter OD3−inside diameter ID3]/2).

Also, it is assumed that in the second section, the diameter of the circle C7 drawn through the inner circumferential ends 14B of the second blades 12B around the rotation axis RS is an inside diameter ID4. In the second section, the inside diameter ID4 is equal to the inside diameter ID3 (inside diameter ID4=inside diameter ID3). It is assumed that the diameter of the circle C8 drawn through the outer circumferential ends 15B of the second blades 12B around the rotation axis RS is an outside diameter OD4. In the second section, the outside diameter OD4 is equal to the outside diameter OD3 (outside diameter OD4=outside diameter OD3). Half of the difference between the outside diameter OD4 and the inside diameter ID4 is equal to the blade length L2*b* of each of the second blades 12B in the second section (blade length L2*b*=(outside diameter OD4−inside diameter ID4)/2). In the second section, the blade length L2*b* of each of the second blades 12B is equal to the blade length LIb of each of the first blades 12A (blade length L2*b*=blade length L1*b*).

As viewed from a direction parallel to the rotation axis RS, the first blades 12A in the second section as illustrated in FIG. 7 overlap with the first blades 12A in the first section as illustrated in FIG. 6 so as not to project from the contours of the first blades 12A in the first section as illustrated in FIG. 6. Thus, the impeller 10 satisfies the relationships "outside diameter OD3=outside diameter OD1", "inside diameter ID3 inside diameter ID1", and "blade length L1*b*≤blade length L1*a*".

Similarly, as viewed in the direction parallel to the rotation axis RS, the second blades 12B in the second section as illustrated in FIG. 7 overlap with the second blades 12B in the first section as illustrated in FIG. 6 so as not to project from the contours of the second blades 12B in the first section as illustrated in FIG. 6. For this reason, the impeller 10 satisfies the relationships "outside Diameter OD4=outside diameter OD2", "inside diameter ID4≥inside diameter ID2", and "blade length L2*b*≤blade length L2*a*".

It should be noted that as described above, the ratio of the inside diameter ID1 to the outside diameter OD1 of the first blades 12A is lower than or equal to 0.7. Since the blades 12 are configured such that the inside diameter ID3≥the inside diameter ID1, the inside diameter ID4≥an inside diameter ID2, and the inside diameter ID2>the inside diameter ID1, the inside diameter of the first blades 12A can be the blade inside diameter of the blades 12. Furthermore, since the blades 12 are configured such that the outside diameter OD3=the outside diameter OD1, the outside diameter OD4=the outside diameter OD2, and the outside diameter OD2=the outside diameter OD1, the outside diameter of the first blades 12A can be the blade outside diameter of the blades 12. Moreover, in the case where the blades 12 included in the impeller 10 are seen as a whole, the blades 12 are configured such that the ratio of the blade inside diameter to the blade outside diameter of the blades 12 is lower than or equal to 0.7. It should be noted that the blade inside diameter of the blades 12 is the diameter of the circle drawn through the inner circumferential ends of the plurality of blades 12. That is, the blade inside diameter of the blades 12 is the diameter of a circle drawn through the leading edges 14A1 of the plurality of blades 12. Furthermore, the blade outside diameter of the blades 12 is the diameter of the circle drawn through the outer circumferential ends of the plurality of blades 12. That is, the blade outside diameter of the blades 12 is the diameter of a circle drawn through the trailing edges 15A1 and 15B1 of the blades 12.

(Configuration of First Blades 12A and Second Blades 12B)

In a comparison between the first section as illustrated in FIG. 6 and the second section as illustrated in FIG. 7, each of the first blades 12A has the relationship "blade length L1*a*>blade length L1*b*". That is, each of the plurality of blades 12 is formed such that a blade length in the first region is greater than a blade length in the second region. More specifically, each of the first blades 12A is formed such that its blade length decreases from the main plate 11 toward the side plate 13 in the axial direction of the rotation axis RS. Similarly, in a comparison between the first section as illustrated in FIG. 6 and the second section as illustrated in FIG. 7, each of the second blades 12B has the relationship "blade length L2*a*>blade length L2*b*". That is, each of the second blades 12B is formed such that the blade length decreases from the main plate 11 toward the side plate 13 in the axial direction of the rotation axis RS.

As illustrated in FIG. 3, the leading edges of the first blades 12A and the second blades 12B are inclined such that the blade inside diameter increases from the main plate 11 toward the side plate 13. That is, the plurality of blades 12 form an inclined portion 141A that is inclined such that in the direction from the main plate 11 toward the side plate 13, the distance between the inner circumferential ends 14A forming the leading edges 14A1 and the rotation axis RS gradually increases and the blade inside diameter increases. Similarly, the plurality of blades 12 form an inclined portion 141B is inclined such that in the direction from the main plate 11 toward the side plate 13, the distance between the inner circumferential ends 14B forming the leading edges 14B1 and the rotation axis RS gradually increases and the blade inside diameter increases.

(Sirocco Blade Portion and Turbo Blade Portion)

As illustrated in FIGS. 6 and 7, each of the first blades 12A has a first sirocco blade portion 12A1 formed as a forward-swept blade portion and a first turbo blade portion 12A2 formed as a swept-back blade portion. In the radial direction of the impeller 10, the first sirocco blade portion 12A1 forms an outer circumferential side of the first blade 12A, and the first turbo blade portion 12A2 forms an inner circumferential side of the first blade 12A. That is, the first blade 12A is configured such that the first turbo blade portion 12A2 and the first sirocco blade portion 12A1 are arranged in this order from the rotation axis RS toward the outer circumferential side in the radial direction of the impeller 10. In the first blade 12A, the first turbo blade portion 12A2 and the first sirocco blade portion 12A1 are integrally formed. The first turbo blade portion 12A2 forms the leading edge 14A1 of the first blade 12A, and the first sirocco blade portion 12A1 forms the trailing edge 15A1 of the first blade 12A. In the radial direction of the impeller 10, the first turbo blade portion 12A2 linearly extends from the inner circumferential end 14A forming the leading edge 14A1 toward the outer circumferential side.

In the radial direction of the impeller 10, a region where the first sirocco blade portion 12A1 of the first blade 12A is formed will be referred to as a first sirocco region 12A11, and an area where the first turbo blade portion 12A2 of the first blade 12A is formed will be referred to as a first turbo region 12A21. The first blade 12A is configured such that the first turbo region 12A21 is larger than the first sirocco region 12A11 in the radial direction of the impeller 10. Moreover, in both the main-plate-side blade region 122*a* serving as the first region and the side-plate-side blade region 122*b* serving as the second region, the impeller 10 has the relationship "first sirocco region 12A11<first turbo region 12A21" in the radial direction of the impeller 10. In the impeller 10 and the first blade 12A, in both the main-plate-side blade region 122*a* serving as the first region and the side-plate-side blade region 122*b* serving as the second region, the ratio of the first turbo blade portion 12A2 to the first sirocco blade portion 12A1 in the radial direction of the impeller 10 is high.

Similarly, as illustrated in FIGS. 6 and 7, each of the second blades 12B has a second sirocco blade portion 12B1 formed as a forward-swept blade portion and a second turbo blade portion 12B2 formed as a swept-back blade portion. In the radial direction of the impeller 10, the second sirocco blade portion 12B1 forms an outer circumferential side of the second blade 12B, and the second turbo blade portion 12B2 forms an inner circumferential side of the second blade 12B. That is, the second blades 12B is configured such that the second turbo blade portion 12B2 and the second sirocco blade portion 12B1 are arranged in this order from the rotation axis RS toward the outer circumferential side in the radial direction of the impeller 10. In the second blade 12B, the second turbo blade portion 12B2 and the second sirocco blade portion 12B1 are integrally formed. The second turbo blade portion 12B2 forms the leading edge 14B1 of the second blade 12B, and the second sirocco blade portion 12B1 forms the trailing edge 15B1 of the second blade 12B. In the radial direction of the impeller 10, the second turbo blade portion 12B2 linearly extends from the inner circumferential end 14B forming the leading edge 14B1 toward the outer circumferential side.

In the radial direction of the impeller 10, a region where the second sirocco blade portion 12B1 of the second blade 12B is formed will be referred to as a second sirocco region 12B11, and a region where the second turbo blade portion 12B2 of the second blade 12B is formed will be referred to as a second turbo region 12B21. The second blade 12B is configured such that the second turbo region 12B21 is larger than the second sirocco region 12B11 in the radial direction of the impeller 10. Moreover, in both the main-plate-side blade region 122*a* serving as the first region and the side-plate-side blade region 122*b* serving as the second region, the impeller 10 has the relationship "second sirocco region 12B11<second turbo region 12B21" in the radial direction of the impeller 10. In the impeller 10 and the second blade 12B, in both the main-plate-side blade region 122*a* serving as the first region and the side-plate-side blade region 122*b* serving as the second region, the ratio of the second turbo blade portion 12B2 to the second sirocco blade portion 12B1 in the radial direction of the impeller 10 is high.

In the above configuration, each of the plurality of blades 12 is configured such that in both the main-plate-side blade region 122*a* and the side-plate-side blade region 122*b*, a region where the turbo blade portion is formed is larger than a region where the sirocco blade portion is formed, in the radial direction of the impeller 10. That is, each of the plurality of blades 12 is configured such that in both the main-plate-side blade region 122*a* and the side-plate-side blade region 122*b*, the ratio of the turbo blade portion to the sirocco blade portion in the radial direction of the impeller 10 is high, and have the relationship "sirocco region <turbo region". In other words, each of the plurality of blades 12 is configured such that in the first region and the second region, a ratio of the turbo blade portion in the radial direction is larger than a ratio of the sirocco blade portion in the radial direction. It should be noted that the configuration of the plurality of blades 12 is not limited to a configuration in which both the main-plate-side blade region 122*a* and the side-plate-side blade region 122*b*, the ratio of the turbo blade portion to the sirocco blade portion in the radial direction of the impeller 10 is high, and the relationship "sirocco region <turbo region" is satisfied. Each of the plurality of blades 12 may be configured such that in the first region and the second region, the ratio of the turbo blade portion to the sirocco blade portion in the radial direction is low, or the ratio of the turbo blade portion to the sirocco blade portion in the radial direction is equal to the ratio of the sirocco blade portion to the turbo blade portion in the radial direction.

(Outlet Angle)

It is assumed that as illustrated in FIG. 6, a blade outlet angle of the first sirocco blade portion 12A1 of each of the first blades 12A in the first section is an outlet angle $\alpha 1$. The outlet angle $\alpha 1$ is defined as an angle formed by a tangent line TL1 and a center line CL1 of the first sirocco blade portion 12A1 at the outer circumferential end 15A, at an intersection of a segment of the circle C3 around the rotation axis RS and the outer circumferential end 15A. This outlet angle $\alpha 1$ is greater than 90 degrees. It is assumed that an outlet angle of the second sirocco blade portion 12B1 of each of the second blades 12B in the same cross-section is an outlet angle $\alpha 2$. The outlet angle $\alpha 2$ is defined as an angle formed by a tangent line TL2 and a center line CL2 of the second sirocco blade portion 12B1 at the outer circumferential end 15B, at an intersection of a segment of the circle C3 around the rotation axis RS and the outer circumferential end 15B. The outlet angle $\alpha 2$ is greater than 90 degrees. The outlet angle $\alpha 2$ of the second sirocco blade portion 12B1 is equal to the outlet angle $\alpha 1$ of the first sirocco blade portion 12A1 (outlet angle $\alpha 2$=outlet angle $\alpha 1$). The first sirocco blade portion 12A1 and the second sirocco blade portion 12B1 are curved convex in the opposite direction to the rotation direction R as viewed in the direction parallel to the rotation axis RS.

As illustrated in FIG. 7, in the impeller 10, in the second section also, the outlet angle $\alpha 1$ of the first sirocco blade portion 12A1 and the outlet angle $\alpha 2$ of the second sirocco blade portion 12B1 are equal to each other. That is, each of the plurality of blades 12 has a sirocco blade portion that is formed as a forward-swept blade portion such that in a region from the main plate 11 to the side plate 13, the outlet angle is greater than 90 degrees.

Furthermore, it is assumed that as illustrated in FIG. 6, an outlet angle of the first turbo blade portion 12A2 of each of the first blades 12A in the first section is an outlet angle $\beta 1$. The outlet angle $\beta 1$ is defined as an angle formed by a tangent line TL3 and a center line CL3 of the first turbo blade portion 12A2 at an intersection of a segment of a circle C4 around the rotation axis RS and the first turbo blade portion 12A2. This outlet angle $\beta 1$ is smaller than 90 degrees. It is assumed that an outlet angle of the second turbo blade portion 12B2 of each of the second blades 12B in the first section is an outlet angle $\beta 2$. The outlet angle $\beta 2$ is defined as an angle formed by a tangent line TL4 and a center line CL4 of the second turbo blade portion 12B2 at an intersection of a segment of the circle C4 around the rotation axis RS and the second turbo blade portion 12B2. The outlet angle $\beta 2$ is smaller than 90 degrees. The outlet angle $\beta 2$ of the second turbo blade portion 12B2 is equal to the outlet angle β1 of the first turbo blade portion 12A2 (outlet angle β2=outlet angle β1).

Although it is not illustrated in FIG. 7, in the impeller 10, in the second section also, the outlet angle β1 of the first turbo blade portion 12A2 and the outlet angle β2 of the second turbo blade portion 12B2 are equal to each other. Furthermore, the outlet angle β1 and the outlet angle β2 are smaller than 90 degrees.

(Radial Blade Portion)

As illustrated in FIGS. 6 and 7, each of the first blades 12A has a first radial blade portion 12A3 that connects the first turbo blade portion 12A2 and the first sirocco blade portion 12A1. The first radial blade portion 12A3 is formed as a radial blade that linearly extends in the radial direction of the impeller 10. Similarly, each of the second blades 12B has a second radial blade portion 12B3 that connects the second turbo blade portion 12B2 and the second sirocco blade portion 12B1. The second radial blade portion 12B3 is formed as a radial blade that linearly extends in the radial direction of the impeller 10. The first radial blade portion 12A3 and the second radial blade portion 12B3 each have a blade angle of 90 degrees. More specifically, an angle formed by a tangent line at an intersection of a center line of the first radial blade portion 12A3 and a circle C5 around the rotation axis RS and the center line of the first radial blade portion 12A3 is 90 degrees. Furthermore, an angle formed by a tangent line at an intersection of a center line of the second radial blade portion 12B3 and the circle C5 around the rotation axis RS and the center line of the second radial blade portion 12B3 is 90 degrees.

Figure 8:
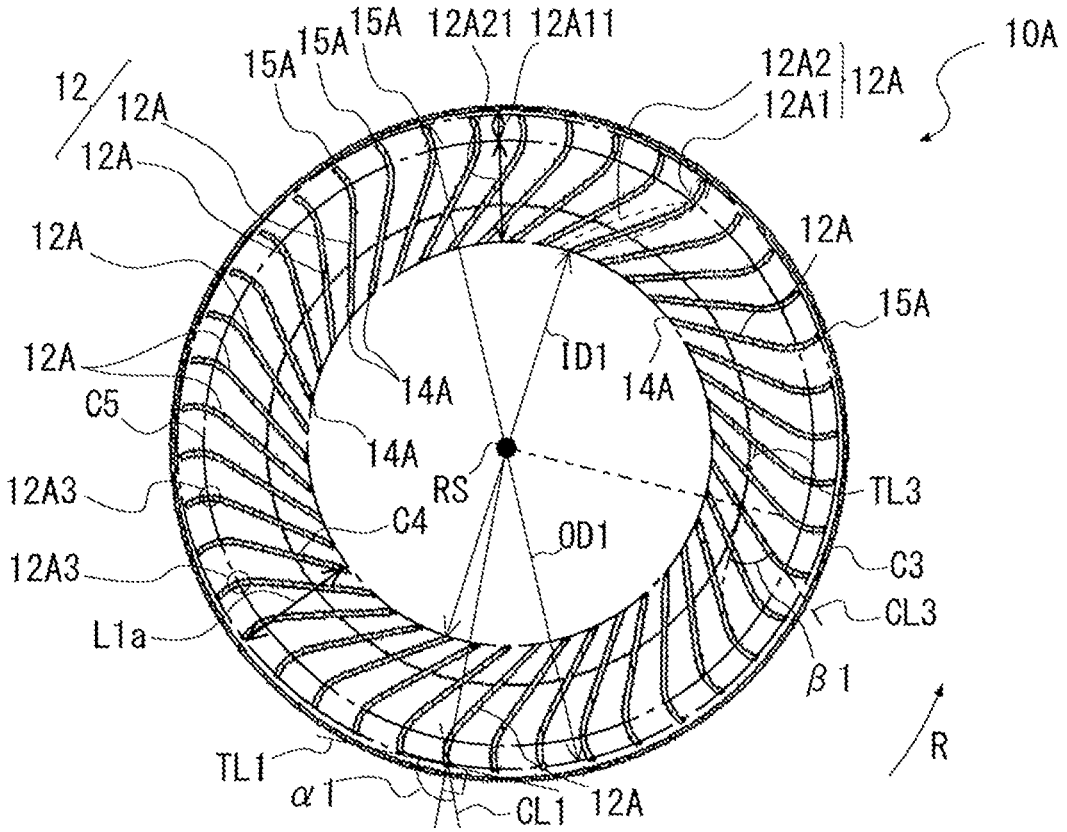
FIG. 8 is a schematic view of a section of an impeller according to a modification of the impeller illustrated in FIG. 6.

FIG. 8 is a schematic view of a section of an impeller 10A of a modification of the impeller 10 illustrated in FIG. 6. FIG. 8 that illustrates the impeller 10A of the modification is a schematic view that illustrates blades 12 in a section of the impeller 10 that is taken along line C-C in FIG. 5. The impeller 10A includes a plurality of blades 12. The plurality of blades 12 include first blades 12A, but does not include second blades 12B. As in the impeller 10A according to the modification, the blades 12 may be made up of first blades 12A only.

(Inter-Blade Distance)

Figure 9:
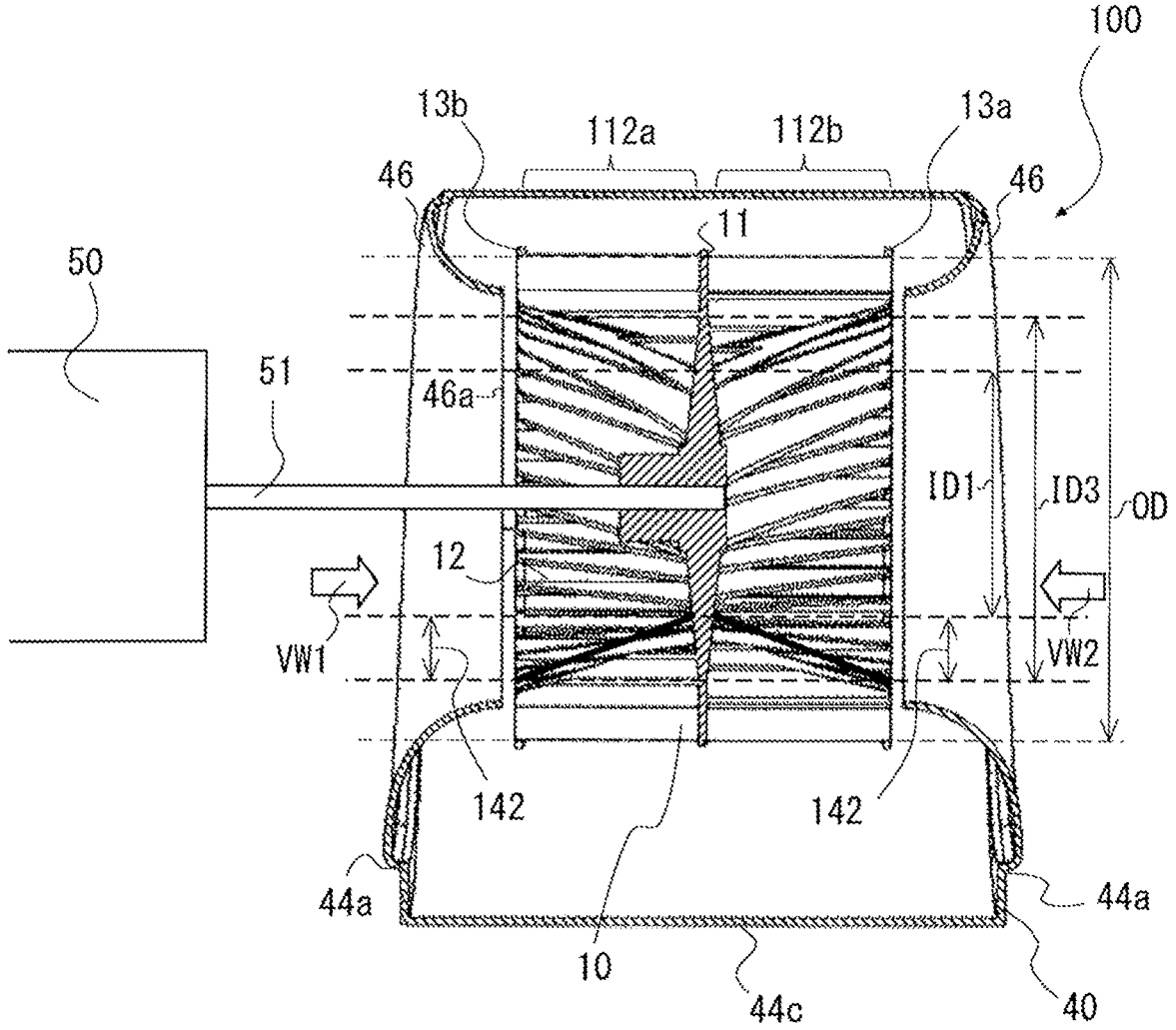
FIG. 9 is a conceptual diagram for explanation of the impeller connected to a motor in the multi-blade fan according to Embodiment 1.
Figure 10:
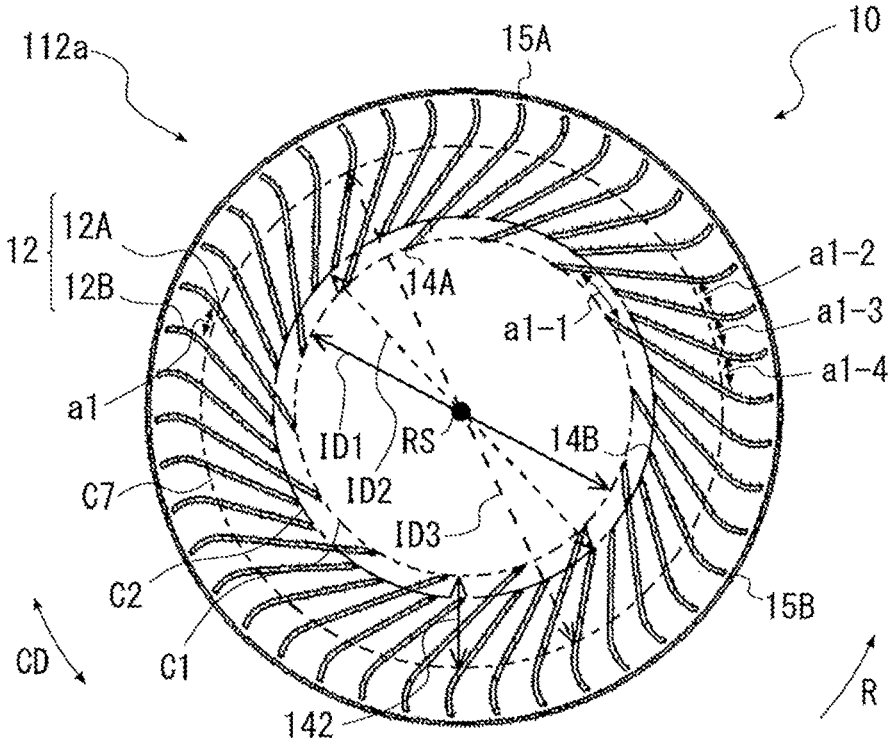
FIG. 10 is a schematic view of blades in a section of a first blade portion that is taken along line C-C in FIG. 5.
Figure 11:
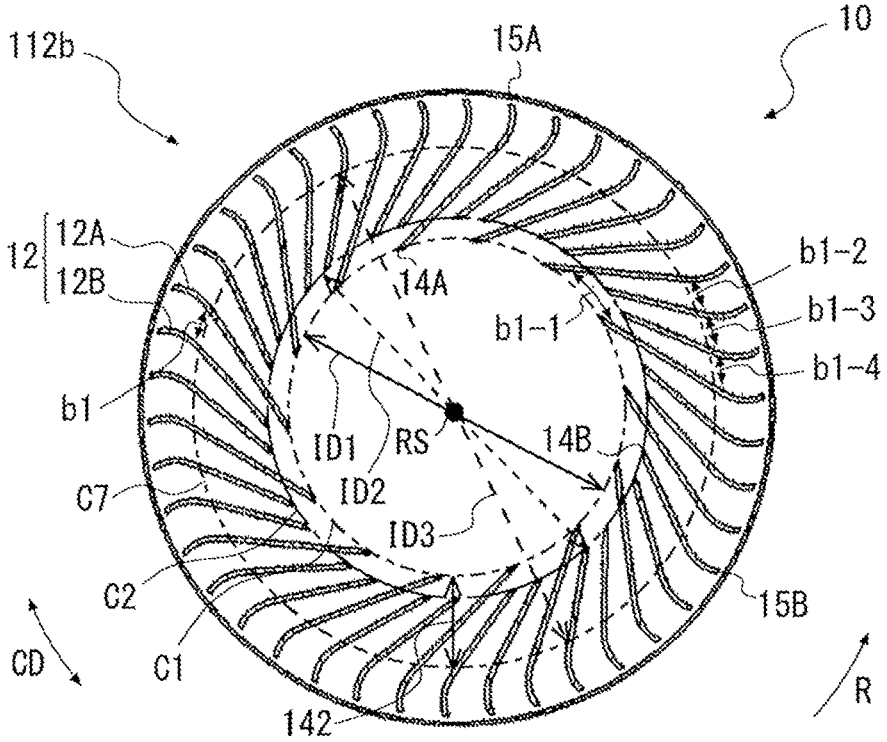
FIG. 11 is a schematic view of blades in a section of a second blade portion that is taken along line C-C in FIG. 5.
Figure 12:
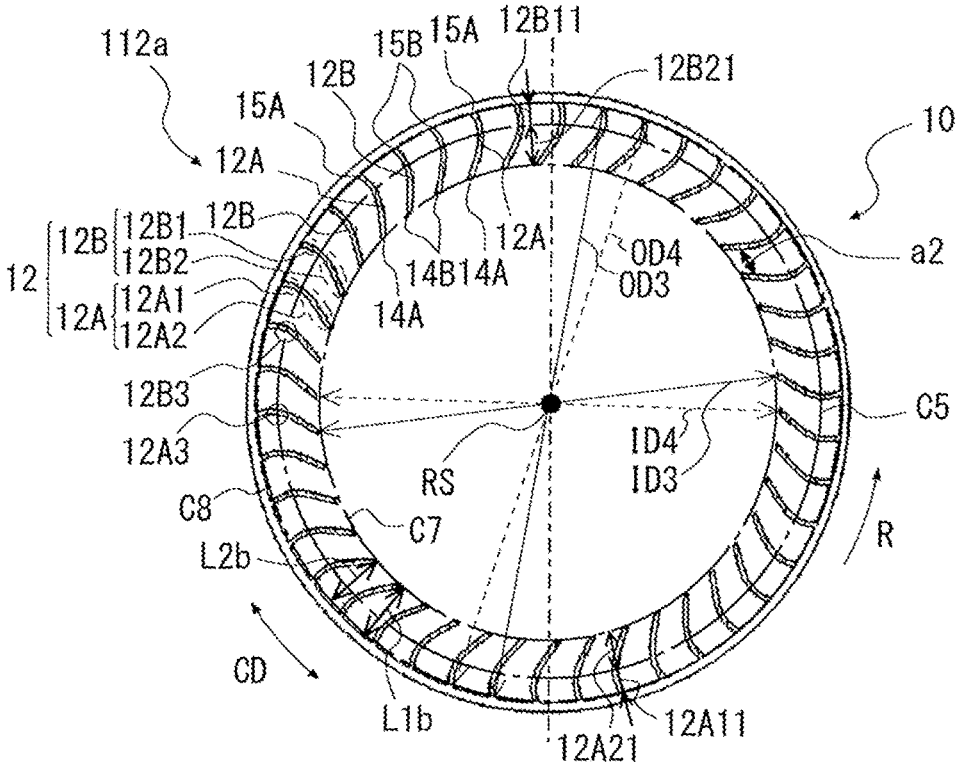
FIG. 12 is a schematic view of the blades in a section of the first blade portion that is taken along line D-D in FIG. 5.
Figure 13:
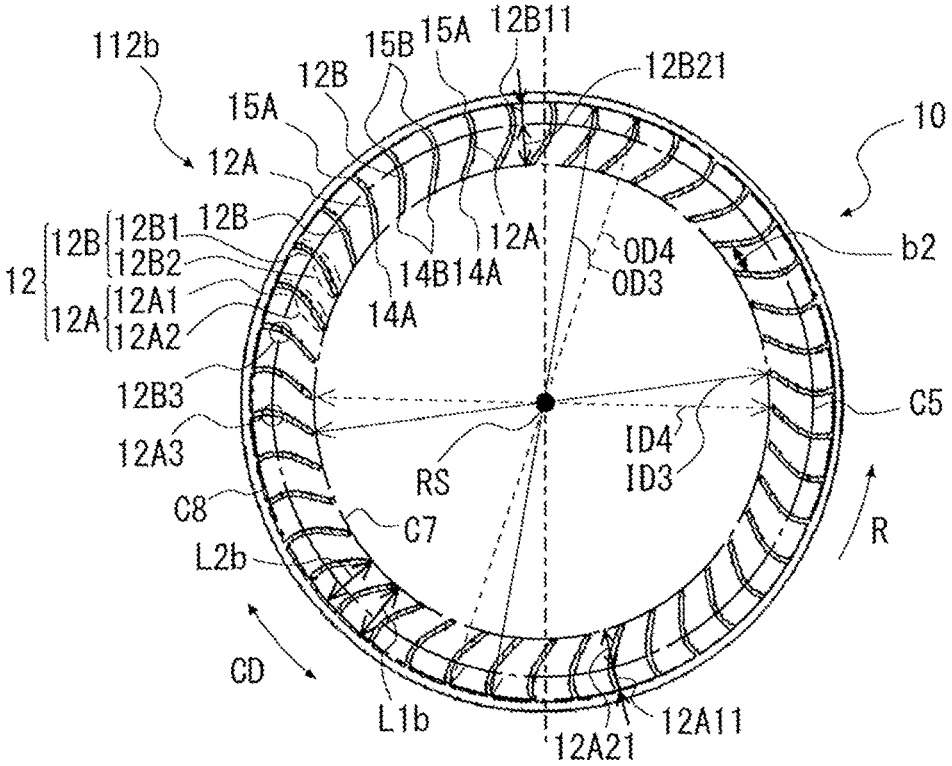
FIG. 13 is a schematic view of the blades in a section of the second blade portion that is taken along line D-D in FIG. 5.

FIG. 9 is a conceptual diagram for explanation of the impeller 10 connected to a motor 50 in the multi-blade fan 100 according to Embodiment 1. FIG. 10 is a schematic view illustrating the blades 12 in a section of the first blade portion 112*a* that is taken along line C-C in FIG. 5. FIG. 11 is a schematic view illustrating the blades 12 in a section of the second blade portion 112*b* that is taken along line C-C in FIG. 5. FIG. 12 is a schematic view illustrating the blades 12 in a section of the first blade portion 112*a* that is taken along line D-D in FIG. 5. FIG. 13 is a schematic view illustrating the blades 12 in a section of the second blade portion 112*b* that is taken along line D-D in FIG. 5. The distance between any adjacent ones of blades 12 arranged in the circumferential direction will be described with reference to FIGS. 9 to 13. FIGS. 10 and 12 illustrate respective sections of the impeller 10 as viewed in a direction indicated by an arrow VW1 in FIG. 9. FIGS. 11 and 13 illustrate respective sections of the impeller 10 as viewed in a direction indicated by an arrow VW2 in FIG. 9.

It should be noted that the between any adjacent two of the blades 12 arranged in the circumferential direction will be referred to as an inter-blade distance. In the blades 12, the inter-blade distance increases from the leading edges 14A1 toward the trailing edges 15A1 as illustrated in FIGS. 10 to 13, and similarly, the inter-blade distance increases from the leading edges 14B1 toward the trailing edges 15B1. Specifically, the inter-blade distance in the turbo blade portion including the first turbo blade portion 12A2 and the second turbo blade portion 12B2 increases from the inner circumferential side toward the outer circumferential side. Also, the inter-blade distance in a sirocco blade portion including a first sirocco blade portion 12A1 and a second sirocco blade portion 12B1 is longer than the inter-blade distance in the turbo blade portion and increases from the inner circumferential side toward the outer circumferential side. That is, the inter-blade distance between a first turbo blade portion 12A2 and a second turbo blade portion 12B2 or the inter-blade distance between adjacent second turbo blade portions 12B2 increases from the inner circumferential side toward the outer circumferential side. Furthermore, the inter-blade distance between the first sirocco blade portion 12A1 and the second sirocco blade portion 12B1 or the inter-blade distance between adjacent second sirocco blade portions 12B1 is longer than the inter-blade distance in the turbo blade portion and increases from the inner circumferential side toward the outer circumferential side.

As illustrated in FIG. 9, the multi-blade fan 100 may include a motor 50 that rotates the main plate 11 of the impeller 10, in addition to the impeller 10 and the scroll casing 40. That is, the multi-blade fan 100 may include the impeller 10, the scroll casing 40 that houses the impeller 10, and a motor 50 that drives the impeller 10. A motor shaft 51 that serves as a rotation shaft of the motor 50 is inserted in the scroll casing 40 through a side surface of the scroll casing 40. The motor shaft 51 is connected to and fixed to the main plate 11 of the impeller 10. In the multi-blade fan 100, on a side of the main plate 11 on which the first blade portion 112*a* is formed, the motor 50 is provided and the motor shaft 51 is connected, and a side of the main plate 11 on which the second blade portion 112*b* is formed, the motor 50 is not provided and the motor shaft 51 is not connected. That is, the multi-blade fan 100 is configured such that the motor 50 is provided to face the first blade portion 112*a*. It will be described how the first blade portion 112*a* formed on the side at which the motor 50 is provided is different from the second blade portion 112*b* formed on the side at which the motor 50 is not provided.

The first blade portion 112*a* and the second blade portion 112*b* each have a blade inclined region 142 that is inclined such that in the direction from the main plate 11 toward the side plate 13, the distances between the leading edges 14A1 and the leading edges 14B1 and the rotation axis RS increase, and the blade inside diameters increase. In the case where the plurality of blades 12 are made up of first blades 12A only as illustrated in FIG. 8, the blade inclined region 142 is inclined such that the leading edges 14A1 extend away from the rotation axis RS such that that the blade inside diameter increases from the main plate 11 toward the side plate 13. As illustrated in FIG. 9, the plurality of blades 12 are inclined on the inner circumferential side because of provision of the blade inclined region 142. The blade inclined region 142 of the first blade portion 112*a* is provided to face the motor 50.

The blade inclined region 142 is formed at least in a region between the circle C1 drawn through portions of the inner circumferential ends 14A of the first blades 12A that are closer to the main plate 11 and the circle C7 drawn through portions of the inner circumferential ends 14A of the first blades 12A that are closer to the side plate 13. That is, the blade inclined region 142 is formed at least in a region between portions of the first blades 12A in the first section that have the inside diameter ID1 and are closer to the main plate 11 than the middle position MP and portions of the first blades 12A in the second section that have the inside diameter ID3 and are closer to the side plate 13 than the middle position MP. It should be noted that the blade inclined region 142 is a region in which the above inclined portions 141A and 141B are formed.

As illustrated in FIG. 10, in the first blade portion 112*a*, the inter-blade distance between any adjacent two of portions of blades 12 that are closer to the main plate 11 will be referred to as a first inter-blade distance a1. Also, as illustrated in FIG. 11, in the second blade portion 112*b*, the inter-blade distance between any adjacent two of portions of blades 12 that are closer to the main plate 11 will be referred to as a second inter-blade distance b1. The blade inclined region 142 has, on both plate sides of the main plate 11, portions of a plurality of blades 12 where the first inter-blade distance a1 and the second inter-blade distance b1 are set. The first inter-blade distance a1 is the inter-blade distance in the blade inclined region 142 of the first blade portion 112*a*, and the second inter-blade distance b1 is the inter-blade distance in the blade inclined region 142 of the second blade portion 112*b*.

More specifically, as illustrated in FIG. 10, in the blade inclined region 142 of the first blade portion 112*a*, the inter-blade distance between any adjacent two of first blades 12A arranged adjacent to each other in the circumferential direction CD will be referred to as a first inter-blade distance a1-1. Furthermore, between the first blades 12A arranged adjacent to each other in the circumferential direction CD, the inter-blade distance between any adjacent two of first and second blades 12A and 12B arranged adjacent to each other in the circumferential direction CD will be referred to as a first inter-blade distance a1-2. That is, within the first inter-blade distance a1-1, the inter-blade distance between any adjacent two of first and second blades 12A and 12B arranged adjacent to each other in the circumferential direction CD will be defined as the first inter-blade distance a1-2. Furthermore, the inter-blade distance between second blades 12B arranged adjacent to each other in the circumferential direction CD between the first blades 12A arranged adjacent to each other in the circumferential direction CD is defined as a first inter-blade distance a1-3. That is, the inter-blade distance between second blades 12B arranged adjacent to each other in the circumferential direction CD within the first inter-blade distance a1-1 is defined as the first inter-blade distance a1-3. Furthermore, between the first blades 12A arranged adjacent to each other in the circumferential direction CD, the inter-blade distances between second and first blades 12B and 12A arranged adjacent to each other in the circumferential direction CD will each be referred to as a first inter-blade distance a1-4. That is, within the first inter-blade distance a1-1, the inter-blade distance between any adjacent two of second and first blades 12B and 12A arranged adjacent to each other in the circumferential direction CD will be referred to as the first inter-blade distance a1-4. The first inter-blade distance a1-1, the first inter-blade distance a1-2, the first inter-blade distance a1-3, and the first inter-blade distance a1-4 are inter-blade distances between blades 12 in the blade inclined region 142 of the first blade portion 112*a*.

As illustrated in FIG. 11, in the blade inclined region 142 of the second blade portion 112*b*, the inter-blade distance between any adjacent two of first blades 12A arranged adjacent to each other in the circumferential direction CD will be referred to as a second inter-blade distance b1-1. Furthermore, between the first blades 12A arranged adjacent to each other in the circumferential direction CD, the inter-blade distance between first and second blades 12A and 12B arranged adjacent to each other in the circumferential direction CD will be referred to as a second inter-blade distance b1-2. That is, within the second inter-blade distance b1-1, the inter-blade distance between any adjacent two of first and second blades 12A and 12B arranged adjacent to each other in the circumferential direction CD will be referred to as the second inter-blade distance b1-2. Furthermore, between the first blades 12A arranged adjacent to each other in the circumferential direction CD, the inter-blade distance between any adjacent two of second blades 12B arranged adjacent to each other in the circumferential direction CD will be referred to as a second inter-blade distance b1-3. That is, the inter-blade distance between second blades 12B arranged adjacent to each other in the circumferential direction CD within the second inter-blade distance b1-1 is defined as the second inter-blade distance b1-3. Furthermore, the inter-blade distance between second and first blades 12B and 12A arranged adjacent to each other in the circumferential direction CD between the first blades 12A arranged adjacent to each other in the circumferential direction CD is defined as a second inter-blade distance b1-4. That is, within the second inter-blade distance b1-1, the inter-blade distance between any adjacent two of second and first blades 12B and 12A arranged adjacent to each other in the circumferential direction CD will be referred to as the second inter-blade distance b1-4. The second inter-blade distance b1-1, the second inter-blade distance b1-2, the second inter-blade distance b1-3, and the second inter-blade distance b1-4 are inter-blade distances between blades 12 in the blade inclined region 142 of the second blade portion 112*b*.

The first inter-blade distance a1 and the second inter-blade distance b1 are distances measured at points that are separated by the same distance from the rotation axis RS in the radial direction of the impeller 10 from the rotation axis RS. Similarly, the first inter-blade distance a1-1 and the second inter-blade distance b1-1 are distances measured at points that are separated by the same distance from the rotation axis RS in the radial direction of the impeller 10 from the rotation axis RS. Similarly, the first inter-blade distance a1-2 and the second inter-blade distance b1-2 are distances measured at points that are separated by the same distance from the rotation axis RS in the radial direction of the impeller 10 from the rotation axis RS. Similarly, the first inter-blade distance a1-3 and the second inter-blade distance b1-3 are distances measured at points that are separated by the same distance from the rotation axis RS in the radial direction of the impeller 10 from the rotation axis RS. Similarly, the first inter-blade distance a1-4 and the second inter-blade distance b1-4 are distances measured at points that are separated by the same distance from the rotation axis RS in the radial direction of the impeller 10 from the rotation axis RS.

The impeller 10 of the multi-blade fan 100 is formed such that the first inter-blade distance a1-1 in the first blade portion 112*a*, which the motor 50 is provided to face, is greater than the second inter-blade distance b1-1 in the second blade portion 112*b*, which the motor 50 is not provided to face (first inter-blade distance a1-1>second inter-blade distance b1-1). Similarly, the impeller 10 is formed such that the first inter-blade distance a1-2 in the first blade portion 112*a*, which the motor 50 is provided to face, is greater than the second inter-blade distance b1-2 in the second blade portion 112*b*, which the motor 50 is not provided to face (first inter-blade distance a1-2>second inter-blade distance b1-2). Similarly, the impeller 10 is formed such that the first inter-blade distance a1-3 in the first blade portion 112*a*, which the motor 50 is provided to face, is greater than the second inter-blade distance b1-3 in the second blade portion 112*b*, which the motor 50 is not provided to face (first inter-blade distance a1-3>second inter-blade distance b1-3). Similarly, the impeller 10 is formed such that the first inter-blade distance a1-4 in the first blade portion 112*a*, which the motor 50 is provided to face, is greater than the second inter-blade distance b1-4 in the second blade portion 112*b*, which the motor 50 is not provided to face (first inter-blade distance a1-4>second inter-blade distance b1-4).

The impeller 10 is formed such that the first inter-blade distance a1 between any adjacent two of blades 12 included in the first blade portion 112*a*, which the motor 50 is provided to face, is greater than the second inter-blade distance b1 between any adjacent two of blades 12 included in the second blade portion 112*b*, which the motor 50 is not provided to face (first inter-blade distance a1>second inter-blade distance b1). Moreover, the multi-blade fan 100 includes a region in which the first inter-blade distance a1 between any adjacent two of a plurality of blades 12 included in the first blade portion 112*a*, which the motor 50 is provided to face, is greater than the second inter-blade distance b1 between any adjacent two of a plurality of blades 12 included in the second blade portion 112*b*, which the motor 50 is not provided to face. In the case where the multi-blade fan 100 includes the impeller 10A as illustrated in FIG. 8, the first inter-blade distance a1 between any adjacent two of a plurality of first blades 12A included in the first blade portion 112*a* is greater than the second inter-blade distance b1 between any adjacent two of a plurality of first blades 12A included in the second blade portion 112*b*.

FIG. 12 illustrates a section of part of the impeller 10 that is closer to the side plate 13 in the first blade portion 112*a*. As illustrated in FIG. 12, in the first blade portion 112*a*, the inter-blade distance between any adjacent two of portions of blades 12 that are closer to the side plate 13 will be referred to as a first inter-blade distance a2. On the other hand, FIG. 10 illustrates a section of part of the impeller 10 that is closer to the main plate 11 in the first blade portion 112*a*. The impeller 10 is formed such that the first inter-blade distance a2 in part of the first blade portion 112*a* that is closer to the side plate 13 is greater than the first inter-blade distance a1 in part of the first blade portion 112*a* that is closer to the main plate 11 (first inter-blade distance a1<first inter-blade distance a2). Although FIGS. 10 and 12 illustrate a comparison between sections of the impeller 10, this configuration is applied to the entire impeller 10. That is, the impeller 10 is formed such that in the entire main-plate-side blade region 122*a* and the entire side-plate-side blade region 122*b* also, the first inter-blade distance a2 in the part of the first blade portion 112*a* that is closer to the side plate 13 is greater than the first inter-blade distance a1 in the part of the first blade portion 112*a* that is closer to the main plate 11 (first inter-blade distance a1<first inter-blade distance a2). Moreover, in one set of blades 12 having a main-plate-side blade region 122*a* and a side-plate-side blade region 122*b*, a maximum inter-blade distance (a2max) in the side-plate-side blade region 122*b* is greater than a maximum inter-blade distance (a1max) in the main-plate-side blade region 122*a* (maximum inter-blade distance (a1max)<maximum inter-blade distance (a2max)).

FIG. 13 illustrates a section of the impeller 10 beside the side plate 13 in the second blade portion 112*b*. As illustrated in FIG. 13, in the second blade portion 112*b*, the inter-blade distance between blades 12 beside the side plate 13 is defined as a second inter-blade distance b2. On the other hand, FIG. 11 illustrates a section of the impeller 10 beside the main plate 11 in the second blade portion 112*b*. The impeller 10 is formed such that the second inter-blade distance b2 of the second blade portion 112*b* beside the side plate 13 is greater than the second inter-blade distance b1 of the second blade portion 112*b* beside the main plate 11 (second inter-blade distance b1<second inter-blade distance b2). Although FIGS. 11 and 13 illustrate a comparison between one cross-section of the impeller 10 and another, this configuration is applied to the whole of the impeller 10. That is, the impeller 10 is formed such that in the whole main-plate-side blade region 122*a* and the whole side-plate-side blade region 122*b*, too, the second inter-blade distance b2 of the second blade portion 112*b* beside the side plate 13 is greater than the second inter-blade distance b1 of the second blade portion 112*b* beside the main plate 11 (second inter-blade distance b1<second inter-blade distance b2). Moreover, in a view of one set of blades 12 having a main-plate-side blade region 122*a* and a side-plate-side blade region 122*b*, a maximum inter-blade distance (b2max) in the side-plate-side blade region 122*b* is greater than a maximum inter-blade distance (b1max) in the main-plate-side blade region 122*a* (maximum inter-blade distance (b1max)<maximum inter-blade distance (b2max)).

The impeller 10 of the multi-blade fan 100 is formed such that the first inter-blade distance a1 of the first blade portion 112*a* beside the main plate 11 as illustrated in FIG. 10 is greater than the second inter-blade distance b1 of the second blade portion 112*b* beside the main plate 11 as illustrated in FIG. 11 (first inter-blade distance a1>second inter-blade distance b1). Although FIGS. 10 and 11 illustrate a comparison between one cross-section of the impeller 10 and another, this configuration is applied to the whole of the impeller 10. That is, the impeller 10 is formed such that in the whole main-plate-side blade region 122*a* of the first blade portion 112*a* and the whole main-plate-side blade region 122*a* of the second blade portion 112*b*, too, the first inter-blade distance a1 of the first blade portion 112*a* beside the main plate 11 is greater than the second inter-blade distance b1 of the second blade portion 112*b* beside the main plate 11 (first inter-blade distance a1>second inter-blade distance b1). Moreover, in the impeller 10, a maximum inter-blade distance (a1max) of the first blade portion 112*a* in the main-plate-side blade region 122*a* is greater than a maximum inter-blade distance (b1max) of the second blade portion 112*b* in the main-plate-side blade region 122*a* (maximum inter-blade distance (b1max)<maximum inter-blade distance (a1max)).

The impeller 10 of the multi-blade fan 100 is formed such that the first inter-blade distance a2 of the first blade portion 112*a* beside the side plate 13 as illustrated in FIG. 12 is greater than or equal to the second inter-blade distance b2 of the second blade portion 112*b* beside the side plate 13 as illustrated in FIG. 13 (first inter-blade distance a2≥second inter-blade distance b2). Although FIGS. 12 and 13 illustrate a comparison between one cross-section of the impeller 10 and another, this configuration is applied to the whole of the impeller 10. That is, the impeller 10 is formed such that in the whole side-plate-side blade region 122*b* of the first blade portion 112*a* and the whole side-plate-side blade region 122*b* of the second blade portion 112*b*, too, the first inter-blade distance a2 of the first blade portion 112*a* beside the side plate 13 is greater than or equal to the second inter-blade distance b2 of the second blade portion 112*b* beside the side plate 13 (first inter-blade distance a2 second inter-blade distance b2). That is, the impeller 10 is formed such that a maximum inter-blade distance (a2max) of the first blade portion 112*a* in the side-plate-side blade region 122*b* is greater than or equal to a maximum inter-blade distance (b2max) of the second blade portion 112*b* in the side-plate-side blade region 122*b*. It should be noted that the first inter-blade distance a2 and the second inter-blade distance b2 are distances measured at points the same distance from the rotation axis RS in the radial direction of the impeller 10 from the rotation axis RS.

The impeller 10 of the multi-blade fan 100 is formed such that the first inter-blade distance a2 of the first blade portion 112*a* beside the side plate 13 as illustrated in FIG. 12 is greater than the second inter-blade distance b1 of the second blade portion 112*b* beside the main plate as illustrated in FIG. 11 (first inter-blade distance a2>second inter-blade distance b1). Although FIGS. 12 and 11 illustrate a comparison between one cross-section of the impeller 10 and another, this configuration is applied to the whole of the impeller 10. That is, the impeller 10 is formed such that in the whole side-plate-side blade region 122*b* of the first blade portion 112*a* and the whole main-plate-side blade region 122*a* of the second blade portion 112*b*, too, the first inter-blade distance a2 of the first blade portion 112*a* beside the side plate 13 is greater than the second inter-blade distance b1 of the second blade portion 112*b* beside the main plate 11 (first inter-blade distance a2>second inter-blade distance b1). Moreover, in the impeller 10, a maximum inter-blade distance (a2max) of the first blade portion 112*a* in the side-plate-side blade region 122*b* is greater than a maximum inter-blade distance (b1max) of the second blade portion 112*b* in the main-plate-side blade region 122*a* (maximum inter-blade distance (b1max)<maximum inter-blade distance (a2max)). It should be noted that the first inter-blade distance a2 and the second inter-blade distance b1 are distances measured at points the same distance from the rotation axis RS in the radial direction of the impeller 10 from the rotation axis RS.

As described above, the main-plate-side blade region 122*a* of the impeller 10 that is closer to the main plate 11 is a first region, and the side-plate-side blade region 122*b* of the impeller 10 that is closer to the side plate 13 is a second region. Therefore, the impeller 10 and the multi-blade fan 100 are formed such that the first inter-blade distance a1 in the first region is greater than the second inter-blade distance b1 in the first region (first inter-blade distance a1>second inter-blade distance b1) and the first inter-blade distance a2 in the second region is greater than or equal to the second inter-blade distance b2 in the second region (first inter-blade distance a2≥second inter-blade distance b2). Furthermore, the impeller 10 and the multi-blade fan 100 may be further formed such that the first inter-blade distance a2 in the second region is greater than the first inter-blade distance a1 in the first region (first inter-blade distance a1<first inter-blade distance a2) and the second inter-blade distance b2 in the second region is greater than the second inter-blade distance b1 in the first region (second inter-blade distance b1<second inter-blade distance b2). That is, the impeller 10 and the multi-blade fan 100 may be formed such that the inter-blade distance in a region closer to the side plate 13 is greater than the inter-blade distance in a region closer to the main plate 11. Furthermore, the impeller 10 and the multi-blade fan 100 may be formed such that the first inter-blade distance a2 in the second region is greater than the second inter-blade distance b1 in the first region (first inter-blade distance a2>second inter-blade distance b1). Therefore, the impeller 10 of the multi-blade fan 100 is formed such that the inter-blade distance between any adjacent ones of the blades 12 included in the first blade portion 112*a*, which the motor 50 is provided to face, is greater than or equal to the inter-blade distance between the blades 12 included in the second blade portion 112*b*, which the motor 50 is not provided to face. In addition, the impeller 10 of the multi-blade fan 100 is formed such that the inter-blade distance between any adjacent ones of the blades 12 included in the region closer to the side plate 13 is greater than the inter-blade distance between any adjacent ones of the blades 12 included in the region closer to the main plate 11.

[Relationship Between Impeller 10 and Scroll Casing 40]

Figure 14:
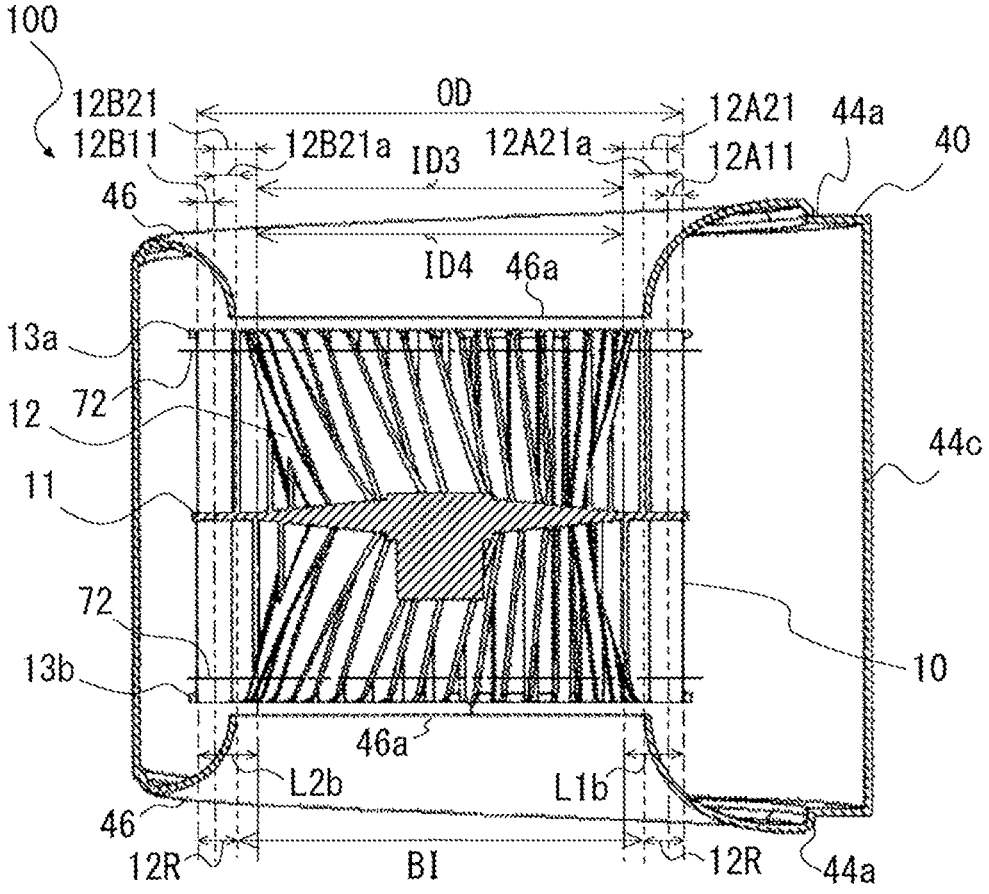
FIG. 14 is a schematic view illustrating a relationship between the impeller and the bellmouths in a section of the multi-blade fan that is taken along line A-A in FIG. 2.
Figure 15:
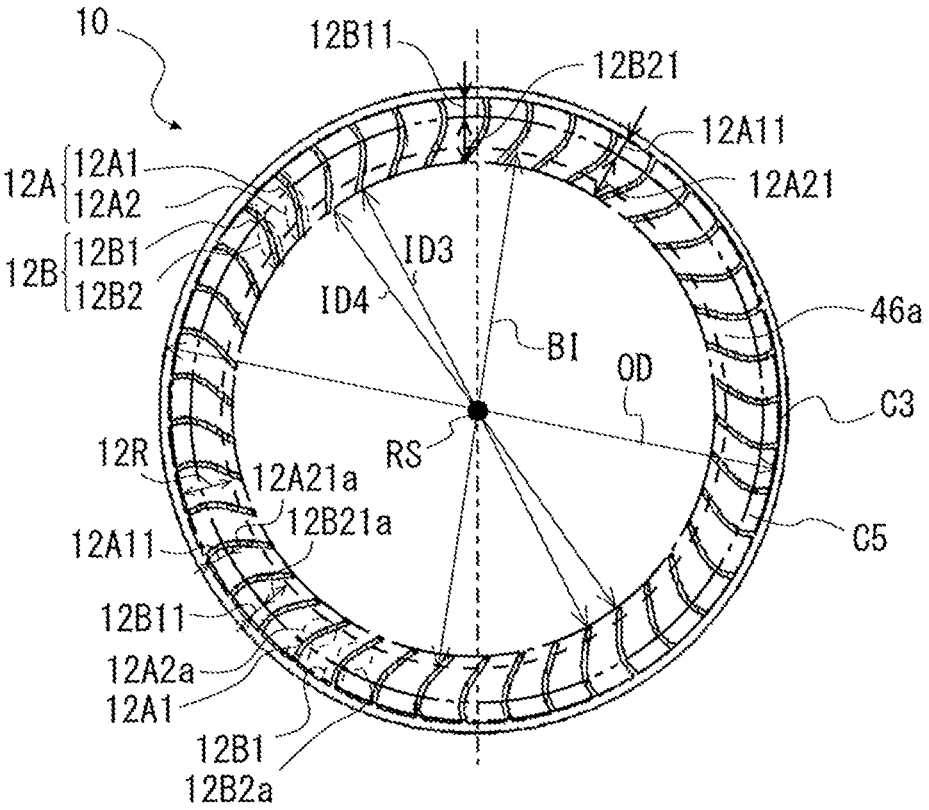
FIG. 15 is a schematic view illustrating a relationship between the blades and a bellmouth in a second section of the impeller as viewed in the direction parallel to the rotation axis in FIG. 14.

FIG. 14 is a schematic view illustrating a relationship between the impeller 10 and a bellmouth 46 in a section of the multi-blade fan 100 that is taken along line A-A in FIG. 2. FIG. 15 is a schematic view illustrating a relationship between blades 12 and a bellmouth 46 as viewed in the direction parallel to the rotation axis RS in a second section of the impeller 10 as illustrated in FIG. 14. As illustrated in FIGS. 14 and 15, a blade outside diameter OD of a circle drawn through the outer circumferential ends of the blades 12 is larger than the inside diameter BI of the bellmouth 46 included in the scroll casing 40. It should be noted that the blade outside diameter OD of the blades 12 is equal to the outside diameters OD1 and OD2 of the first blades 12A and the outside diameter OD3 and OD4 of the second blades 12B (blade outside diameter OD=outside diameter OD1=outside diameter OD2=outside diameter OD3=outside diameter OD4).

The impeller 10 is configured such that the first turbo region 12A21 is larger than the first sirocco region 12A11 in the radial direction with respect to the rotation axis RS. That is, the impeller 10 and each of the first blades 12A are configured such that in the radial direction with respect to the rotation axis RS, the ratio of the first turbo blade portion 12A2 to the first sirocco blade portion 12A1 is higher than the ratio of the first sirocco blade portion 12A1 to the first turbo blade portion 12A2, and the relationship "first sirocco blade portion 12A1<first turbo blade portion 12A2" is satisfied. The relationship regarding the ratio between the first sirocco blade portion 12A1 and the ratio of the first turbo blade portion 12A2 in the radial direction of the rotation axis RS is established in both the main-plate-side blade region 122*a* corresponding to the first region and the side-plate-side blade region 122*b* corresponding to the second region. It should be noted that the configuration of the impeller 10 and each of the first blades 12A is not limited to a configuration in which in the radial direction with respect to the rotation axis RS, the ratio of the first turbo blade portion 12A2 to the first sirocco blade portion 12A1 is higher than the ratio of the first sirocco blade portion 12A1 to the first turbo blade portion 12A2, and the relationship "first sirocco blade portion 12A1<first turbo blade portion 12A2" is satisfied. The impeller 10 and each of the first blades 12A may be configured such that in the radial direction with respect to the rotation axis RS, the ratio of the first turbo blade portion 12A2 to the first sirocco blade portion 12A1 is lower than or equal to the ratio of the first sirocco blade portion 12A1 to the first turbo blade portion 12A2.

Furthermore, as viewed in the direction parallel to the rotation axis RS, a region including portions of the blades 12 that are closer to the outer circumferential side than the inner circumferential side of the bellmouth 46 that has inside diameter BI in the radial direction with respect to the rotation axis RS will be referred to as an outer circumferential region 12R. It is preferable that the impeller 10 be configured such that in the outer circumferential region 12R also, the ratio of the first turbo blade portion 12A2 to the first sirocco blade portion 12A1 is higher than the ratio of the first sirocco blade portion 12A1 to the first turbo blade portion 12A2. That is, as viewed in the direction parallel to the rotation axis RS, in the outer circumferential region 12R of the impeller 10 that is closer to the outer circumferential side than the inner circumferential side of the bellmouth 46 that has the inside diameter BI, a first turbo region 12A21*a* is larger than the first sirocco region 12A11 in the radial direction with respect to the rotation axis RS. The first turbo region 12A21*a* is a region of the first turbo region 12A21 that is closer to the outer circumferential side than the inner circumferential side of the bellmouth that has the inside diameter BI, as viewed in the direction parallel to the rotation axis RS. Moreover, where a first turbo blade portion 12A2*a* is a first turbo blade portion 12A2 that forms the first turbo region 12A21*a*, it is preferable that the outer circumferential region 12R of the impeller 10 be configured such that the ratio of the first turbo blade portion 12A2*a* to the first sirocco blade portion 12A1 is higher than the ratio of the first sirocco blade portion 12A1 to the first turbo portion 12A2*a*. The relationship regarding the ratio between the first sirocco blade portion 12A1 and the ratio of the first turbo blade portion 12A2*a* in the outer circumferential region 12R is established in both the main-plate-side blade region 122*a* corresponding to the first region and the side-plate-side blade region 122*b* corresponding to the second region.

Similarly, the impeller 10 is configured such that the second turbo region 12B21 is larger than the second sirocco region 12B11 in the radial direction with respect to the rotation axis RS. That is, the impeller 10 and each of the second blades 12B are configured such that the ratio of the second turbo blade portion 12B2 to the second sirocco blade portion 12B1 is higher than the ratio of the second sirocco blade portion 12B1 to the second turbo blade portion 12B2 in the radial direction with respect to the rotation axis RS, and the relationship "second sirocco blade portion 12B1<second turbo blade portion 12B2" is satisfied. The relationship regarding the ratio between the second sirocco blade portion 12B1 and the second turbo blade portion 12B2 in the radial direction of the rotation axis RS is also satisfied in both the main-plate-side blade region 122*a* corresponding to the first region and the side-plate-side blade region 122*b* corresponding to the second region. It should be noted that the configuration of the impeller 10 and each of the second blades 12B is not limited to a configuration in which the ratio of the second turbo blade portion 12B2 to the second sirocco blade portion 12B1 is higher than the ratio of the second sirocco blade portion 12B1 to the second turbo blade portion 12B2 in the radial direction with respect to the rotation axis RS, and the relationship "second sirocco blade portion 12B1<second turbo blade portion 12B2" is satisfied. The impeller 10 and each of the second blades 12B may be configured such that the ratio of the second turbo blade portion 12B2 to the second sirocco blade portion 12B1 is lower than or equal to the ratio of the second sirocco blade portion 12B1 to the second sirocco blade portion 12B1 in the radial direction with respect to the rotation axis RS.

Furthermore, it is preferable for the impeller 10 that in the outer circumferential region 12R also, the ratio of the second turbo blade portion 12B2 to the second sirocco blade portion 12B1 is higher than the ratio of the second sirocco blade portion 12B1 to the second turbo blade portion 12B2. That is, as viewed in the direction parallel to the rotation axis RS, in the outer circumferential region 12R of the impeller 10 that is closer to the outer circumferential side than the inner circumferential side of the bellmouth 46 that has the inside diameter B, a second turbo region 12B21*a* is larger than the second sirocco region 12B11 in the radial direction with respect to the rotation axis RS. The second turbo region 12B21*a* is a region included in the second turbo region 12B21 that is closer to the outer circumferential side than the inner circumferential side of the bellmouth 46 that has inside diameter BI, as viewed in the direction parallel to the rotation axis RS. Moreover, in the case where a second turbo blade portion 12B2 that forms the second turbo region 12B21*a* is a second turbo blade portion 12B2*a*, it is desirable that the outer circumferential region 12R of the impeller 10 be configured such that the ratio of the second turbo blade portion 12B2*a* to the second sirocco blade portion 12B1 is higher than the ratio of the second sirocco blade portion 12B1 to the second turbo blade portion 12B2*a*. The relationship regarding the ratio between the second sirocco blade portion 12B1 and the second turbo blade portion 12B2*a* in the outer circumferential region 12R is established in both the main-plate-side blade region 122*a* corresponding to the first region and the side-plate-side blade region 122*b* corresponding to the second region.

Figure 16:
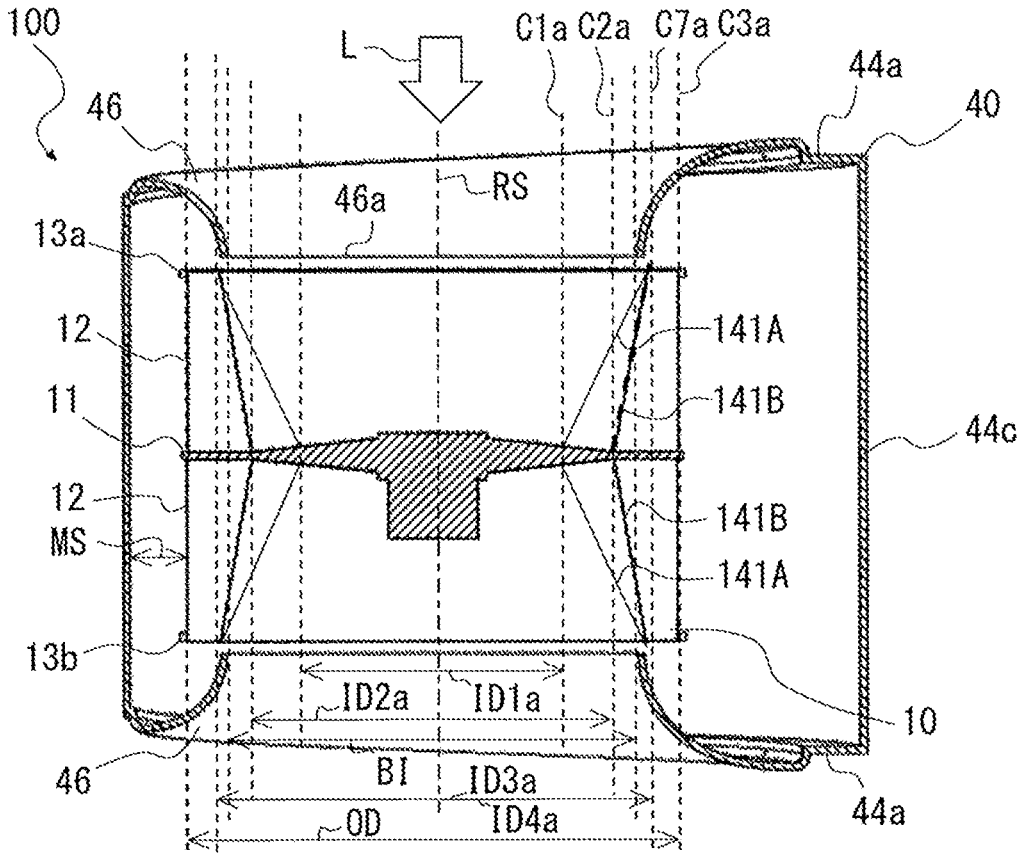
FIG. 16 is a schematic view illustrating a relationship between the impeller and the bellmouths in the section of the multi-blade fan that is taken along line A-A in FIG. 2.
Figure 17:
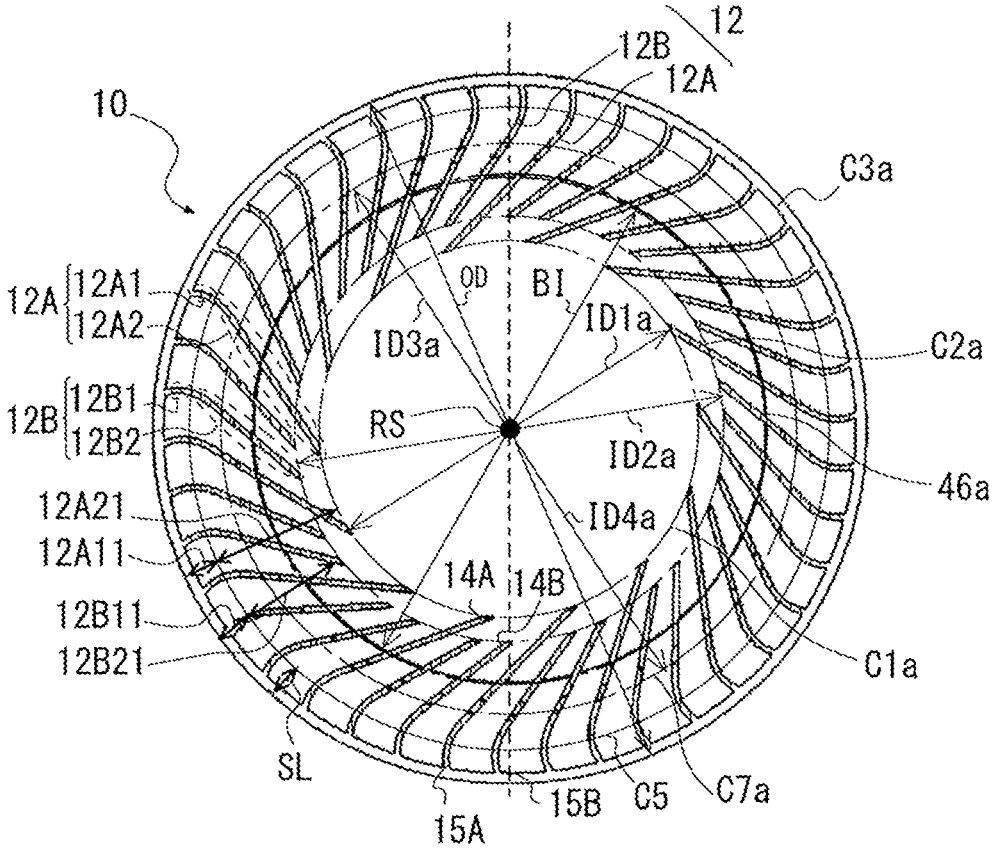
FIG. 17 is a schematic view illustrating a relationship between the blades and a bellmouth as viewed in the direction parallel to the rotation axis in the impeller in FIG. 16.

FIG. 16 is a schematic view illustrating a relationship between the impeller 10 and the bellmouth 46 in the section of the multi-blade fan 100 that is taken along line A-A in FIG. 2. FIG. 17 is a schematic view illustrating a relationship between the blades 12 and the bellmouth 46 as viewed in the direction parallel to the rotation axis RS in the impeller 10 as illustrated in FIG. 16. In FIG. 16, an outlined arrow L indicates a direction in which the impeller 10 is viewed and which is parallel to the rotation axis RS. As illustrated in FIGS. 16 and 17, a circle drawn through the inner circumferential ends 14A of the first blades 12A around the rotation axis RS at connecting locations between the first blades 12A and the main plate 11 as viewed in the direction parallel to the rotation axis RS will be referred to as a circle C1*a*. Moreover, the diameter of the circle C1*a*, that is, the inside diameter of the first blades 12A at the connecting locations between the first blades 12A and the main plate 11, is an inside diameter ID1*a*. Furthermore, a circle drawn through the inner circumferential ends 14B of the second blades 12B around the rotation axis RS at connecting locations between the second blades 12B and the main plate 11 as viewed in the direction parallel to the rotation axis RS will be referred to as a circle C2*a*. Also, the diameter of the circle C2*a*, that is, the inside diameter of the second blades 12B at the connecting locations between the second blades 12B and the main plate 11, is an inside diameter ID2*a*. The inside diameter ID2*a* is larger than the inside diameter ID1*a* (inside diameter ID2*a*>inside diameter ID1*a*). Also, the diameter of a circle C3*a* drawn through the outer circumferential ends 15A of the first blades 12A and the outer circumferential ends 15B of the plurality of second blades 12B around the rotation axis RS as viewed in the direction parallel to the rotation axis RS, that is, the outside diameter of the blades 12, will be referred to as a blade outside diameter OD. Furthermore, a circle drawn through the inner circumferential ends 14A of the first blades 12A around the rotation axis RS at connecting locations between the first blades 12A and the side plate 13 as viewed in the direction parallel to the rotation axis RS will be referred to as a circle C7*a*. Moreover, the diameter of the circle C7*a*, that is, the inside diameter of the first blades 12A at the connecting locations between the first blades 12A and the side plate 13, will be referred to as an inside diameter ID3*a*. Furthermore, a circle drawn through the inner circumferential ends 14B of the second blades 12B around the rotation axis RS at connecting locations between the second blades 12B and the side plate 13 as viewed in the direction parallel to the rotation axis RS will be referred to as the circle C7*a*. In addition, the diameter of the circle C7*a*, that is, the inside diameter of the second blades 12B at the connecting locations between the second blades 12B and the side plate 13, will be referred to as an inside diameter ID4*a*.

As illustrated in FIGS. 16 and 17, as viewed in the direction parallel to the rotation axis RS, the inner circumferential side of the bellmouth 46 that has the inside diameter BI is located between portions of the first turbo blade portions 12A2 and the second turbo blade portions 12B2 that are located between portions of the first blades 12A that are closer to the main plate 11 and correspond to the inside diameter ID1*a* and portions of the first blades 12A that are closer to the side plate 13 and correspond to the inside diameter ID3*a*. More specifically, the inside diameter BI of the bellmouth 46 is larger than the inside diameter ID1*a* of portions of the first blades 12A that are closer to the main plate 11, and is smaller than the inside diameter ID3*a* of portions of the first blades 12A that are closer to the side plate 13. That is, the inside diameter BI of the bellmouth 46 is larger than the blade inside diameter of the portions of the blades 12 that are closer to the main plate 11 and smaller than the blade inside diameter of the portions of the blades 12 that are closer to the side plate 13. In other words, the bellmouth 46 has an opening 46*a* that has the inside diameter BI and is located between portions of the first turbo blade portions 12A2 and second turbo blade portions 12B2 that are located between the circle C1*a* and the circle C7*a*, as viewed in the direction parallel to the rotation axis RS.

Furthermore, as illustrated in FIGS. 16 and 17, the inner circumferential side of the bellmouth 46 that has the inside diameter BI is located between portions of the first turbo blade portions 12A2 and the second turbo blade portions 12B2 that are located between portions of the second blades 12B that are closer to the main plate 11 and correspond to the inside diameter ID2*a* and portions of the second blades 12B that are closer to the side plate 13 and correspond to the inside diameter ID4*a*. More specifically, the inside diameter BI of the bellmouth 46 is larger than the inside diameter ID2*a* of the portions of the second blades 12B that are closer to the main plate 11 and smaller than the inside diameter ID4*a* of the portions of the second blades 12B that are closer to the side plate 13. That is, the inside diameter BI of the bellmouth 46 is larger than the blade inside diameter of the portions of the blades 12 that are closer to the main plate 11, and is smaller than the blade inside diameter of the portions of the blades 12 that are closer to the side plate 13. More specifically, the inside diameter BI of the bellmouth 46 is larger than the blade inside diameter of the blades 12 in the first region, which is the diameter of a circle drawn through the inner circumferential ends of the blades 12 in the first region, and is smaller than the blade inside diameter of the blades 12 in the second region, which is the diameter of a circle drawn through the inner circumferential ends of the of blades 12 in the second region. In other words, the opening 46*a* that is defined by the inner circumferential side of the bellmouth 46 that has the inside diameter BI is located in a region of the first turbo blade portions 12A2 and the second turbo blade portions 12B2 between the circle C2*a* and the circle C7*a* as viewed in the direction parallel to the rotation axis RS.

As illustrated in FIGS. 16 and 17, in the radial direction of the impeller 10, the length of each of the first and second sirocco blade portions 12A1 and 12B1 is a length SL. Furthermore, in the multi-blade fan 100, the shortest distance between the blades 12 of the impeller 10 and the peripheral wall 44*c* of the scroll casing 40 is a distance MS. In this case, the multi-blade fan 100 is configured such that the distance MS is greater than twice the length SL (distance MS>length SL×2). Although the distance MS is indicated in the A-A section of the multi-blade fan 100 in FIG. 16, the distance MS is the shortest distance between the peripheral wall 44*c* of the scroll casing 40 and the blades 12 and is not necessarily indicated in the A-A section.

Figure 18:
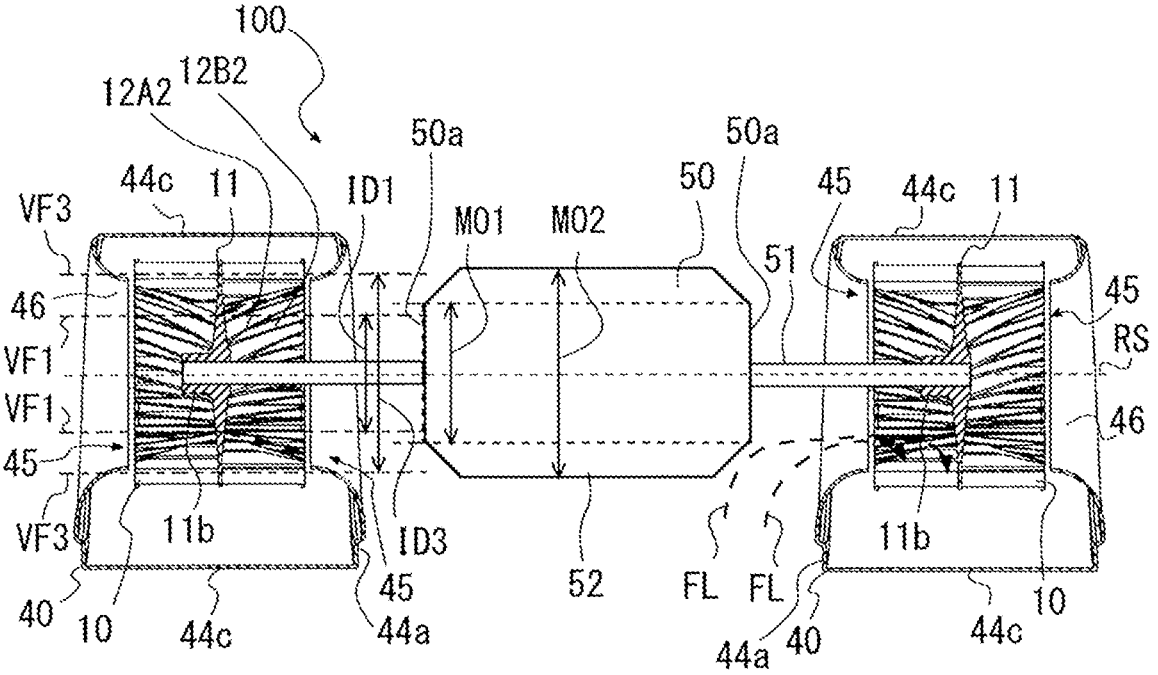
FIG. 18 is a conceptual diagram for explanation of a relationship between the impeller and a motor in the multi-blade fan according to Embodiment 1.

FIG. 18 is a conceptual diagram for explanation of a relationship between the impeller 10 and a motor 50 in the multi-blade fan 100 according to Embodiment 1. In FIG. 18, dotted lines FL indicate an example of the flow of air that flows from the outside of the scroll casing 40 thereinto. As illustrated in FIG. 18, the multi-blade fan 100 may include, in addition to the impeller 10 and the scroll casing 40, a motor 50 configured to rotate the main plate 11 of the impeller 10. That is, the multi-blade fan 100 may have an impeller 10, a scroll casing 40 that houses the impeller 10, and a motor 50 configured to drive the impeller 10.

The motor 50 is provided adjacent to the side wall 44*a* of the scroll casing 40. The motor 50 includes a motor shaft 51 that extends along the rotation axis RS of the impeller 10 and is inserted in the scroll casing 40 through a side surface of the scroll casing 40.

The main plate 11 is provided perpendicular to the rotation axis RS along the side wall 44*a* of the scroll casing 40 that is closer to the motor 50. The main plate 11 has, at central part thereof, a shaft portion 11*b* to which the motor shaft 51 is connected, and the motor shaft 51 is fixed to the shaft portion 11*b* of the main plate 11 while being inserted in the scroll casing 40. The motor shaft 51 of the motor 50 is connected to and fixed to the main plate 11 of the impeller 10.

When the motor 50 is driven, the blades 12 is rotated around the rotation axis RS via the motor shaft 51 and the main plate 11. As a result, outside air is sucked into the impeller 10 through the suction port 45 and blown into the scroll casing 40 by a pressure-rising action of the impeller 10. The air blown into the scroll casing 40 is decelerated in an expanded air passage formed by the peripheral wall 44*c* of the scroll casing 40 to recover its static pressure, and is blown to the outside through the discharge port 42*a* illustrated in FIG. 1.

An outer peripheral wall 52 that forms an end portion 50*a* of the motor 50 that has the outside diameter MO1 is located between an imaginary extended surface VF1 that is formed by increasing the blade inside diameter of the portions of the blades 12 that are closer to the main plate 11, in the axial direction of the rotation axis RS, and an imaginary extended surface VF3 that is formed by increasing the blade inside diameter of the portions of the blades 12 that are closer to the side plate 13, in the axial direction of the rotation axis RS. Furthermore, the outer peripheral wall 52 that forms the end portion 50*a* of the motor 50 which has the outside diameter MO1 is provided in such a location as to face the first turbo blade portions 12A2 and the second turbo blade portions 12B2 in the axial direction of the rotation axis RS. More specifically, the outside diameter MO1 of the end portion 50*a* of the motor 50 is larger than the inside diameter ID1 of the portions of the first blades 12A that are closer to the main plate 11, and smaller than the inside diameter ID3 of the portions of the first blades 12A that are closer to the side plate 13. That is, the outside diameter MO1 of the end portion 50*a* of the motor 50 is larger than the blade inside diameter of the portions of the blades 12 that are closer to the main plate 11 and smaller than the blade inside diameter of the portions of the blades 12 that are closer to the side plate 13. Further, the outer peripheral wall 52 at the end portion

50*a* of the motor 50 is located between portions of the first turbo blade portions 12A2 and the second turbo blade portions 12B2 that are located between the above circles C1*a* and C7*a*, as viewed in the direction parallel to the rotation axis RS. It should be noted that regarding the multi-blade fan 100, the value of the outside diameter MO2 of part of the motor 50 that is other than the end portion 50*a* is not limited.

Figure 19:
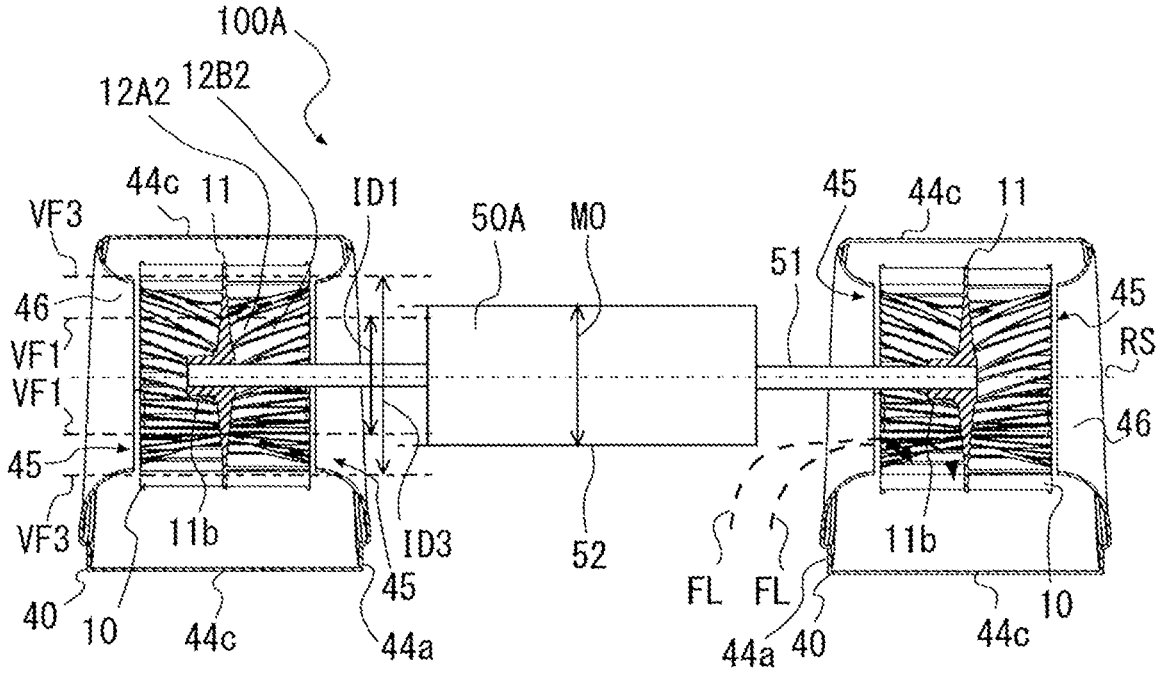
FIG. 19 is a conceptual diagram of a multi-blade fan according to a first modification of the multi-blade fan illustrated in FIG. 18.

FIG. 19 is a conceptual diagram of a multi-blade fan 100A according to a first modification of the multi-blade fan 100 as illustrated in FIG. 18. An outer peripheral wall 52 of a motor 50A, which has the outside diameter MO, is located between an imaginary extended surface VF1 that is formed by increasing the blade inside diameter of the portions of the blades 12 that are closer to the main plate 11 in the axial direction of the rotation axis RS and an imaginary extended surface VF3 that is formed by increasing the blade inside diameter of the portions of the blades 12 that are closer to the side plate 13 in the axial direction of the rotation axis RS. Furthermore, the outer peripheral wall 52 of the motor 50A that has the outside diameter MO is provided in such a location as to face the first turbo blade portions 12A2 and the second turbo blade portions 12B2 in the axial direction of the rotation axis RS. More specifically, the outside diameter MO of the motor 50A is larger than the inside diameter ID1 of the portions of the first blades 12A that are closer to the main plate 11 and smaller than the inside diameter ID3 of the first blades 12A beside the side plate 13. That is, the outside diameter MO of the motor 50A is larger than the blade inside diameter of the portions of the blades 12 that are closer to the main plate 11 and smaller than the blade inside diameter of the portions of the blades 12 that are closer to the side plate 13. Furthermore, the outer peripheral wall 52 of the motor 50A that has the outside diameter MO is located between the portions of the first turbo blade portions 12A2 and the second turbo blade portions 12B2 that are located between the above circles C1*a* and C7*a* as viewed in the direction parallel to the rotation axis RS.

Figure 20:
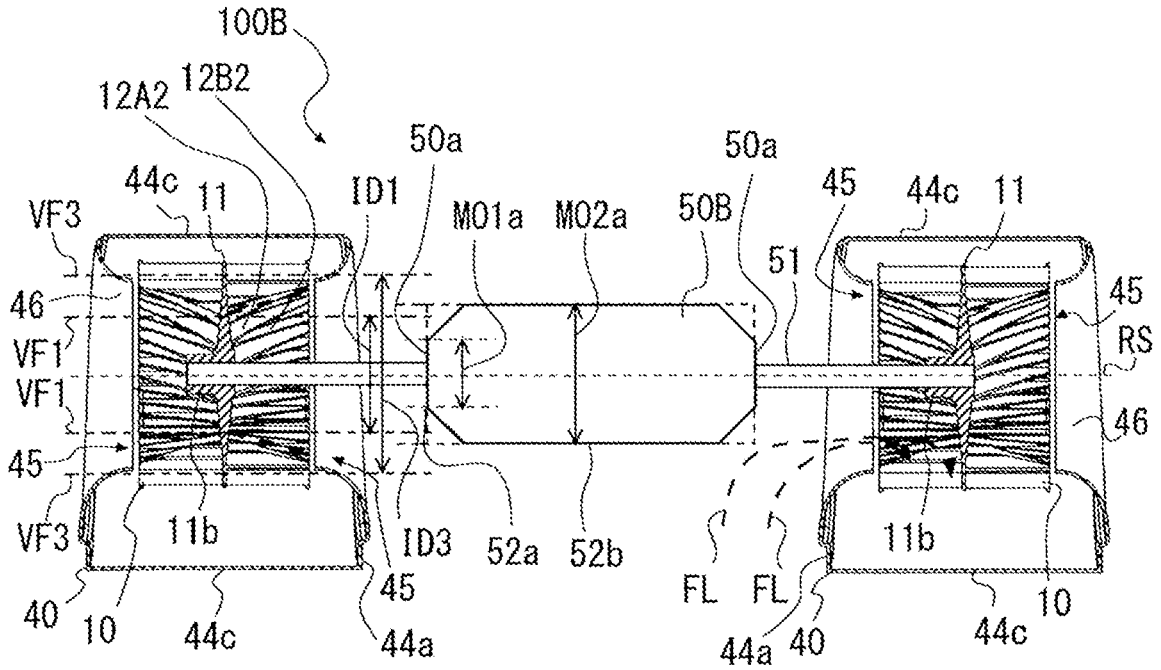
FIG. 20 is a conceptual diagram of a multi-blade fan according to a second modification of the multi-blade fan illustrated in FIG. 18.

FIG. 20 is a conceptual diagram of a multi-blade fan 100B according to a second modification of the multi-blade fan 100 as illustrated in FIG. 18. As illustrated in FIG. 20, an outer peripheral wall 52*a* of an end portion 50*a* of a motor 50B that has the outside diameter MO1*a* is located between the rotation axis RS and an imaginary extended surface VF1 that is formed by increasing the blade inside diameter of the portions of the blades 12 that are closer to the main plate 11 in the axial direction of the rotation axis RS. Furthermore, the outer peripheral wall 52*a* of the end portion 50*a* of the motor 50B that has the outside diameter MO1*a* is provided in such a location as to face the first turbo blade portions 12A2 and the second turbo blade portions 12B2 in the axial direction of the rotation axis RS. More specifically, the outside diameter MO1*a* of the end portion 50*a* of the motor 50B is smaller than the inside diameter ID1 of the portions of the first blades 12A that are closer to the main plate 11. That is, the outside diameter MO1*a* of the end portion 50*a* of the motor 50B is smaller than the blade inside diameter of the portions of the blades 12 that are closer to the main plate 11. In addition, the outer peripheral wall 52*a* at the end portion 50*a* of the motor 50B is located within the above circle C1*a* as viewed in the direction parallel to the rotation axis RS.

Furthermore, an outer peripheral wall 52*b* of the motor 50B that has the outermost diameter MO2*a* is located between the imaginary extended surface VF1 that is formed by increasing the blade inside diameter of the portions of the blades 12 that are closer to the main plate 11 in the axial direction of the rotation axis RS and an imaginary extended surface VF3 that is formed by increasing the blade inside diameter of the portions of the blades 12 that are closer to the side plate 13 in the axial direction of the rotation axis RS. Furthermore, the outer peripheral wall 52*b* of the motor 50B, which has the outermost diameter MO2*a*, is provided in such a location as to face the first turbo blade portions 12A2 and the second turbo blade portions 12B2 in the axial direction of the rotation axis RS. More specifically, the outermost diameter MO2*a* of the motor 50B is larger than the inside diameter ID1 of the portions of the first blades 12A that are closer to the main plate 11 and smaller than the inside diameter ID3 of the first blades 12A beside the side plate 13. That is, the outermost diameter MO2*a* of the motor 50B is larger than the blade inside diameter of the portions of the blades 12 that are closer to the main plate 11 and smaller than the blade inside diameter of the portions of the blades 12 that are closer to the side plate 13. Furthermore, the outer peripheral wall 52*b* of the motor 50B, which has the outermost diameter MO2*a*, is located in a region of the first turbo blade portions 12A2 and the second turbo blade portions 12B2 between the above circles C1*a* and C7*a* as viewed in the direction parallel to the rotation axis RS.

[Advantages of Impeller 10 and Multi-Blade Fan 100]

In the impeller 10 and the multi-blade fan 100, the blades 12 include a first blade portion 112*a* formed on one plate side of the main plate 11 and a second blade portion 112*b* formed on the other plate side of the main plate 11. Moreover, the impeller 10 and the multi-blade fan 100 include a region in which a first inter-blade distance of the first blade portion 112*a* is greater than a second inter-blade distance of the second blade portion 112*b*. Therefore, even if the area of suction of air in the impeller 10 is reduced because of provision of the motor 50, it is possible to reduce a loss of suction on a side of the impeller 10 where the motor 50 is provided, by providing the motor 50 on the side where the first blade portion 112*a*, whose inter-blade distance is great, is formed. That is, even in the case where the impeller 10 is of a double-suction type and the flow of sucked air varies between one suction side and the other suction side, depending on the type of usage, the environment of usage, or other conditions, by providing the first blade portion 112*a*, whose inter-blade distance is greater than that of the second blade portion 112*b*, on a side through which a smaller amount of sucked air flows, it is possible to increase the flow rate of air that is sucked on the side where the first blade portion 112*a* is located. As a result, the impeller 10 can reduce a loss of suction.

Furthermore, in the first and second regions of the impeller 10, the ratio of the turbo blade portion to the sirocco blade portion in the radial direction is higher than the ratio of the sirocco blade portion to the turbo blade portion in the radial direction. Since the impeller 10 is configured such that the ratio of the turbo blade portion to the sirocco blade portion is higher in any region between the main plate 11 and the side plate 13, sufficient pressure recovery can be achieved by the blades. Therefore, the impeller 10 can further improve pressure recovery than an impeller or a multi-blade fan that does not have the above configuration.

Furthermore, each of the blades 12 has a blade inclined region 142 that is inclined such that in the direction from the main plate 11 toward the side plate 13, the distances between the inner circumferential end 14A and the inner circumferential end 14B and the rotation axis RS increase. Moreover, the first inter-blade distance a1 is an inter-blade distance of the blade inclined region 142 of the first blade portion 112*a*, and the second inter-blade distance b1 is an inter-blade distance of the blade inclined region 142 of the second blade portion 112*b*. In the case where the motor 50 is provided, the blade inclined region 142 is located to face the first blade portion 112*a* in the axial direction of the rotation axis RS. Moreover, the impeller 10 and the multi-blade fan 100 include a region which the first inter-blade distance a1 of the first blade portion 112*a* is greater than the second inter-blade distance b1 of the second blade portion 112*b*. Therefore, even if the area of suction of air in the impeller 10 is reduced because of provision of the motor 50, it possible to reduce a loss of suction on a side of the impeller 10 where the motor 50 is provided, by providing the motor 50 on the side where the first blade portion 112*a*, whose inter-blade distance is great, is formed. That is, even in the case where the impeller 10 is of a double-suction type and the flow of sucked air varies between one suction side and the other suction side, depending on the type of usage, the environment of usage, or other conditions, by providing the first blade portion 112*a*, whose inter-blade distance is greater than that of the second blade portion 112*b*, on a side through which sucked air flows at a low rate, it is possible to increase the flow rate of air that is sucked on the side where the first blade portion 112*a* is located. As a result, the impeller 10 can reduce a loss of suction.

In the impeller 10 and the multi-blade fan 100, the first inter-blade distance of the first region is greater than the second inter-blade distance of the first region (first inter-blade distance a1>second inter-blade distance b1) and the first inter-blade distance of the second region is greater than or equal to the second inter-blade distance of the second region (first inter-blade distance a2≥second inter-blade distance b2). Therefore, even if the area of suction of air in the impeller 10 is reduced because of provision of the motor 50, it possible to reduce a loss of suction on a side of the impeller 10 where the motor 50 is provided, providing the motor 50 on the side on which the first blade portion 112*a*, whose inter-blade distance is great, is formed. Furthermore, since the impeller 10 is configured such that the ratio of the turbo blade portion is high in any region between the main plate 11 and the side plate 13, sufficient pressure recovery can be achieved by the blades. Therefore, the impeller 10 can further improve pressure recovery than an impeller or a multi-blade fan that does not include the configuration.

Furthermore, in the impeller 10 and the multi-blade fan 100, the first inter-blade distance of the second region is greater than the first inter-blade distance of the first region (first inter-blade distance a1<first inter-blade distance a2) and the second inter-blade distance of the second region is greater than the second inter-blade distance of the first region (second inter-blade distance b1<second inter-blade distance b2). That is, in the impeller 10 and the multi-blade fan 100, the inter-blade distance of the portions closer to the side plate 13 is greater than the inter-blade distance of the portions closer to the main plate 11. Therefore, the impeller 10 and the multi-blade fan 100 can further improve pressure recovery than an impeller or a multi-blade fan that does not include the configuration. As a result, the impeller 10 can improve the efficiency of the multi-blade fan 100. Furthermore, by virtue of the above configuration, the impeller 10 can reduce separation of air current at the leading edges of the portions closer to the side plate 13.

Furthermore, in the impeller 10 and the multi-blade fan 100, in the first and second regions of the impeller 10, the ratio of the turbo blade portion in the radial direction to the sirocco blade portion is higher than the ratio of the sirocco blade portion to the turbo blade portion in the radial direction. Since the impeller 10 and the multi-blade fan 100 are configured such that the ratio of the turbo blade portion is high in any region between the main plate 11 and the side plate 13, sufficient pressure recovery can be achieved by the blades 12. Therefore, the impeller 10 and the multi-blade fan 100 can further improve pressure recovery than an impeller or a multi-blade fan that does not include the a configuration. As a result, the impeller 10 can improve the efficiency of the multi-blade fan 100. Furthermore, by virtue of the above configuration, the impeller 10 can reduce I separation of an air current at the leading edges of the portions closer to the side plate 13.

Moreover, each of the blades 12 has a radial blade portion that connects the turbo blade portion and the sirocco blade portion and has a blade angle of 90 degrees. In the impeller 10, since the radial blade portion is provided between the turbo blade portion and the sirocco blade portion, the angle of a region between the sirocco blade portion and the turbo blade portion does not vary steeply. Therefore, the impeller 10 can reduce pressure fluctuations in the scroll casing 40, increase the fan efficiency of the multi-blade fan 100, and further reduce noise.

Furthermore, the blades 12 are configured such that at least one second blade 12B is provided between any adjacent two of the first blades 12A arranged in the circumferential direction. Also, in the impeller 10 and the multi-blade fan 100, in each of the second blades 12B, the ratio of the turbo blade portion is high in any region between the main plate 11 and the side plate 13, sufficient pressure recovery can be achieved by the second blades 12B. Therefore, the impeller 10 and the multi-blade fan 100 can further improve pressure recovery than an impeller or a multi-blade fan that does not include the configuration. As a result, the impeller 10 can improve the efficiency of the multi-blade fan 100. Furthermore, by virtue of the above configuration, the impeller 10 can reduce separation of an air current at the leading edge of the portions closer to the side plate 13.

Furthermore, the second blades 12B are formed such that the ratio of the inside diameter of the second blades 12B, which is the diameter of a circle drawn through the inner circumferential ends 14B of the second blades 12B, to the outside diameter of the second blades 12B, which is the diameter of a circle drawn through the outer circumferential ends 15B of the second blades 12B, is lower than or equal to 0.7. Also, in the impeller 10 and the multi-blade fan 100, since in each of the second blades 12B, the ratio of the turbo blade portion is high in any region between the main plate 11 and the side plate 13, sufficient pressure recovery can be achieved by the second blades 12B. Therefore, the impeller 10 and the multi-blade fan 100 can further improve pressure recovery than an impeller or a multi-blade fan that does not include the above configuration. As a result, the impeller 10 can improve the efficiency of the multi-blade fan 100. In addition, by virtue of the above configuration, the impeller 10 can reduce separation of an air current at the leading edges of the portions closer to the side plate 13.

Furthermore, the blades 12 are configured such that in part of the blades 12 that is located further outward than part of the bellmouth 46 that has the inside diameter BI, in the radial direction with respect to the rotation axis RS, the ratio of the turbo blade portion to the sirocco blade portion in the radial direction of the main plate 11 is higher than the ratio of the sirocco blade portion to the turbo blade portion in the radial direction of the main plate 11 throughout the blades 12. In the blades 12, the above configuration is provided in any region between the main plate 11 and the side plate 13. Accordingly, the blades 12 can increase the amount of air that is sucked at part of the blades 12 that is located inward of the part of the bellmouth 46 that has the inside diameter BI. Furthermore, by increasing the ratio of the turbo blade portion in the part of the blades 12 that is located further outward than the part of the bellmouth 46 that has inside diameter BI, the blades 12 can increase the volume of air that is drawn out from the impeller 10. In addition, by virtue of the above configuration, the blades 12 can increase the pressure recovery in the scroll casing 40 of the multi-blade fan 100 and improve the fan efficiency.

Furthermore, the inside diameter BI of the bellmouth 46 is larger than the blade inside diameter of the portions of the blades 12 that are closer to the main plate 11 and smaller than the blade inside diameter of the portions of the blades 12 that are closer to the side plate 13. Therefore, the multi-blade fan 100 can reduce interference between the flow of sucked air that flows into the scroll casing from the suction port 45 of the bellmouth 46 and the portions of the blades 12 that are closer to the side plate 13, and can further reduce noise.

Moreover, the inside diameter BI of the bellmouth 46 is larger than the blade inside diameter of the portions of the second blades 12B that are closer to the main plate 11 and smaller than the blade inside diameter of the portions of the second blades 12B that are closer to the side plate 13. Therefore, the multi-blade fan 100 can reduce interference between the flow of sucked gas that flows in the bellmouth 46 from the suction port 45 of the bellmouth 46 and the portions of the second blades 12B that are closer to the side plate 13, and can further reduce noise.

Furthermore, the distance MS, which is the shortest possible distance between the blades 12 and the peripheral wall 44*c*, is greater than twice the length of the sirocco blade portion in the radial direction. Therefore, the multi-blade fan 100 can achieve pressure recovery with the turbo blade portion, increase the distance between the scroll casing 40 and the impeller 10 in a region where the scroll casing 40 and the impeller 10 are closest to each other, and can therefore reduce noise.

Furthermore, the multi-blade fan 100 is formed such that the outside diameter MO1 of an end portion 50*a* of the motor 50 is larger than the blade inside diameter of the portions of the blades 12 that are closer to the main plate 11 and smaller than the blade inside diameter of the portions of the blades 12 that are closer to the side plate 13. By virtue of the above configuration, in the multi-blade fan 100, the flow direction of an air current from a region closer to the motor 50 is changed such that the air current flows in the axial direction of the rotation axis RS of the impeller 10 and the air smoothly flows into the scroll casing 40, whereby the volume of air that is drawn out from the impeller 10 can be increased. In addition, by virtue of the above configuration, the multi-blade fan 100 can increase the pressure recovery in the scroll casing 40 and improve the fan efficiency.

Furthermore, the multi-blade fan 100A is formed such that the outside diameter MO of the motor 50A is larger than the blade inside diameter of the portions of the blades 12 that are closer to the main plate 11 and smaller than the blade inside diameter of the portions of the blades 12 that are closer to the side plate 13. By virtue of the above configuration, the multi-blade fan 100A can change the flow direction of an air current from a region close to the motor 50A to the axial direction of the rotation axis RS of the impeller 10 to cause air to smoothly flow into the scroll casing 40, thereby increasing the volume of air that is drawn out from the impeller 10. In addition, by virtue of the above configuration, the multi-blade fan 100A can improve the pressure recovery in the scroll casing 40 and also improve the fan efficiency.

Furthermore, the multi-blade fan 100B is formed such that the outermost diameter MO2*a* of the motor 50B is larger than the blade inside diameter of the portions of the blades 12 that are closer to the main plate 11 and smaller than the blade inside diameter of the portions of the blades 12 that are closer to the side plate 13. In addition, the multi-blade fan 100B is formed such that the outside diameter MO1*a* of an end portion 50*a* of the motor 50B is smaller than the blade inside diameter of the portions of the blades 12 that are closer to the main plate 11. By virtue of the above configuration, the multi-blade fan 100B can better cause air to be smoothly flow into the scroll casing 40 and increase the volume of air that is emitted from the impeller 10 than the multi-blade fan 100A or other devices. Furthermore, by virtue of the above configuration, the multi-blade fan 100B can further improve the pressure recovery in the scroll casing 40 and also improve fan efficiency, as compared with the multi-blade fan 100A or other devices.

Embodiment 2

[Multi-Blade Fan 100C]

Figure 21:
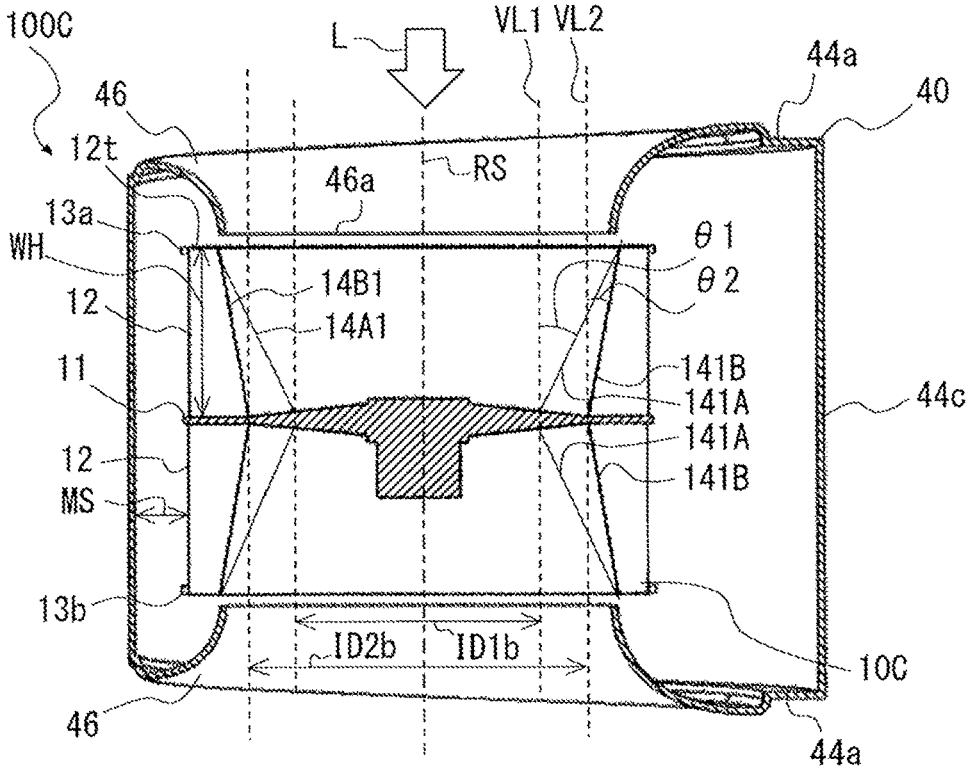
FIG. 21 is a sectional view schematically illustrating a multi-blade fan according to Embodiment 2.
Figure 22:
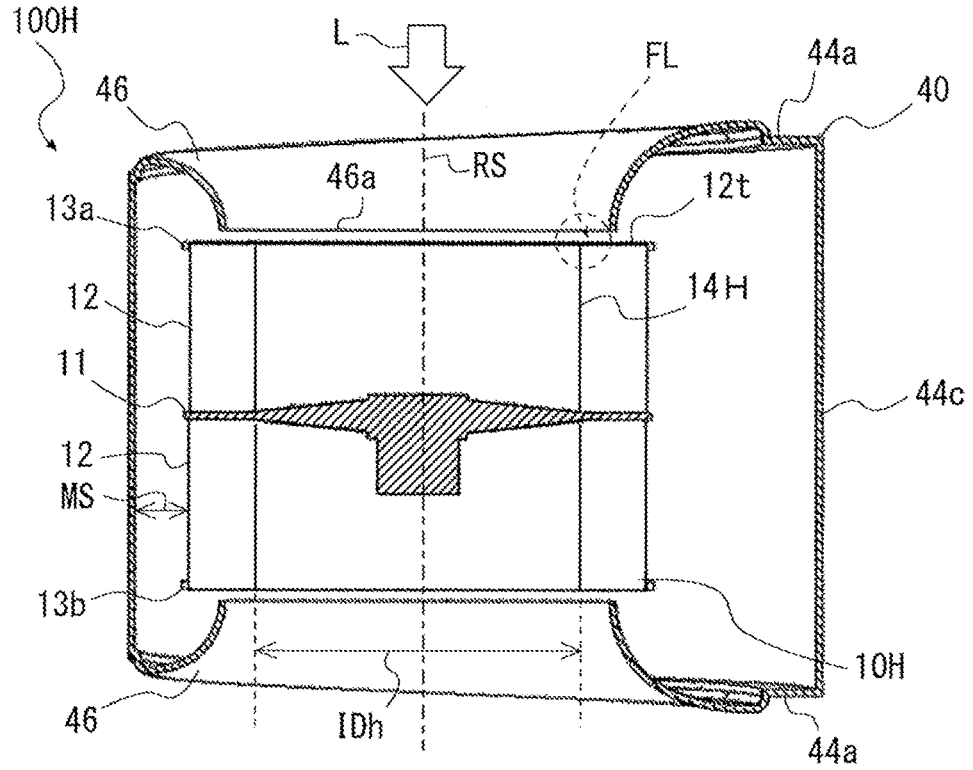
FIG. 22 is a sectional view schematically illustrating a multi-blade fan of a comparative example.
Figure 23:
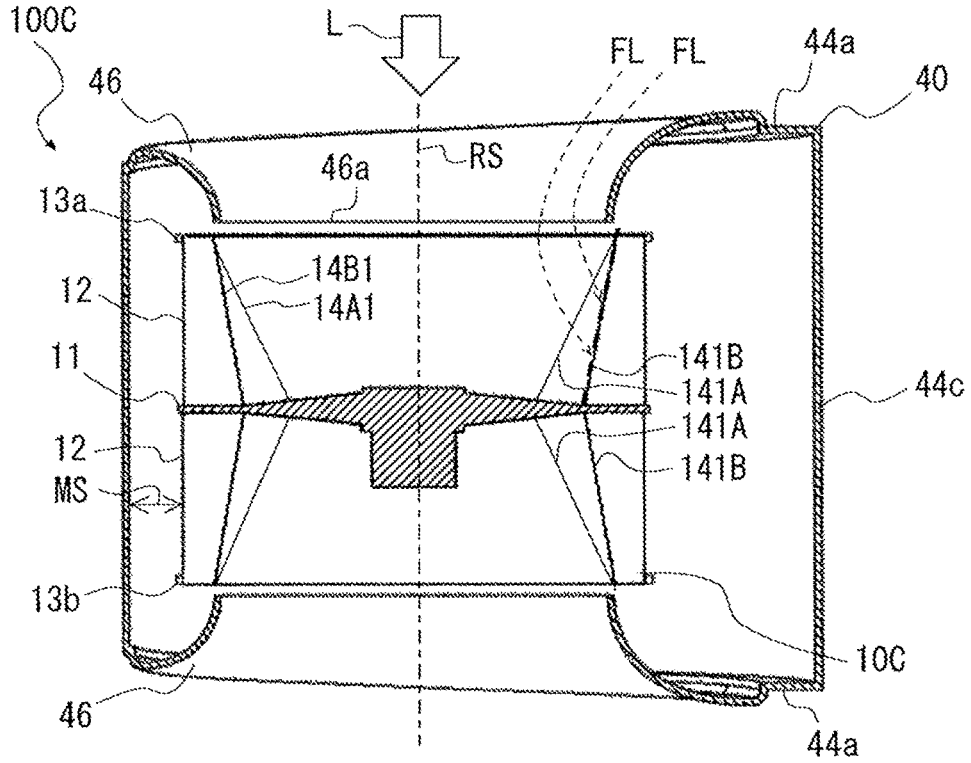
FIG. 23 is a sectional view schematically for explanation of advantages of the multi-blade fan according to Embodiment 2.

FIG. 21 is a schematic sectional view illustrating a multi-blade fan 100C according to Embodiment 2. FIG. 22 is a schematic sectional view illustrating a multi-blade fan 100H of a comparative example. FIG. 23 is a sectional view for explanation of advantages of the multi-blade fan 100C according to Embodiment 2. The schematic sectional view of FIG. 21 is for a schematic sectional view for explanation of advantages the multi-blade fan 100C according to Embodiment 2. The multi-blade fan 100C according to Embodiment 2 will be described with reference to FIGS. 21 to 23, and components and parts thereof that are the same as those of the multi-blade fan 100 or other devices as illustrated in FIGS. 1 to 20 will be denoted by the same reference signs, and their descriptions will thus be omitted. The following description regarding an impeller 10C of the multi-blade fan 100C according to Embodiment 2 further specifies the configuration of the inclined portions 141A and 141B of the blades 12 of the impeller 10 of the multi-blade fan 100 according to Embodiment 1. Therefore, the impeller 10C will be described with reference to FIGS. 21 to 23 by referring mainly to the configuration of the inclined portions 141A and 141B of the multi-blade fan 100C according to Embodiment 2.

As described above, each of the blades 12 has an inclined portion 141A that is inclined such that the leading edge 14A1 is inclined such that in the direction from the main plate 11 toward the side plate 13, the distance between the leading edge 14A1 and the rotation axis RS gradually increases and the blade inside diameter increases. That is, in the blade 12, the inclined portion 141A is inclined such that in the direction from the main plate 11 toward the side plate 13, the inner circumferential end 14A is inclined such that the distance between the inner circumferential end 14A and the rotation axis RS gradually increases and the blade inside diameter increases. Similarly, each of the blades 12 has an inclined portion 141B that is inclined such that in the direction from the main plate 11 toward the side plate 13, the leading edge 14B1 is inclined such that the distance between the leading edge 14B1 and the rotation axis RS gradually increases and the blade inside diameter increases. That is, in the blade 12, the inclined portion 141B is inclined such that in the direction from the main plate 11 toward the side plate 13, the inner circumferential end 14B is inclined such that the distance between the inner circumferential end 24B and the rotation axis RS gradually increases and the blade inside diameter increases.

The inclined portion 141A is inclined relative to the rotation axis RS. Preferably, the angle of inclination of the inclined portion 141A should be greater than 0 degree and smaller than or equal to 60 degrees, and more preferably, should be greater than 0 degree and smaller than or equal to 45 degrees. That is, preferably, an angle θ1 of inclination between the inclined portion 141A and the rotation axis RS should satisfy the relationship "0 degree <θ1≤60 degrees", and more preferably, the angle θ1 of inclination between the inclined portion 141A and the rotation axis RS should satisfy the relationship "0 degree <θ1≤45 degrees". The imaginary line VL1 as indicated in FIG. 1 is an imaginary line parallel to the rotation axis RS. Therefore, the angle between the inclined portion 141A and the imaginary line VL1 is equal to the angle between the inclined portion 141A and the rotation axis RS.

Similarly, the inclined portion 141B is inclined relative to the rotation axis RS. Preferably, the angle of inclination of the inclined portion 141B should be greater than 0 degree and smaller than or equal to 60 degrees, and more preferably, should be greater than 0 degree and smaller than or equal to 45 degrees. That is, preferably, the angle of inclination θ2 between the inclined portion 141B and the rotation axis RS should satisfy the relationship "0 degree <θ2≤60 degrees", and more preferably, should satisfy the relationship "0 degree <θ2≤45 degrees". The imaginary line VL2 as indicated in FIG. 21 is an imaginary line parallel to the rotation axis RS. Therefore, the angle between the inclined portion 141B and the imaginary line VL2 is equal to the angle between the inclined portion 141B and the rotation axis RS. The angle θ1 of inclination and the angle θ2 of inclination may be equal to each other or different from each other.

The blade height WH as indicated in FIG. 21 is less than or equal to 200 mm. The blade height WH is the distance between the main plate 11 and end portions 12*t* of the blades 12 in the axial direction of the rotation axis RS, and is the maximum distance between the main plate 11 and the end portions 12*t* of the blades 12 in the axial direction of the rotation axis RS. The blade height WH is not limited to a blade height less than or equal to 200 mm, that is, it may be greater than 200 mm.

[Advantages of Impeller 10C and Multi-Blade Fan 100C]

As illustrated in FIG. 22, the multi-blade fan 100H of the comparative example is configured such that an inside diameter IDh that is the diameter of a circle drawn through the leading edges 14H is a certain value in the axial direction of the rotation axis RS. That is, the multi-blade fan 100H of the comparative example does not have an inclined portion 141A or an inclined portion 141B, and therefore does not have a gradient formed in the portion corresponding to the blade inside diameter. Therefore, as illustrated in FIG. 22, the multi-blade fan 100H of the comparative example is configured such that air (dotted line FL) to be sucked into the multi-blade fan 100H easily passes through an end portion 12*t* of the impeller 10H or a corner portion formed by the end portion 12*t* and a leading edge 14H. The end portion 12*t* of the impeller 10H or the corner portion formed by the end portion 12*t* and the leading edge 14H is a portion of the blade 12 that has a small area. Therefore, air passes through a narrow gap between the blade 12 and an adjacent blade 12, whereby the multi-blade fan 100H sucks air with a high ventilation resistance.

By contrast, as illustrated in FIG. 23, the multi-blade fan 100C has an inclined portion 141A and an inclined portion 141B at the leading edges of the blades 12, and has a gradient formed in the portion corresponding to the blade inside diameter. Therefore, as illustrated in FIG. 23, by virtue of the gradient formed in the portion corresponding to the blade inside diameter of the blades 12, the multi-blade fan 100C can ensure a larger area of the leading edges of the blades 12 for an air current, whereby air can pass through the impeller 10C with la ow ventilation resistance. As a result, the multi-blade fan 100C can improve an air-sending efficiency.

The angle of inclination of the inclined portions 141A and 141B of the multi-blade fan 100C can be set as appropriate. By further increasing the angles of inclination of the inclined portions 141A and 141B, in the multi-blade fan 100C, it is possible to ensure a larger area of the leading edges of the blades 12 for the air current. However, it is necessary to increase the sizes of the impeller 10C and the multi-blade fan 100C in the radial direction to increase the angles of inclination while ensuring the predetermined blade height WH. To ensure a large area of the leading edges of the blades 12 while preventing upsizing of the impeller 10C and the multi-blade fan 100C, it is preferable that the angles of inclination of the inclined portions 141A and 141B be set smaller than or equal to 60 degrees. Furthermore, in order that the impeller 10C and the multi-blade fan 100C be made smaller, it is preferable that the angles of inclination of the inclined portions 141A and 141B be set smaller than or equal to 45 degrees.

[Multi-Blade Fan 100D]

Figure 24:
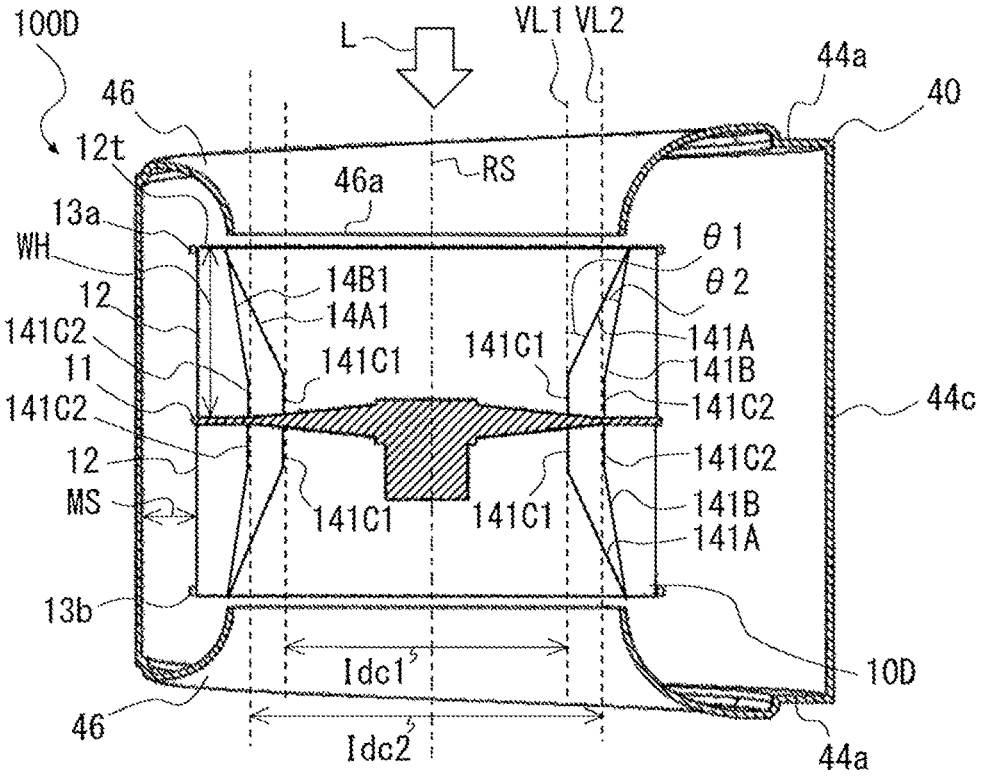
FIG. 24 is a sectional view of a multi-blade fan according to a first modification of the multi-blade fan illustrated in FIG. 21.

FIG. 24 is a sectional view of a multi-blade fan 100D according to a first modification of the multi-blade fan 100C as illustrated in FIG. 21. The multi-blade fan 100D according to the first modification of the multi-blade fan 100C according to Embodiment 2 will be described with reference to FIG. 24. It should be noted that components and parts that are the same in configuration as those of the multi-blade fan 100 or other devices as illustrated in FIGS. 1 to 23 will be denoted by the same reference signs, and their descriptions will thus be omitted. The following description regarding an impeller 10D of the multi-blade fan 100D further specifies the configuration of the leading edges 14A1 and 14B1 of the blades 12 of the impeller 10C of the multi-blade fan 100C according to Embodiment 2. Therefore, in the following description, the impeller 10D is described with reference to FIG. 24 by referring mainly to the configuration of the leading edges 14A1 and 14B1 of the multi-blade fan 100D.

As described above, each of the blades 12 has an inclined portion 141A that is inclined such that in the direction from the main plate 11 toward the side plate 13, the leading edge 14A1 is inclined such that the distance between the leading edge 14A1 and the rotation axis RS gradually increases and the blade inside diameter increases. Similarly, each of the blades 12 has an inclined portion 141B that is inclined such that in the direction from the main plate 11 toward the side plate 13, the leading edge 14B1 is inclined such that the distance between the leading edge 14B1 and the rotation axis RS gradually increases and the blade inside diameter increases. The blades 12 each have a gradient that is formed on the inner circumferential side by the inclined portion 141A and the inclined portion 141B.

The inclined portion 141A is inclined relative to the rotation axis RS. Preferably, the angle of inclination of the inclined portion 141A should be greater than 0 degree and smaller than or equal to 60 degrees, and more preferably, should greater than 0 degree and smaller than or equal to 45 degrees. That is, preferably, the angle of inclination θ1 of the inclined portion 141A to the rotation axis RS should be set to satisfy the relationship "0 degree <θ1≤60 degrees", and more preferably should be set to satisfy the relationship "0 degree <θ1≤45 degrees". Similarly, the inclined portion 141B is inclined relative to the rotation axis RS. Preferably, the angle of inclination of the inclined portion 141B should be greater than 0 degree and smaller than or equal to 60 degrees, and more preferably, should be greater than 0 degree and smaller than or equal to 45 degrees. That is, preferably, the angle θ2 of inclination of the inclined portion 141B to the rotation axis RS should be set to satisfy the relationship "0 degree <θ2≤60 degrees", and more preferably should be set to satisfy the relationship "0 degree <θ2≤45 degrees".

The blade height WH as indicated in FIG. 24 is less than or equal to 200 mm. The blade height WH is the distance between the main plate 11 and end portions 12*t* of the blades 12 in the axial direction of the rotation axis RS, and is the maximum distance between the main plate 11 and the end portions 12*t* of the blades 12 in the axial direction of the rotation axis RS. The blade height WH is not limited to a height that is less than or equal to 200 mm, that is, it may be greater than 200 mm.

The blades 12 have linear portions 141C1 that are provided at the leading edges 14A1 between the main plate 11 and the side plate 13 and that are parallel to the rotation axis RS in FIG. 24. It should be noted that the configuration of the linear portions 141C1 are not limited to the above configuration in which the linear portions 141C1 are parallel to the rotation axis RS. The linear portions 141C1 are provided between the main plate 11 and the side plate 13 and closer to the main plate 11 to the side plate 13. Therefore, in each of the first blades 12A, the leading edge 14A1 has a linear portion 141C1 provided closer to the main plate 11 and an inclined portion 141A provided closer to the side plate 13. The impeller 10D of the multi-blade fan 100D is configured such that an inside diameter IDc1 that is the diameter of a circle drawn through the linear portions 141C1 of the leading edges 14A1 is constant in the axial direction of the rotation axis RS.

Similarly, the blades 12 have linear portions 141C2 that are provided at the leading edges 14B1 between the main plate 11 and the side plate 13 and that are parallel to the rotation axis RS as indicated in FIG. 24. It should be noted that the linear portions 141C2 are not limited to the above configuration in which the linear portions 141C2 are parallel to the rotation axis RS. The linear portions 141C2 are provided between the main plate 11 and the side plate 13 and closer to the main plate 11 than the side plate 13. Therefore, the leading edge 14B1 of each of the second blades 12B has a linear portion 141C2 provided closer to the main plate 11 and an inclined portion 141B provided closer to the side plate 13. In the impeller 10D of the multi-blade fan 100D, an inside diameter IDc2 that is the diameter of a circle drawn through the linear portions 141C2 of the leading edges 14B1 is constant in the axial direction of the rotation axis RS.

[Advantages of Impeller 10D and Multi-Blade Fan 100D]

As illustrated in FIG. 24, in the multi-blade fan 100D, at the leading edge of each of the blades 12, an inclined portion 141A and an inclined portion 141B are provided, and a gradient is formed in the portion corresponding to the blade inside diameter. Therefore, in the multi-blade fan 100D, because of formation of the gradient formed in the portion corresponding to the blade inside diameter of the blade 12, it is possible to increase the area of the leading edge of the blade 12 for an air current, whereby air can pass through the impeller 10D with a lower ventilation resistance. As a result, the multi-blade fan 100D can improve the air-sending efficiency.

[Multi-Blade Fan 100E]

Figure 25:
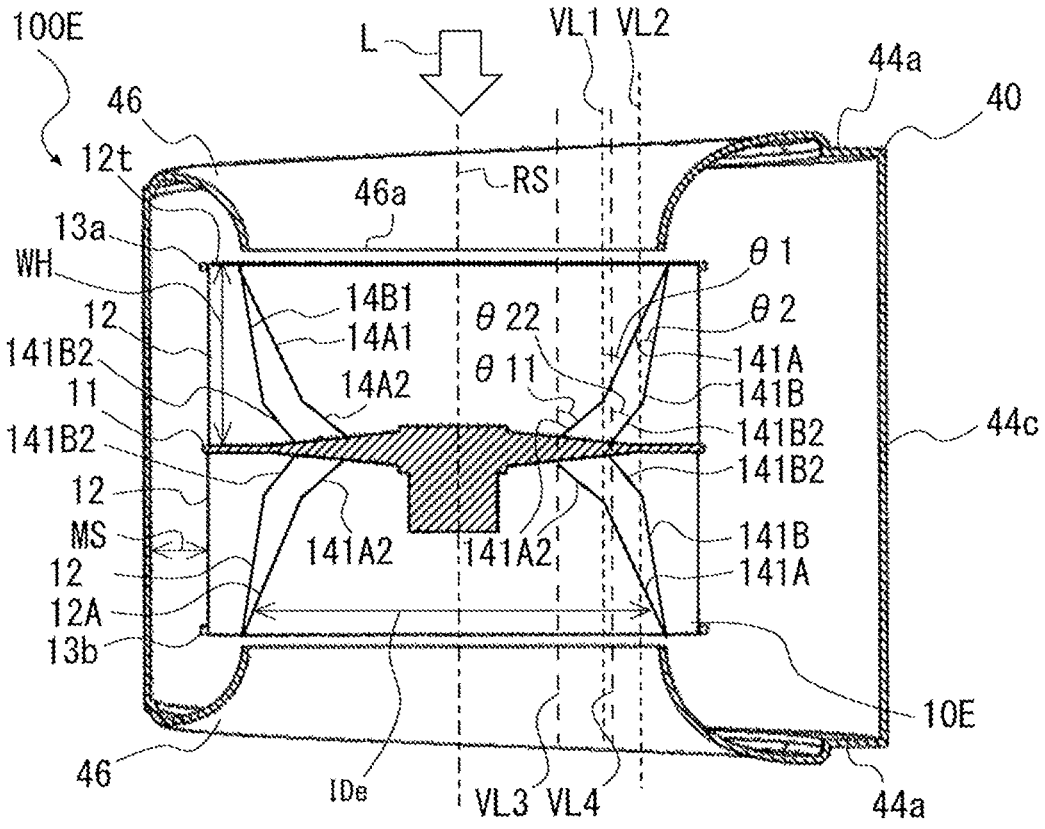
FIG. 25 is a sectional view of a multi-blade fan according to a second modification of the multi-blade fan illustrated in FIG. 21.

FIG. 25 is a sectional view of a multi-blade fan 100E that is a second modification of the multi-blade fan 100C as illustrated in FIG. 21. The multi-blade fan 100E that is the second modification of the multi-blade fan 100C according to Embodiment 2 will be described with reference to FIG. 25, and components and portions that are the same as those of the multi-blade fan 100 or other devices as illustrated in FIGS. 1 to 24 will be denoted by the same reference signs, and their descriptions will thus be omitted. The following description regarding an impeller 10E of the multi-blade fan 100E further specifies the configuration of the leading edges 14A1 and 14B1 of the blades 12 of the impeller 10C of the multi-blade fan 100C according to Embodiment 2. Therefore, the description regarding the impeller 10E will be made by referring mainly to the configuration of the leading edges 14A1 and 14B1 of the multi-blade fan 100E, with reference to FIG. 25.

As described above, each of the blades 12 has an inclined portion 141A that is inclined such that in the direction from the main plate 11 toward the side plate 13, the leading edge 14A1 is inclined such that the distance between the leading edge 14A1 and the rotation axis RS gradually increases and a blade inside diameter IDe increases. Furthermore, the blade 12 has an inclined portion 141A2 that is inclined such that in the direction from the main plate 11 toward the side plate 13, the leading edge 14A1 is inclined such that the distance between the leading edge 14A1 and the rotation axis RS gradually increases and the blade inside diameter IDe increases. The inclined portion 141A2 is provided between the main plate 11 and the side plate 13 and closer to the main plate 11 than the side plate 13. Therefore, the leading edge 14A1 of the first blade 12A has the inclined portion 141A2 provided closer to the main plate 11 and the inclined portion 141A provided closer to the side plate 13. That is, between the main plate 11 and the side plate 13, the first blade 12A of the blade 12 has two inclined portions, namely the inclined portion 141A and the inclined portion 141A2. The configuration of the first blade 12A of the blade 12 is not limited to a configuration in which the first blade 12A has two inclined portions, namely an inclined portion 141A and an inclined portion 141A2. That is, the first blade 12A has only to have two or more inclined portions.

Similarly, each of the blades 12 has an inclined portion 141B that is inclined such that in the direction from the main plate 11 toward the side plate 13, the leading edge 14B1 is inclined such that the distance between the leading edge 14B1 and the rotation axis RS gradually increases and the blade inside diameter IDe increases. Furthermore, the blade 12 has an inclined portion 141B2 that is inclined such that in the direction from the main plate 11 toward the side plate 13, the leading edge 14B1 is inclined such that the leading edge 14B1 and the rotation axis RS increases and the blade inside diameter IDe increases. The inclined portion 141B2 is provided between the main plate 11 and the side plate 13 and closer to the main plate 11 than the side plate 13. Therefore, the leading edge 14B1 of each second blade 12B has an inclined portion 141B2 provided closer to the main plate 11 and an inclined portion 141B provided closer to the side plate 13. That is, between the main plate 11 and the side plate 13, the second blade 12B of the blade 12 has two inclined portions, namely an inclined portion 141B and an inclined portion 141B2. The configuration of the second blade 12B of the blade 12 is not limited to a configuration in which the second blade 12B has two inclined portions, namely an inclined portion 141B and an inclined portion 141B2; that is, the second blade 12B has only to have two or more inclined portions. The blades 12 have gradients formed on the inner circumferential side by the inclined portion 141A, the inclined portion 141A2, the inclined portion 141B, and the inclined portion 141B2.

At least one of the inclined portion 141A and the inclined portion 141A2 is inclined relative to the rotation axis RS. Preferably, the angles of inclination of the inclined portion 141A and/or the inclined portion 141A2 should be greater than 0 degree and smaller than or equal to 60 degrees, and more preferably, should be greater than 0 degree and smaller than or equal to 45 degrees. That is, preferably, the angle θ1 of inclination between the inclined portion 141A and the rotation axis RS should be set to satisfy the relationship "0 degree <θ1≤60 degrees" or more preferably, should be set to satisfy the relationship "0 degree <θ1≤45 degrees". Alternatively, preferably, the angle θ11 of inclination between the inclined portion 141A2 and the rotation axis RS should be set to satisfy the relationship "0 degree <θ11≤60 degrees", and more preferably, should be set to satisfy the relationship "0 degree <θ11≤45 degrees". It should be noted that the imaginary line VL3 as indicated in FIG. 25 is an imaginary line parallel to the rotation axis RS. Therefore, the angle between the inclined portion 141A2 and the imaginary line VL3 is equal to the angle between the inclined portion 141A2 and the rotation axis RS.

The angle θ1 of inclination of the inclined portion 141A and the angle θ11 of inclination of the inclined portion 141A2 are different from each other. In the case where the first blade 12A has two or more inclined portions, the angles of inclination of the inclined portions are different from each other. The relationship between the angle 01 of inclination of the inclined portion 141A and the angle θ11 of inclination of the inclined portion 141A2 is not limited. For example, as illustrated in FIG. 25, the angle 011 of inclination of the inclined portion 141A2 of the first blade 12A may be greater than the angle θ1 of inclination of the inclined portion 141A of the first blade 12A. Alternatively, the angle θ11 of inclination of the inclined portion 141A2 of a first blade 12A may be smaller than the angle θ1 of inclination of the inclined portion 141A of the first blade 12A.

Similarly, at least one of the inclined portion 141B and the inclined portion 141B2 is inclined relative to the rotation axis RS. Preferably, the angles of inclination of the inclined portion 141B and/or the inclined portion 141B2 should be greater than 0 degree and smaller than or equal to 60 degrees, and more preferably should be greater than 0 degree and smaller than or equal to 45 degrees. That is, preferably, the angle θ2 of inclination between the inclined portion 141B and the rotation axis RS should be set to satisfy the relationship "0 degree <θ2≤60 degrees", and more preferably, should be set to satisfy the relationship "0 degree <θ2≤45 degrees". Alternatively, preferably, the angle θ22 of inclination between the inclined portion 141B2 and the rotation axis RS should be set to satisfy the relationship "0 degree <θ22≤60 degrees", and more preferably, should be set to satisfy the relationship "0 degree <θ22≤45 degrees". The imaginary line VL4 as indicated in FIG. 25 is an imaginary line parallel to the rotation axis RS. Therefore, the angle between the inclined portion 141B2 and the imaginary line VL4 is equal to the angle between the inclined portion 141B2 and the rotation axis RS.

The angle θ2 of inclination of the inclined portion 141B and the angle θ22 of inclination of the inclined portion 141B2 are different from each other. In the case where the second blade 12B has two or more inclined portions, the angles of inclination of the inclined portions are different from each other. The relationship between the angle θ2 of inclination of the inclined portion 141B and the angle θ22 of inclination of inclination θ22 of the inclined portion 141B2 is not limited. For example, as illustrated in FIG. 25, the angle θ22 of inclination of the inclined portion 141B2 of a second blade 12B may be greater than the angle θ2 of inclination of the inclined portion 141B of the second blade 12B. Alternatively, the angle θ2 of inclination of θ22 of the inclined portion 141B2 of the second blade 12B may be smaller than the angle 92 of inclination of the inclined portion 141B of the second blade 12B.

The blade height WH as indicated in FIG. 25 is less than or equal to 200 mm. The blade height WH is the distance between the main plate 11 and end portions 12*t* of the blades 12 in the axial direction of the rotation axis RS, and is the maximum distance between the main plate 11 and the end portions 12*t* of the blades 12 in the axial direction of the rotation axis RS. The blade height WH is not limited to a height that is less than or equal to 200 mm, that is, it may be greater than 200 mm.

[Advantages of Impeller 10E and Multi-Blade Fan 100E]

As illustrated in FIG. 25, in the multi-blade fan 100E, at the leading edge of each of the blades 12, an inclined portion 141A, an inclined portion 141A2, an inclined portion 141B, and an inclined portion 141B2 are provided, and a gradient is formed in the portion corresponding to the blade inside diameter IDe. Therefore, in the multi-blade fan 100E, because of formation of the gradient in the portion corresponding to the blade inside diameter IDe of the blades 12, it is possible to increase the area of the leading edges of the blades 12 for an air current, whereby air can pass through the impeller 10E with a lower ventilation resistance. As a result, the multi-blade fan 100E can increase the air-sending efficiency.

Embodiment 3

[Multi-Blade Fan 100F]

Figure 26:
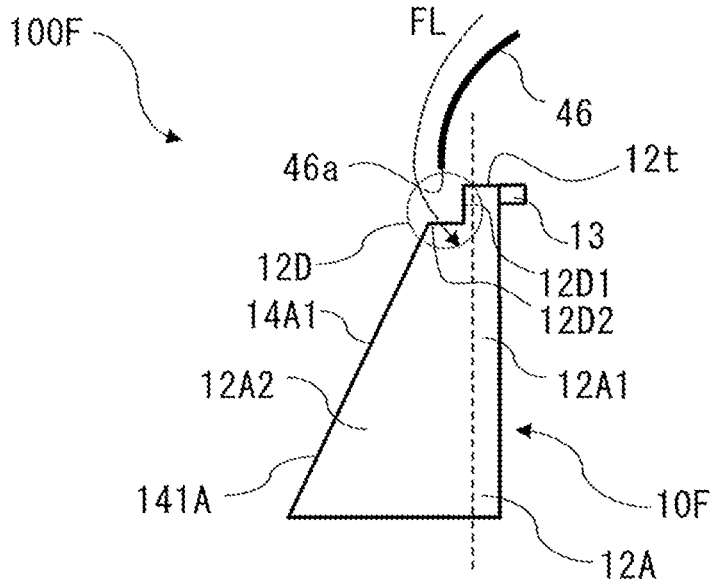
FIG. 26 is a schematic view illustrating a relationship between a bellmouth and a blade of a multi-blade fan according to Embodiment 3.
Figure 27:
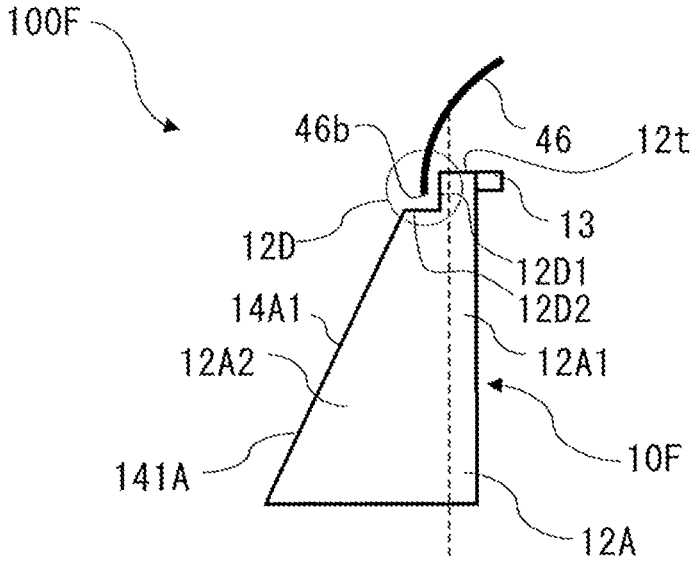
FIG. 27 is a schematic view illustrating a relationship between the bellmouth and a blade of a modification of the multi-blade fan according to Embodiment 3.

FIG. 26 is a schematic view illustrating a relationship between a bellmouth 46 and a blade 12 at a multi-blade fan 100F according to Embodiment 3. FIG. 27 is a schematic view illustrating a relationship between a bellmouth 46 and a blade 12 of a modification of the multi-blade fan 100F according to Embodiment 3. The multi-blade fan 100F according to Embodiment 3 will be described with reference to FIGS. 26 and 27. It should be noted that components and portions that are the same in configuration as those of the multi-blade fan 100 or other devices as illustrated in FIGS. 1 to 25 will be denoted by the same reference signs, and their descriptions will be omitted. The following description regarding an impeller 10F of the multi-blade fan 100F according to Embodiment 3 further specifies the configuration of the turbo blade portions of the impeller 10 of the multi-blade fan 100 according to Embodiment 1. Therefore, the description regarding the impeller 10F will be made with reference to FIGS. 26 and 27 by referring mainly to the configuration of the turbo blade portions of the multi-blade fan 100F according to Embodiment 3.

The impeller 10F of the multi-blade fan 100F according to Embodiment 3 have step portions 12D formed at end portions 12*t* of respective turbo blade portions, which is closer to the side plate 13. Each of the step portions 12D will be described referring to the first blade 12A as illustrated in FIG. 26. The step portion 12D is formed at an end portion 12*t* of the first turbo blade portion 12A2 that is closer to the side plate 13. That is, the step portion 12D is formed at the end portion 12*t* of the inclined portion 141A, which is closer to the side plate 13. The step portion 12D is formed by notching a wall that forms the first blade 12A. The step portion 12D is formed by a continuous portion between the leading edge 14A1 of the first blade 12A and the end portion 12*t* of the first turbo blade portion 12A2. The step portion 12D is formed by a side edge portion 12D1 extending in the axial direction of the rotation axis RS of the impeller 10F and an upper edge portion 12D2 extending in the radial direction of the impeller 10F; however, the configuration of the step portion 12D is not limited to such a configuration. For example, the step portion 12D may be formed as an arc-shaped edge portion in which the side edge portion 12D1 and the upper edge portion 12D2 are formed continuously and integrally with each other.

The second blade 12B has also a step portion 12D, although this illustration will be omitted since the configuration of the step portion 12D of the second blade 12B is similar to that of the step portion 12D of the first blade 12A. The step portion 12D is formed at an end portion 12*t* of the second turbo blade portion 12B2, which is closer to the side plate 13. That is, the step portion 12D is formed at the end portion 12*t* of the inclined portion 141B, which is closer to the side plate 13. The step portion 12D is formed by notching a wall that forms the second blade 12B. The step portion 12D is formed by notching a continuous portion between the leading edge 14B1 of the second blade 12B and the end portion 12*t* of the second turbo blade portion 12B2, which is closer to the side plate 13.

The blades 12 of the multi-blade fan 100F according to Embodiment 3 are formed such that a blade outside diameter of the blades 12 that is the diameter of a circle drawn through the outer circumferential ends of the blades 12 is larger than the inside diameter BI of the bellmouth 46. Moreover, as illustrated in FIGS. 26 and 27, the multi-blade fan 100F is configured such that an inner circumferential end portion 46*b* of the bellmouth 46 is provided above the step portion 12D. The multi-blade fan 100F is configured such that the inner circumferential end portion 46*b* of the bellmouth 46 is provided above to face the upper edge portion 12D2 of the step portion 12D. The multi-blade fan 100F has a gap formed between the inner circumferential end portion 46*b* of the bellmouth 46 and the side edge portion 12D1 and between the inner circumferential end portion 46*b* of the bellmouth 46 and the upper edge portion 12D2.

[Advantages of Impeller 10F and Multi-Blade Fan 100F]

The impeller 10F and the multi-blade fan 100F have the step portions 12D formed at the end portions 12*t* of the turbo blade portions that are closer to the side plate 13. In the impeller 10F and the multi-blade fan 100F, because of provision of the step portions 12D, it is possible to widen the gap between the bellmouth 46 and each of the blades 12. Therefore, in the impeller 10F and the multi-blade fan 100F, it is possible to reduce an increase in velocity of an air current in the gap between the bellmouth 46 and the blade 12, whereby it is possible to reduce noise that is generated by the air current that passes through the gap between the bellmouth 46 and the blade 12.

Furthermore, in the impeller 10F and the multi-blade fan 100F, it is possible to provide the bellmouth 46 closer to the impeller 10F than in the case where the blade 12 has no step portion 12D. Moreover, in the impeller 10F and the multi-blade fan 100F, since the bellmouth 46 is provided close to the impeller 10F, it is possible to reduce the gap between the bellmouth 46 and the blade 12. As a result, the impeller 10F and the multi-blade fan 100F can reduce leakage of sucked air, that is, they can reduce the amount of air that does not pass through the space between adjacent blades 12 of the impeller 10F. Since the bellmouth 46 and the side edge portions 12D1 are provided to face each other as illustrated in FIG. 27, the impeller 10F and the multi-blade fan 100F can further reduce leakage of sucked air than in the case where the bellmouth 46 and the side edge portions 12D1 do not face each other. In other words, since the bellmouth 46 is provided within the step portions 12D and provided above each of the blades 12 and in the radial direction of the blade 12, the multi-blade fan 100F can further reduce leakage of sucked air than in the case where the bellmouth 46 is not provided within the step portions 12D.

Embodiment 4

[Multi-Blade Fans 100J, 100K, and 100L]

Figure 28:
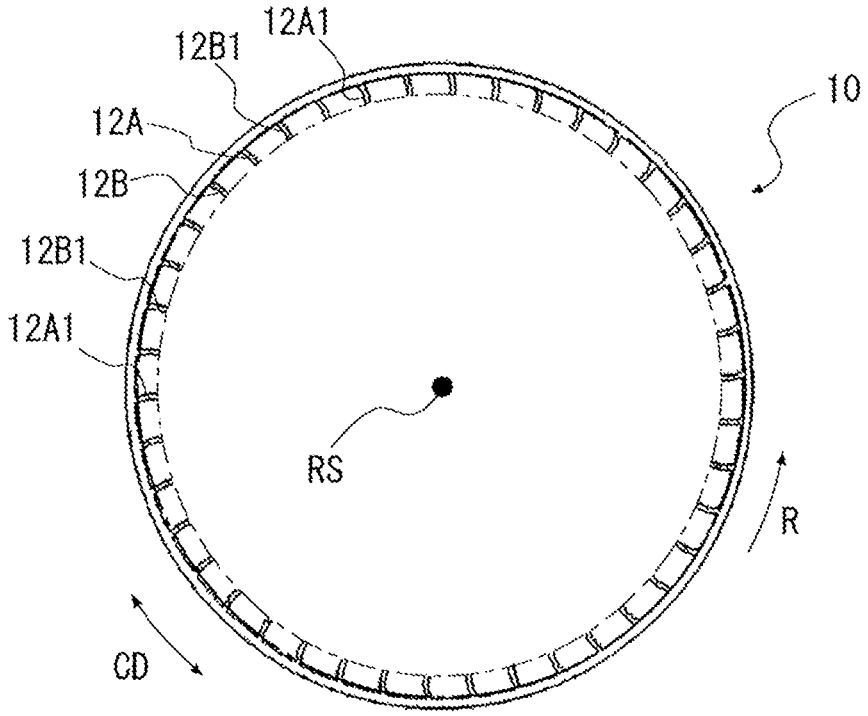
FIG. 28 is a schematic view of blades at an end portion an impeller of a multi-blade fan according to Embodiment 4, which is closer to a side plate in a direction parallel to the rotation axis in an impeller of a multi-blade fan according to Embodiment 4.
Figure 29:
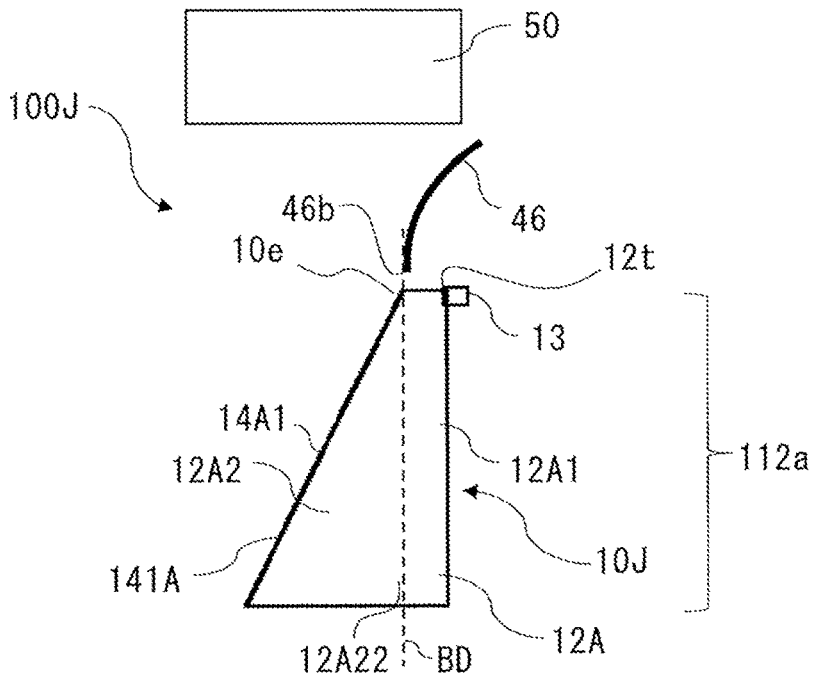
FIG. 29 is a first schematic view illustrating a relationship between an impeller and a bellmouth of the multi-blade fan according to Embodiment 4.
Figure 30:
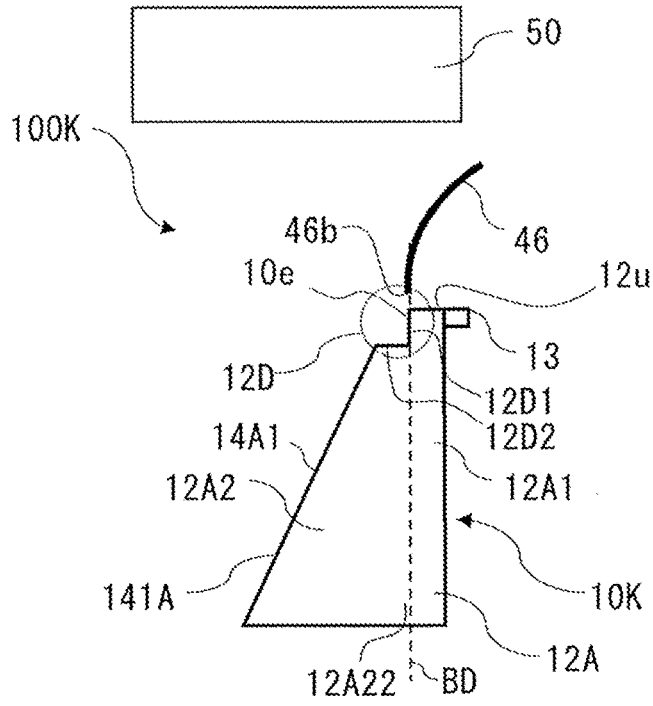
FIG. 30 is a second schematic view illustrating a relationship between an impeller and the bellmouth of a multi-blade fan according to Embodiment 4.
Figure 31:
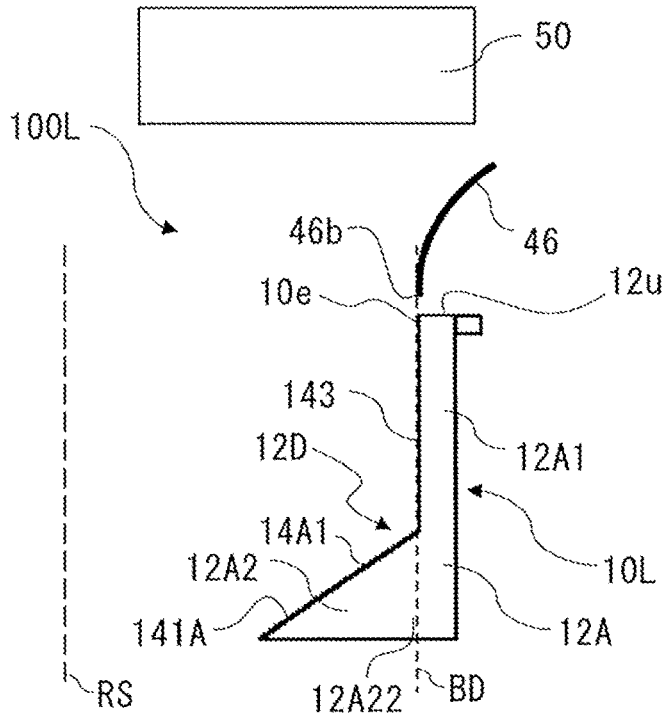
FIG. 31 is a third schematic view illustrating a relationship between the impeller and the bellmouth of the multi-blade fan according to Embodiment 4.

FIG. 28 is a schematic view illustrating blades 12 at an end portion of an impeller 10 of a multi-blade fan 100 according to Embodiment 4b, which is closer to the side plate 13 in a direction parallel to the rotation axis RS of the impeller 10. FIG. 29 is a first schematic view illustrating a relationship between an impeller 10J and the bellmouth 46 of a multi-blade fan 100J according to Embodiment 4. FIG. 30 is a second schematic view illustrating a relationship between an impeller 10K and the bellmouth 46 of a multi-blade fan 100K according to Embodiment 4. FIG. 31 is a third schematic view illustrating a relationship between an impeller 10L and a bellmouth 46 of a multi-blade fan 100L according to Embodiment 4. In the following description, the multi-blade fans 100J, 100K, and 100L may be referred to as "multi-blade fan 100K, etc." Furthermore, the impellers 10J, 10K, and 10L may be referred to as "impeller 10J, etc."

In each of FIGS. 29 to 31, the dotted line BD indicates a boundary between a first sirocco blade portion 12A1 and a first turbo blade portion 12A2. Also, in each of FIGS. 29 to 31, the dotted line BD indicates a boundary between a second sirocco blade portion 12B1 and a second turbo blade portion 12B2. The multi-blade fans 100J, 100K, and 100L according to Embodiment 4 will be described with reference to FIGS. 29 to 31. It should be noted that components and parts that have the same configurations as those of the multi-blade fan 100 or other devices as illustrated in FIGS. 1 to 27 will be denoted by the same reference signs, and their descriptions will thus be omitted. Furthermore, the impellers 10J, 10K, and 10L illustrated in FIGS. 29 to 31 correspond to the impeller 10 of FIG. 28. Each of the multi-blade fans 100J, 100K, and 100L includes a motor 50 as well as the multi-blade fan 100 as illustrated in FIG. 9.

As illustrated in FIGS. 28 and 29, each of end portions 12*u* of the impeller 10J that are closer to the side plate 13 includes the first sirocco blade portion 12A1. Moreover, the first sirocco blade portion 12A1 is formed such that the ratio of the inside diameter of the first blades 12A to the outside diameter of the first blades 12A is higher than or equal to 0.7. That is, the multi-blade fan 100J is configured such that a region of each of the blades 12 that is closer to the side plate 13 is formed as a sirocco blade portion in which the ratio of the inside diameter of the blades 12 to the outside diameter of the blades 12 is higher than or equal to 0.7. Since the multi-blade fan 100J has a first sirocco blade portion 12A1 in which the ratio of the inside diameter of the first blades 12A to the outside diameter of the first blades 12A in the region closer to the side plate 13 is higher than or equal to 0.7, it is possible to widen in the radial direction, part of each of the first blades 12A that is close to the air inlet 10*e*.

In the case where the impeller 10J includes second blades 12B, each of the end portions 12*u* of the impeller 10J that are closer to the side plate 13 has the first sirocco blade portion 12A1 and the second sirocco blade portion 12B1. Moreover, the second sirocco blade portion 12B1 is formed such that the ratio of the inside diameter of the second blades 12B to the outside diameter of the second blades 12B is higher than or equal to 0.7. That is, the multi-blade fan 100J is configured such that a region of each of the blades 12 that is closer to the side plate 13 is formed as a sirocco blade portion in which the ratio of the inside diameter of the blades 12 to the outside diameter of the blades 12 is higher than or equal to 0.7. Since the multi-blade fan 100 has the first sirocco blade portion 12A1 and the second sirocco blade portion 12B1 that are formed such that the ratio of the inside diameter of the blades 12 to the outside diameter of the blades 12 in the region beside the side plate 13 is higher than or equal to 0.7, it is possible to widen in the radial direction, part of each of the second blades 12B that is close to the air inlet 10*e*.

Similarly, as illustrated in FIGS. 28 and 30, each of end portions 12*u* of the impeller 10K that are closer to the side plate 13 has the first sirocco blade portion 12A1. Moreover, the first sirocco blade portion 12A1 is formed such that the ratio of the inside diameter of the first blades 12A to the outside diameter of the first blades 12A is higher than or equal to 0.7. That is, in the multi-blade fan 100K, a region of each of the blades 12 that is closer to the side plate 13 is formed as a sirocco blade portion in which the ratio of the inside diameter of the blades 12 to the outside diameter of the blades 12 is higher than or equal to 0.7. Since the multi-blade fan 100K has the first sirocco blade portion 12A1 in which the ratio of the inside diameter of the first blades 12A to the outside diameter of the first blades 12A in the region close to the side plate 13 is higher than or equal to 0.7, the multi-blade fan 100K, it is possible to widen in the radial direction, part of each of the first blades 12A that is closer to the air inlet 10*e*.

In the case where the impeller 10K includes second blades 12B, each of the end portions 12*u* of the impeller 10K that are closer to the side plate 13 has the first sirocco blade portion 12A1 and the second sirocco blade portion 12B1. Moreover, the second sirocco blade portion 12B1 is formed such that the ratio of the inside diameter of the second blades 12B to the outside diameter of the second blades 12B is higher than or equal to 0.7. That is, in the multi-blade fan 100K, the region of each of the blades 12 that is closer to the side plate 13 is formed as a sirocco blade portion in which the ratio of the inside diameter of the blades 12 to the outside diameter of the blades 12 is higher than or equal to 0.7. Since the multi-blade fan 100K has the first sirocco blade portion 12A1 and the second sirocco blade portion 12B1 that that are formed such that the ratio of the inside diameter of the blades 12 to the outside diameter of the blades 12 in the region beside the side plate 13 is higher than or equal to 0.7, it is possible to widen in the radial direction, part of each of the second blades 12B that is close to the air inlet 10*e*.

The impeller 10K of the multi-blade fan 100K has step portions 12D that are formed at the end portions 12*u* of the respective turbo blade portions that are closer to the side plate 13.

Similarly, as illustrated in FIGS. 28 and 31, an end portion 12*u* of the impeller 10L that is closer to the side plate 13 has the first sirocco blade portion 12A1. Moreover, the first sirocco blade portion 12A1 is formed such that the ratio of the inside diameter of the first blades 12A to the outside diameter of the first blades 12A is higher than or equal to 0.7. That is, in a region of each of the blades 12 that is closer to the side plate 13, the multi-blade fan 100L has a sirocco blade portion in which the ratio of the inside diameter of the blades 12 to the outside diameter of the blades 12 is higher than or equal to 0.7. Since the multi-blade fan 100L has the first sirocco blade portion 12A1 in which the ratio of the inside diameter of the first blades 12A to the outside diameter of the first blades 12A in the region closer to the side plate 13 is higher than or equal to 0.7, it is possible to widen in the radial direction, part of each of the first blades 12A that is closer to the air inlet 10*e*.

In the case where the impeller 10L includes second blades 12B, each of the end portions 12*u* of the impeller 10L that are closer to the side plate 13 has the first sirocco blade portion 12A1 and the second sirocco blade portion 12B1. Moreover, the second sirocco blade portion 12B1 is formed such that the ratio of the inside diameter of the second blades 12B to the outside diameter of the second blades 12B is higher than or equal to 0.7. That is, in the multi-blade fan 100L, the region of each of the blades 12, which is closer to the side plate 13, is formed as a sirocco blade portion in which the ratio of the inside diameter of the blades 12 to the outside diameter of the blades 12 is higher than or equal to 0.7. Since the multi-blade fan 100L has the first sirocco blade portion 12A1 and the second sirocco blade portion 12B1 that are formed such that the ratio of the inside diameter of the blades 12 to the outside diameter of the blades 12 in the region closer to the side plate 13 is higher than or equal to 0.7, it is possible to widen in the radio direction, part of each of the second blades 12B near the air inlet 10*e*.

In the impeller 10L of the multi-blade fan 100L, between the end portion 12*u* and the inclined portion 141A, a linear portion 143 is formed. The linear portion 143 extends in a direction along the axial direction of the rotation axis RS, as compared with the inclined portion 141A. That is, the linear portion 143 is inclined at a smaller angle than the inclined portion 141A in the axial direction of the rotation axis RS. The linear portion 143 may be formed to extend in a direction parallel to the axial direction of the rotation axis RS. It should be noted that the direction in which the linear portion 143 extends may not be parallel to the axial direction of the rotation axis RS. In the impeller 10L of the multi-blade fan 100L, the linear portion 143, which extends in the axial direction of the rotation axis RS, and the inclined portion 141A, which is inclined with respect to the axial direction of the rotation axis RS, form a step portion 12D.

[Advantages of Impeller 10J, Multi-Blade Fan 100J, and Other Devices]

Each of the blades 12 has a sirocco blade portion formed such that at an end portion closer to the side plate 13 in the axial direction of the rotation axis RS, the ratio of the blade inside diameter of the blades 12 that is the diameter of a circle drawn through the inner circumferential ends of the blades 12 to the blade outside diameter of the blades that is the diameter of a circle drawn through the outer circumferential ends of the blades 12 is higher than or equal to 0.7. Since the impeller 10J, the multi-blade fan 100J, etc., each have sirocco blade portions in which the ratio of the inside diameter of the blades 12 to the outside diameter of the blades 12 at the end portions 12*u* closer to the side plate 13 is higher than or equal to 0.7, it is possible to widen the gap between the bellmouth 46 and each of the blades 12. Therefore, in the impeller 10J, the multi-blade fan 100J, etc., it is possible reduce an increase in velocity of an air current in the gap between the bellmouth 46 and the blade 12, thus reducing noise that is generated by an air current that passes through the gap between the bellmouth 46 and the blade 12.

Furthermore, by virtue of the above configuration, in the case where the motor 50 and the blade 12 are close to each other, in the impeller 10J, the multi-blade fan 100J, etc., it is possible to reduce a resistance during suction and reduce generated noise.

Furthermore, in the impeller 10K, the multi-blade fan 100K, etc., step portions 12D are formed at end portions 12*u* of a turbo blade portion that are closer to the side plate 13. Because of provision of the step portions 12D, in the impeller 10K, the multi-blade fan 100K, etc., it is possible to widen the gap between the bellmouth 46 and each of the blades 12. Therefore, in the impeller 10K, the multi-blade fan 100K, etc., it is possible to reduce an increase in velocity of an air current in the gap between the bellmouth 46 and the blade 12, and thus reduce noise that is generated by the air current passing through the gap between the bellmouth 46 and the blade 12.

In addition, in the impeller 10L of the multi-blade fan 100L, h the linear portion 143 and the inclined portion 141A form the step portion 12D. Since each of the first blades 12A has the inclined portion 141A and the linear portion 143, in the impeller 10L and the multi-blade fan 100L, it is possible to reduce the areas of the first blades 12A and reduce a resistance against sucked air.

[Modifications of Multi-Blade Fans 100J, 100K, and 100L, Etc.]

Figure 32:
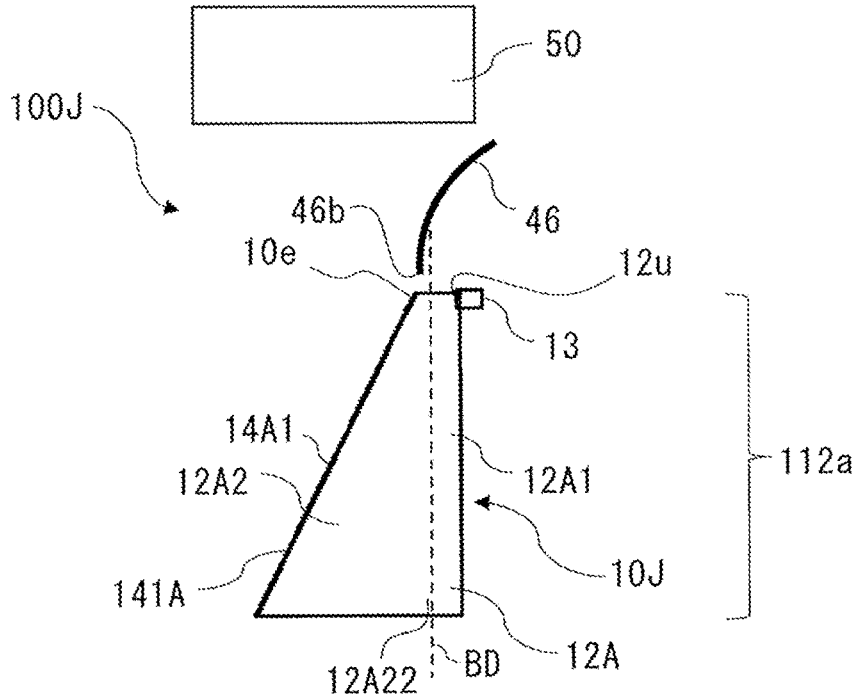
FIG. 32 is a first schematic view illustrating a relationship between an impeller and the bellmouth of a modification of a multi-blade fan according to Embodiment 4.
Figure 33:
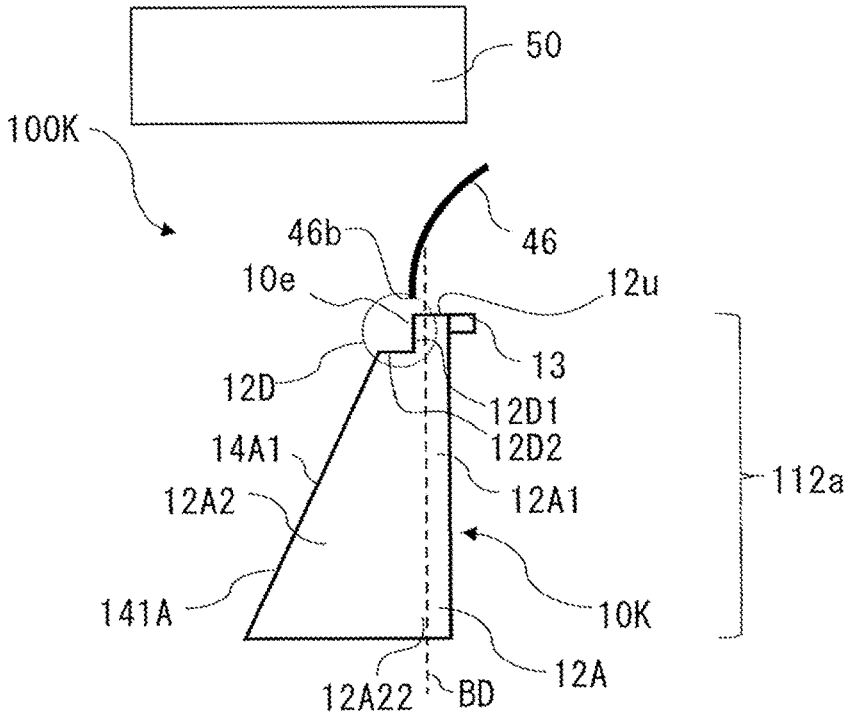
FIG. 33 is a second schematic view illustrating a relationship between the impeller and the bellmouth of a modification of the multi-blade fan according to Embodiment 4.
Figure 34:
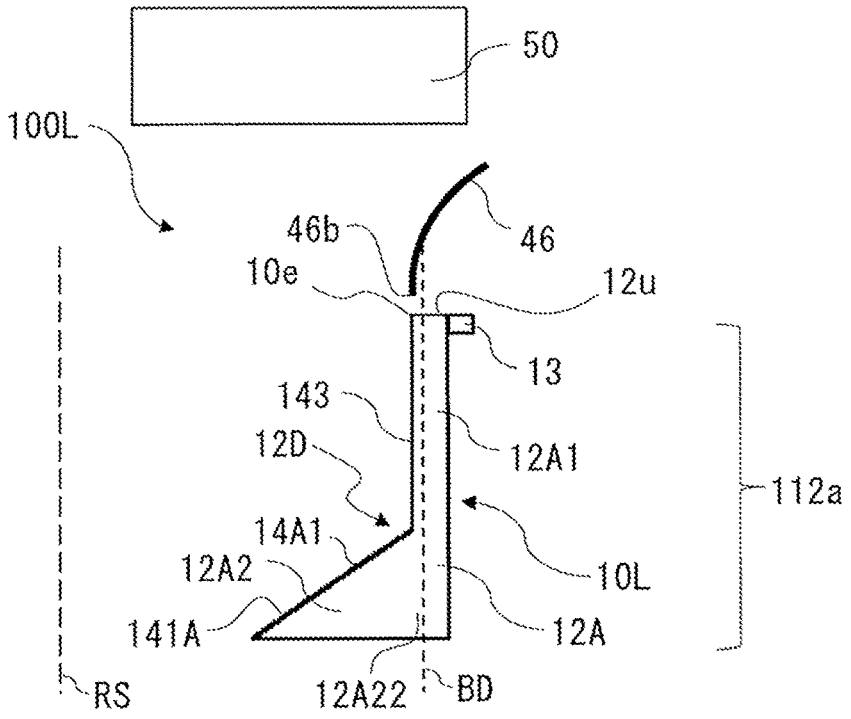
FIG. 34 is a third schematic view illustrating a relationship between an impeller and the bellmouth of a modification of the multi-blade fan according to Embodiment 4.

FIG. 32 is a first schematic view illustrating a relationship between an impeller 10J and the bellmouth 46 of a modification of the multi-blade fan 100J according to Embodiment 4. FIG. 33 is a second schematic view illustrating a relationship between an impeller 10K and the bellmouth 46 of a modification of the multi-blade fan 100K according to Embodiment 4. FIG. 34 is a third schematic view illustrating a relationship between an impeller 10L and the bellmouth 46 of a modification of the multi-blade fan 100L according to Embodiment 4. In the following description, the modifications of the multi-blade fans 100J, 100K, and 100L may be abbreviated as "modifications of the multi-blade fan 100K, etc." Furthermore, the modifications of the impellers 10J, 10K, and 10L may be referred to as "modification of the impeller 10J, etc."

The modifications of the multi-blade fan 100J, etc. each include a plurality of blades 12. Moreover, the blades 12 have respective turbo blade portions and sirocco blade portion that are formed such that at the end portions 12*u* closer to the side plate 13, the ratio of the blade inside diameter of the blades 12 that is the diameter of a circle drawn through the inner circumferential ends of the blades 12 to the blade outside diameter of the blades that is the diameter of a circle drawn through the outer circumferential ends of the blades 12 is higher than or equal to 0.7.

The first turbo blade portion 12A2 of the modification of the multi-blade fan 100J, etc. is formed outward of the inner circumferential end portion 46*b* of the bellmouth 46 in the radial direction with respect to the rotation axis RS as viewed in the direction parallel to the axial direction of the rotation axis RS. The multi-blade fans 100J, 100K, and 100L are each configured such that each of the end portions 12*u* close to the side plate 13 in the axial direction of the rotation axis RS has the first sirocco blade portion 12A1 and the first turbo blade portion 12A2. The modification of the multi-blade fan 100J or other devices is configured such that at the end portions 12*u* closer to the side plate 13 in the axial direction of the rotation axis RS, the diameter of a circle drawn through the first turbo blade portions 12A2 corresponds to the inside diameter of the modification of the impeller 10J, etc.

As viewed in the direction parallel to the axial direction of the rotation axis RS, at each of the end portions 12*u* of each of the impellers 10J, 10K, and 10L, an outer circumferential end portion 12A22 of the first turbo blade portion 12A2 is provided outward of the inner circumferential end portion 46*b* of the bellmouth 46 in the radial direction. Moreover, as viewed in the direction parallel to the axial direction of the rotation axis RS, the boundary between the first sirocco blade portion 12A1 and the first turbo blade portion 12A2 as indicated by the dotted line BD is provided outward of the inner circumferential end portion 46*b* of the bellmouth 46 in the radial direction. That is, each of the multi-blade fans 100J, 100K, and 100L is formed such that an outside diameter of the first turbo blade portions 12A2 that is the diameter of a circle drawn through the outer circumferential end portions 12A22 of the first turbo blade portions 12A2 is larger than the inside diameter BI of the bellmouth 46 as illustrated in FIG. 14.

In the case where the modification of the multi-blade fan 100J or other devices includes second blades 12B, each of the second turbo blade portions 12B2 of the modification of the multi-blade fan 100J or other devices is provided outward of the inner circumferential end portion 46*b* of the bellmouth 46 in the radial direction with respect to the rotation axis RS as viewed in the direction parallel to the axial direction of the rotation axis RS (not illustrated). In this case, the modification of the multi-blade fan 100J or other devices is configured such that the end portions 12*u* closer to the side plate 13 in the axial direction of the rotation axis RS are formed by the first sirocco blade portions 12A1 and the first turbo blade portions 12A2 as well as the second sirocco blade portions 12B1 and the second turbo blade portions 12B2. In the case where the modification of the multi-blade fan 100J or other devices includes second blades 12B, the modification of the multi-blade fan 100J or other devices is configured such that at the end portions 12*u* closer to the side plate 13 in the axial direction of the rotation axis RS, the diameter of a circle drawn through the first turbo blade portions 12A2 and the second turbo blade portions 12B2 is the inside diameter of the modification of the impeller 10J or other impellers.

As viewed in the direction parallel to the axial direction of the rotation axis RS, at each of the end portions 12*u* of each of the impellers 10J, 10K, and 10L, an outer circumferential end portion 12A22 of the second turbo blade portion 12B2 is provided closer to the outer circumferential side than the inner circumferential end portion 46*b* of the bellmouth 46 in the radial direction. Moreover, as viewed in the direction parallel to the axial direction of the rotation axis RS, the boundary between the second sirocco blade portion 12B1 and the second turbo blade portion 12B2 as indicated by the dotted line BD is provided closer to the outer circumferential side than the inner circumferential end portion 46*b* of the bellmouth 46 in the radial direction. That is, each of the multi-blade fans 100J, 100K, and 100L is formed such that an outside diameter of the second turbo blade portions 12B2 that is the diameter of a circle drawn through the outer circumferential end portions 12A22 of the second turbo blade portions 12B2 is larger than the inside diameter BI of the bellmouth 46 as illustrated in FIG. 14.

[Advantages of Modifications of Impeller 10J, Multi-Blade Fan 100J, Etc.]

In the multi-blade fans 100J, 100K, and 100L, an outside diameter of turbo blade portions that is the diameter of a circle drawn through outer circumferential end portions of the turbo blade portions is larger than the inside diameter BI of the bellmouth 46 as illustrated in FIG. 14. Therefore, in the multi-blade fans 100J, 100K, and 100L, it is possible to further improve static pressure efficiency than a multi-blade fan that does not have such a configuration.

In addition, in the modifications of the impeller 10J, the multi-blade fan 100J, etc., it is possible to reduce an increase in velocity of an air current in the gap between the bellmouth 46 and each of the blades 12, and thus reduce noise that is generated by the air current that passes through the gap between the bellmouth 46 and the blade 12. In addition, in the impeller 10J and the multi-blade fan 100J, it is possible to reduce the resistance during suction and also reduce the generation of noise in the case where the motor 50 and the blade 12 are close to each other.

Furthermore, the blades 12 have turbo blade portions and sirocco blade portions that are formed such that at the end portions closer to the side plate 13, the ratio of a blade inside diameter of the blades 12 that is the diameter of a circle drawn through the inner circumferential ends of the blades 12 to a blade outside diameter of the blades 12 that is the diameter of a circle drawn through the outer circumferential ends of the blades 12 is higher than or equal to 0.7. By virtue of the sirocco blade portions and the turbo blade portions formed such that the ratio of the above inside diameter of the blades 12 to the above outside diameter of the blades 12 at the end portion 12*u* beside the side plate 13 is higher than or equal to 0.7, the modifications of the impeller 10J, the multi-blade fan 100J, etc. can widen the gap between the bellmouth 46 and each of the blades 12. Therefore, in the modifications of the impeller 10J, the multi-blade fan 100J, etc., it is possible to reduce an increase in velocity of an air current in the gap between the bellmouth 46 and the blade 12, and thus reduce noise that is generated by the air current that passes through the gap between the bellmouth 46 and the blade 12. Furthermore, by virtue of the above configuration, in the modifications of the impeller 10J, the multi-blade fan 100J, etc., it is possible to reduce the resistance during suction and reduce the generation of noise in the case where the motor 50 and the blade 12 are close to each other.

Embodiment 5

[Multi-Blade Fans 100M, 100N, and 100P]

Figure 35:
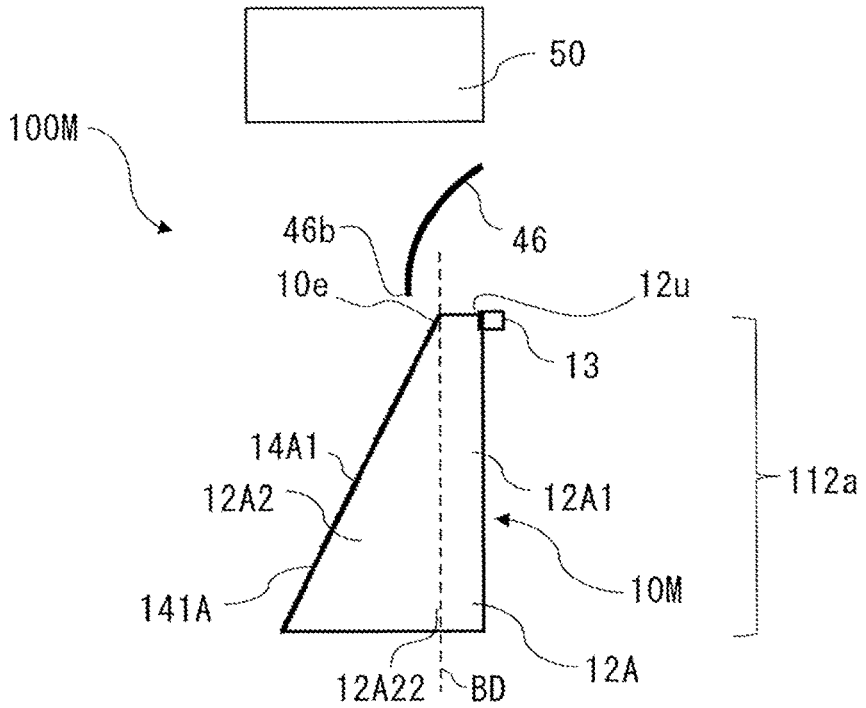
FIG. 35 is a first schematic view illustrating a relationship between an impeller and a bellmouth of a multi-blade fan according to Embodiment 5.
Figure 36:
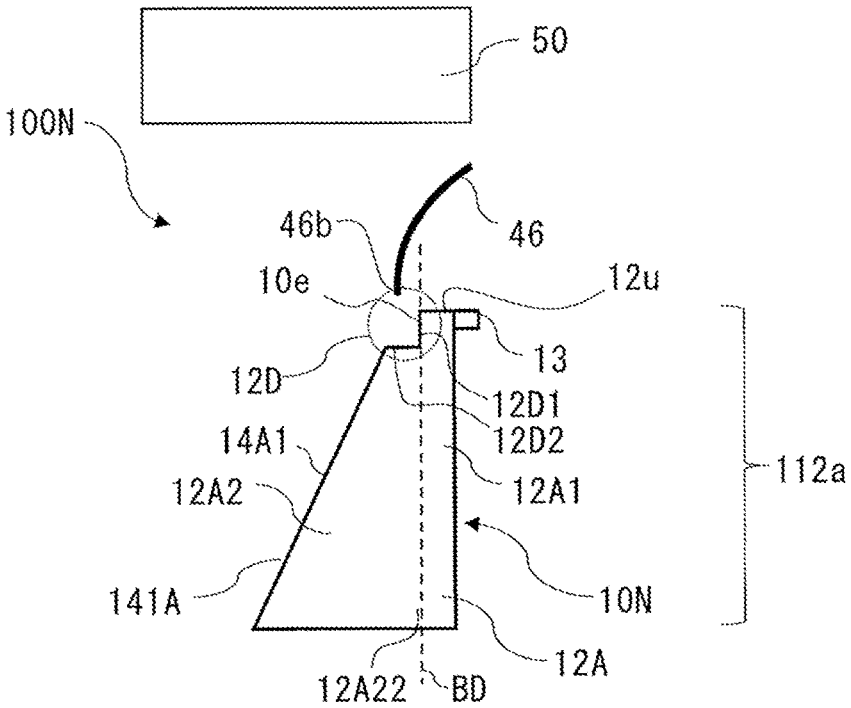
FIG. 36 is a second schematic view illustrating a relationship between an impeller and the bellmouth of the multi-blade fan according to Embodiment 5.
Figure 37:
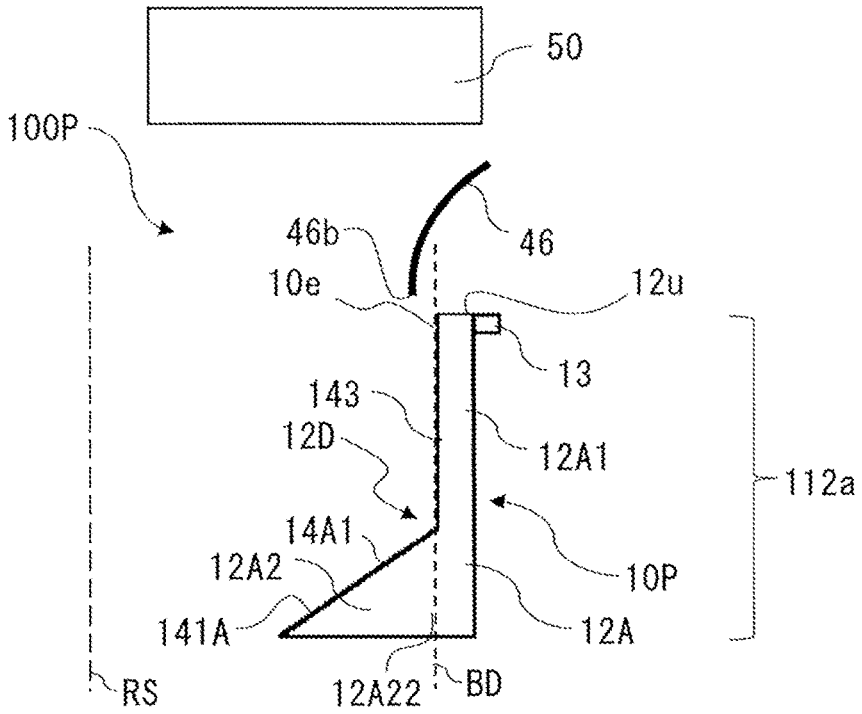
FIG. 37 is a third schematic view illustrating a relationship between an impeller and the bellmouth of a multi-blade fan according to Embodiment 5.

FIG. 35 is a first schematic view illustrating a relationship between an impeller 10M and the bellmouth 46 of a multi-blade fan 100M according to Embodiment 5. FIG. 36 is a second schematic view illustrating a relationship between an impeller 10N and the bellmouth 46 of a multi-blade fan 100N according to Embodiment 5. FIG. 37 is a third schematic view illustrating a relationship between an impeller 10P and the bellmouth 46 of a multi-blade fan 100P according to Embodiment 5. In the following description, the multi-blade fans 100M, 100N, and 100P may be referred to as "multi-blade fan 100M, etc." Furthermore, the impellers 10M, 10N, and 10P may be referred to as "impeller 10M, etc."

The multi-blade fans 100M, 100N, and 100P according to Embodiment 5 will be described with reference to FIGS. 35 to 37. It should be noted that components and portions that have the same configurations as those of the multi-blade fan 100, etc., as illustrated in FIGS. 1 to 34 are denoted by the same reference signs, and their descriptions will thus be omitted. Furthermore, each of the multi-blade fans 100M, 100N, and 100P includes a motor 50 as the multi-blade fan 100 as illustrated in FIG. 9. The following descriptions regarding the multi-blade fans 100M, 100N, and 100P according to Embodiment 5 further specify a positional relationship between the impeller 10 and the bellmouth 46, as compared with the multi-blade fans 100J, 100K, and 100L according to Embodiment 4.

Each of end portions 12*u* of each of the impeller 10M, 10N, and 10P that are closer to the side plate 13 has the first sirocco blade portion 12A1. The first sirocco blade portion 12A1 is formed such that the ratio of the above inside diameter of the first blades 12A to the outside diameter of the first blades 12A is higher than or equal to 0.7. That is, the multi-blade fan 100M, etc., are each configured such that portions of the blades 12 that are closer to the side plate 13 are formed as sirocco blade portions in which the ratio of the inside diameter of the blades 12 to the outside diameter of the blades 12 is higher than or equal to 0.7. By virtue of the first sirocco blade portions 12A1 formed such that the ratio of the inside diameter of the first blades 12A to the outside diameter of the first blades 12A in the regions closer to the side plate 13 is higher than or equal to 0.7, it is possible for the multi-blade fan 100M, etc., to widen in the radial direction, part of each of the first blades 12A that is close to the air inlet 10*e*.

In the case where the impellers 10M, 10N, and 10P include second blades 12B, end portions 12*u* of each of the impellers 10M, 10N, and 10P that are closer to the side plate 13 has the first sirocco blade portion 12A1 and the second sirocco blade portion 12B1. Moreover, the second sirocco blade portion 12B1 is formed such that the ratio of the inside diameter of the second blades 12B to the outside diameter of the second blades 12B is higher than or equal to 0.7. That is, the multi-blade fan 100M, etc., are each configured such that a region of each of the blades 12 that is closer to the side plate 13 is formed as a sirocco blade portion in which the ratio of the inside diameter of the blades 12 to the outside diameter of the blades 12 is higher than or equal to 0.7. By virtue of the first sirocco blade portion 12A1 and the second sirocco blade portion 12B1 that are formed such that the ratio of the inside diameter of the blades 12 to the outside diameter of the blades 12 in the regions closer to the side plate 13 is higher than or equal to 0.7, it is possible for the multi-blade fan 100M, etc., to widen in the radial direction, part of each of the second blades 12B that is close to the air inlet 10*e*.

At the end portions 12*u* of each of the impellers 10M, 10N, and 10P that are closer to the side plate 13, the first sirocco blade portions 12A1 are formed such that the inside diameter of the blades 12 is larger than the inside diameter BI of the bellmouth 46 as illustrated in FIG. 14. That is, the multi-blade fan 100M, etc., are each formed such that at the end portions 12*u* closer to the side plate 13, the inside diameter of the blades 12 is larger than the inside diameter BI of the bellmouth 46.

Moreover, as viewed in the direction parallel to the axial direction of the rotation axis RS, the boundary between the first sirocco blade portion 12A1 and the first turbo blade portion 12A2 as indicated by the dotted line BD is provided closer to the outer circumferential side than the inner circumferential end portion 46*b* of the bellmouth 46 in the radial direction. That is, each of the multi-blade fans 100M, 100N, and 100P is formed such that an outside diameter of the first turbo blade portions 12A2 that is the diameter of a circle drawn through the outer circumferential end portions 12A22 of the first turbo blade portions 12A2 is larger than the inside diameter BI of the bellmouth 46 as illustrated in FIG. 14.

In the case where the impellers 10M, 10N, and 10P include second blades 12B, the second sirocco blade portions 12B1 at the end portions 12*u* of each of the impellers 10M, 10N, and 10P that are closer to the side plate 13 are formed such that the above inside diameter of the blades 12 is larger than the inside diameter BI of the bellmouth 46 as illustrated in FIG. 14. That is, the multi-blade fan 100M, etc., are each formed such that at the end portions 12*u* closer to the side plate 13, the inside diameter of the blades 12 is larger than the inside diameter BI of the bellmouth 46.

As viewed in the direction parallel to the axial direction of the rotation axis RS, the boundary between the second sirocco blade portion 12B1 and the second turbo blade portion 12B2 as indicated by the dotted line BD is provided closer to the outer circumferential side than the inner circumferential end portion 46*b* of the bellmouth 46 in the radial direction. That is, in each of the multi-blade fans 100M, 100N and 100P, an outside diameter of the second turbo blade portions 12B2 that is the diameter of a circle drawn through the outer circumferential end portions 12A22 of the second turbo blade portions 12B2 is larger than the inside diameter BI of the bellmouth 46 as illustrated in FIG. 14.

[Advantages of Impeller 10M, Multi-Blade Fan 100M, Etc.]

Each of the multi-blade fans 100M, 100N and 100P is formed such that at the end portions 12*u* closer to the side plate 13, the inside diameters of the blades 12 at the sirocco blade portions is larger than the inside diameter BI of the bellmouth 46. Thus, in the multi-blade fans 100M, etc., it is possible to widen the gap between the bellmouth 46 and each of the blades 12. As a result, in the impeller 10M, the multi-blade fan 100M, etc., it is possible to reduce an increase in velocity of an air current in the gap between the bellmouth 46 and the blade 12, and thus reduce noise that is generated by the air current passing through the gap between the bellmouth 46 and the blade 12. Furthermore, in the impeller 10M, the multi-blade fan 100M, etc., it is possible to reduce the resistance during suction and reduce the generation of noise in the case where the motor 50 and the blade 12 are close to each other.

Furthermore, in the impeller 10N, the multi-blade fan 100N, etc., step portions 12D are formed at end portions 12*u* of the turbo blade portions that are closer to the side plate 13. Because of provision of the step portions 12D, in the impeller 10N, the multi-blade fan 100N, etc., it is possible to widen the gap between the bellmouth 46 and a blade 12. Therefore, in the impeller 10N, the multi-blade fan 100N, etc., it is possible to reduce an increase in velocity of an air current in the gap between the bellmouth 46 and the blade 12, and thus reduce noise that is generated by the air current that passes through the gap between the bellmouth 46 and the blade 12.

In the impeller 10P of the multi-blade fan 100P, step portions 12D are each formed by a linear portion 143 and an inclined portion 141A. In the impeller 10P and the multi-blade fan 100P, since each of the first blades 12A has an inclined portion 141A and a linear portion 143, it is possible to reduce the areas of the first blades 12A and reduce the resistance against sucked air.

[Modifications of Multi-Blade Fans 100M, 100N, and 100P, Etc.]

Figure 38:
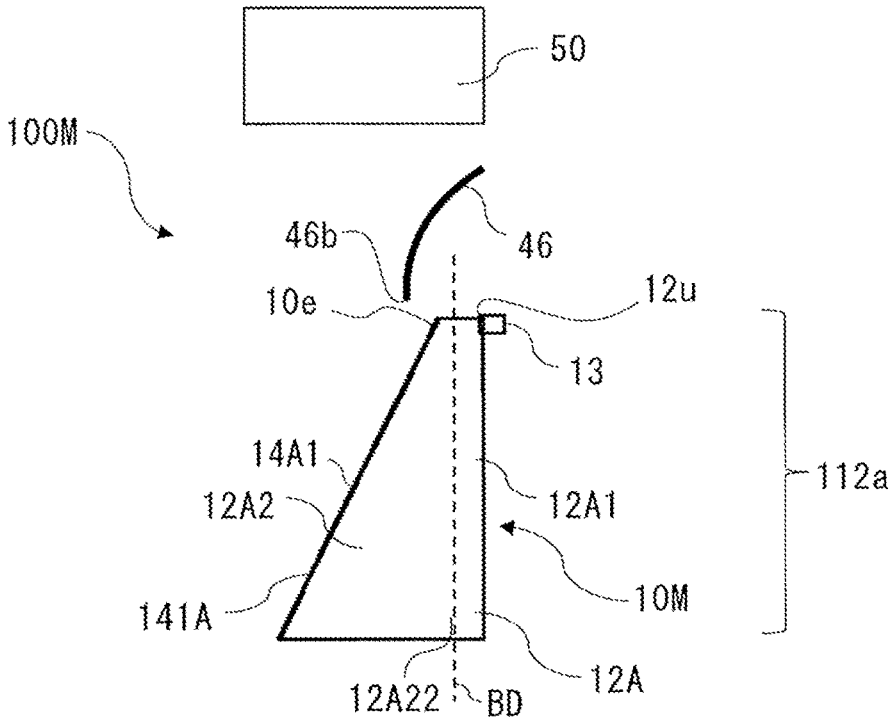
FIG. 38 is a first schematic view illustrating a relationship between an impeller and a bellmouth of a modification of the multi-blade fan according to Embodiment 5.
Figure 39:
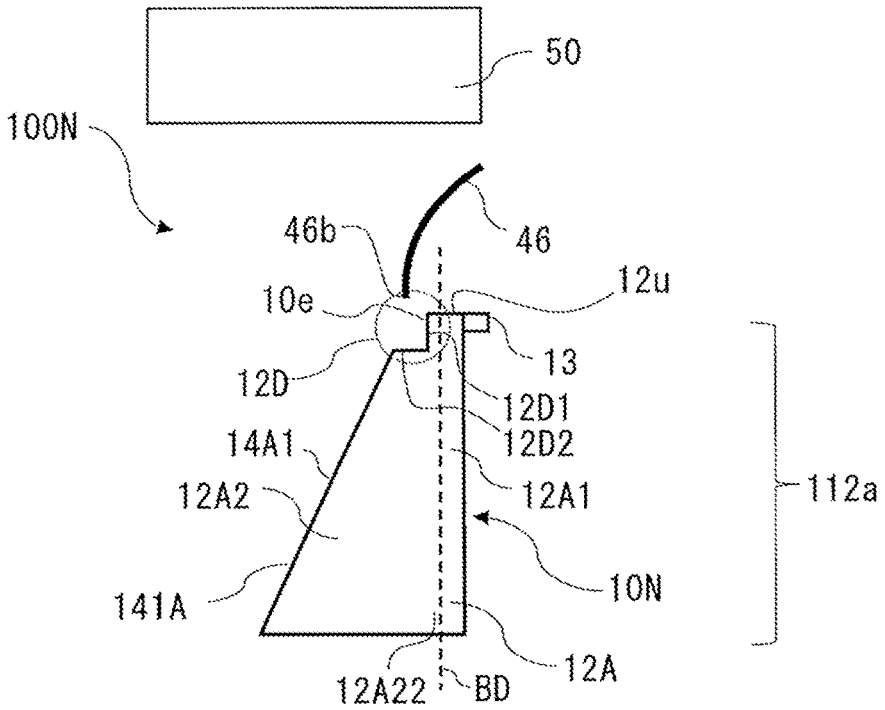
FIG. 39 is a second schematic view illustrating a relationship between an impeller and the bellmouth of the modification of the multi-blade fan according to Embodiment 5.
Figure 40:
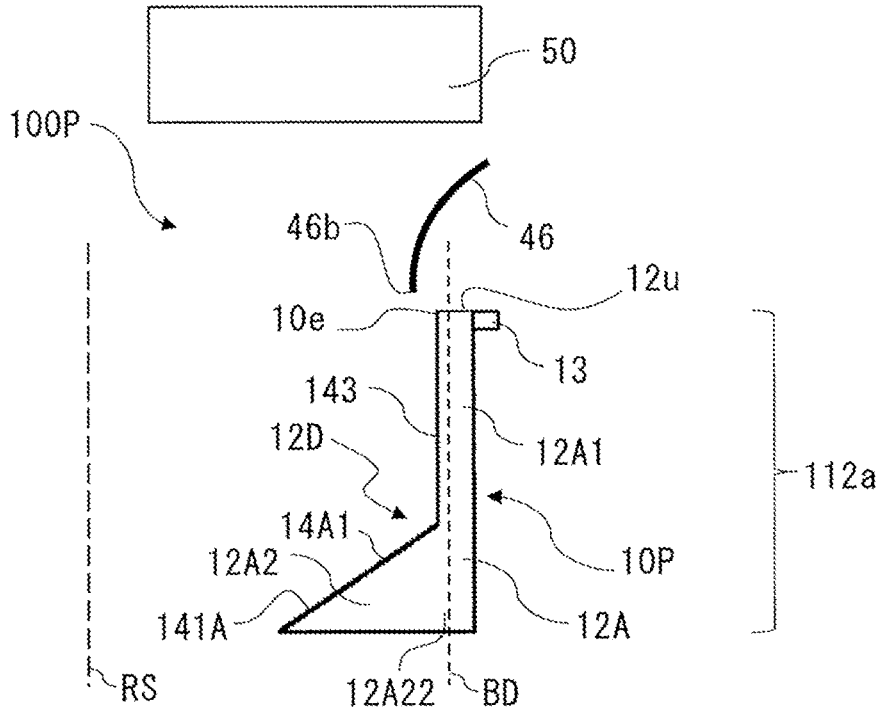
FIG. 40 is a third schematic view illustrating a relationship between an impeller and the bellmouth of the modification of the multi-blade fan according to Embodiment 5.

FIG. 38 is a first schematic view illustrating a relationship between an impeller 10M and the bellmouth 46 of a modification of the multi-blade fan 100M according to Embodiment 5. FIG. 39 is a second schematic view illustrating a relationship between an impeller 10N and the bellmouth 46 of a modification of the multi-blade fan 100N according to Embodiment 5. FIG. 40 is a third schematic view illustrating a relationship between an impeller 10P and the bellmouth 46 of a modification of the multi-blade fan 100P according to Embodiment 5. In the following description, the modifications of the multi-blade fan 100M, 100N, and 100P may be referred to as "modification of the multi-blade fan 100M, etc." Furthermore, the modifications of the impellers 10M, 10N, and 10P may be abbreviated as "modification of the impeller 10M, etc."

The modification of the multi-blade fan 100M, etc., includes a plurality of blades 12. The blades 12 have turbo blade portions and sirocco blade portions formed such that at end portions close to the side plate 13, the ratio of a blade inside diameter of the blades 12 that is the diameter of a circle drawn through the inner circumferential ends of the blades 12 to a blade outside diameter of the blades 12 that is the diameter of a circle drawn through the outer circumferential ends of the blades 12 is higher than or equal to 0.7.

The first turbo blade portions 12A2 of each of the multi-blade fans 100M, 100N, and 100P are provided outward of the inner circumferential end portion 46*b* of the bellmouth 46 in the radial direction with respect to the rotation axis RS as viewed in the direction parallel to the axial direction of the rotation axis RS. In the multi-blade fans 100M, 100N, and 100P, each of end portions 12*u* close to the side plate 13 in the axial direction of the rotation axis RS is formed by a first sirocco blade portion 12A1 and a first turbo blade portion 12A2. In each of the multi-blade fan 100M, 100N, and 100P, at the end portions 12*u* closer to the side plate 13 in the axial direction of the rotation axis RS, the diameter of a circle drawn through the first turbo blade portions 12A2 is the inside diameter of an associated one of the impellers 10M, 10N, and 10P.

As viewed in the direction parallel to the axial direction of the rotation axis RS, at each of the end portions 12*u* of each of the impellers 10M, 10N, and 10P, an outer circumferential end portion 12A22 of the first turbo blade portion 12A2 is provided closer to the outer circumferential side than the inner circumferential end portion 46*b* of the bellmouth 46 in the radial direction. Moreover, as viewed in the direction parallel to the axial direction of the rotation axis RS, the boundary between the first sirocco blade portion 12A1 and the first turbo blade portion 12A2 as indicated by the dotted line BD is located closer to the outer circumferential side than the inner circumferential end portion 46*b* of the bellmouth 46 in the radial direction. That is, in the multi-blade fans 100M, 100N, and 100P, an outside diameter of the first turbo blade portions 12A2 that is the diameter of a circle drawn through the outer circumferential end portions 12A22 of the first turbo blade portions 12A2 is larger than the inside diameter BI of the bellmouth 46 as illustrated in FIG. 14.

In the case where the multi-blade fan 100M, etc., include second blades 12B, the second turbo blade portions 12B2 are each located outward of the inner circumferential end portion 46*b* of the bellmouth 46 in the radial direction as viewed in the direction parallel to the axial direction of the rotation axis RS. In the multi-blade fan 100M, etc., each of end portions 12*u* closer to the side plate 13 in the axial direction of the rotation axis RS is formed by a first sirocco blade portion 12A1 and a first turbo blade portion 12A2 as well as a second sirocco blade portion 12B1 and a second turbo blade portion 12B2. In the case where the multi-blade fan s100M, etc., include second blades 12B, in the multi-blade fan 100M, etc., at the end portions 12*u* closer to the side plate 13 in the axial direction of the rotation axis RS, the diameter at the first turbo blade portions 12A2 and the second turbo blade portions 12B2 is the inside diameter of an associated one of the impellers 10M, 10N, and 10P.

As viewed in the direction parallel to the axial direction of the rotation axis RS, at each of the end portions 12*u* of each of the impellers 10M, 10N, and 10P, an outer circumferential end portion 12A22 of the second turbo blade portion 12B2 is located closer to the outer circumferential side than the inner circumferential end portion 46*b* of the bellmouth 46 in the radial direction. Moreover, as viewed in the direction parallel to the axial direction of the rotation axis RS, the boundary between the second sirocco blade portion 12B1 and the second turbo blade portion 12B2 as indicated by the dotted line BD is located closer to the outer circumferential side than the inner circumferential end portion 46*b* of the bellmouth 46 in the radial direction. That is, in each of the multi-blade fans 100M, 100N, and 100P, an outside diameter of the second turbo blade portions 1B2 that is the diameter of a circle drawn through the outer circumferential end portions 12A22 of the second turbo blade portions 12B2 is larger than the inside diameter BI of the bellmouth 46 as illustrated in FIG. 14.

The first turbo blade portion 12A2 at each of the end portions 12*u* of each of the impellers 10M, 10N, and 10P that are closer to the side plate 13 is formed such that the inside diameter of the blades 12 is larger than the inside diameter BI of the bellmouth 46 illustrated in FIG. 14. That is, in the multi-blade fan 100M, etc., at each of the end portions 12*u* closer to the side plate 13, the inside diameter of the blades 12 is larger than the inside diameter BI of the bellmouth 46.

In each of the impellers 10M, 10N, and 10P, in the case where second blades 12B are provided, the second turbo blade portions 12B2 at the end portions 12*u* closer to the side plate 13 are formed such that the inside diameter of the blades 12 is larger than the inside diameter BI of the bellmouth 46 as illustrated in FIG. 14. That is, in the modifications of the multi-blade fan 100M, etc., at the end portions 12*u* closer to the side plate 13, the inside diameter of the blades 12 is larger than the inside diameter BI of the bellmouth 46.

[Advantages of Modifications of Impeller 10M, Multi-Blade Fan 100M, Etc.]

Each of the multi-blade fan 100M, 100N, and 100P is formed such that an outside diameter of the first turbo blade portions 12A2 that is the diameter of a circle drawn through the outer circumferential end portions 12A22 of the first turbo blade portions 12A2 is larger than the inside diameter BI of the bellmouth 46 as illustrated in FIG. 14. Therefore, the multi-blade fans 100M, 100N, and 100P can further improve the static pressure efficiency than a multi-blade fan that does not have the above configuration.

Furthermore, in the modifications of the impeller 10M, the multi-blade fan 100M, etc., it is possible to reduce an increase in velocity of an air current in the gap between the bellmouth 46 and the blade 12, and thus reduce noise that is generated by the air current passing through the gap between the bellmouth 46 and the blade 12. Also, in the impeller 10M and the multi-blade fan 100M, it is possible to reduce the resistance during suction and also reduce the generation of noise in the case where the motor 50 and the blade 12 are close to each other.

Furthermore, in each of the multi-blade fans 100M, 100N and 100P of the modifications, at the end portions 12*u* closer to the side plate 13, the inside diameter of the blades 12 at the turbo blade portions is larger than the inside diameter BI of the bellmouth 46. Thus, in the multi-blade fans 100M, etc., It is possible to widen the gap between the bellmouth 46 and each of the blades 12. As a result, in the modifications of the impeller 10M, the multi-blade fan 100M, etc., it is possible to reduce an increase in velocity of an air current in the gap between the bellmouth 46 and the blade 12, and thus reduce noise that is generated by the air current passing through the gap between the bellmouth 46 and the blade 12. In addition, in the impeller 10M, the multi-blade fan 100M, etc., it is possible to reduce the resistance during suction and reduce the generation of noise in the case where the motor 50 and the blade 12 are close to each other.

Moreover, the blades 12 have turbo blade portions and sirocco blade portions formed such that at end portions closer to the side plate 13, the ratio of a blade inside diameter of the blades 12 that is the diameter of a circle drawn through the inner circumferential ends of the blades 12 to a blade outside diameter of the blades 12 that is the diameter of a circle drawn through the outer circumferential ends of the blades 12 is higher than or equal to 0.7. By virtue of the sirocco blade portions and the turbo blade portions formed such that at the end portions 12*u* closer to the side plate 13, the ratio of the above inside diameter of the blades 12 to the above outside diameter of the blades 12 is higher than or equal to 0.7, in the modifications of the impeller 10M, the multi-blade fan 100M, etc., it is possible to widen the gap between the bellmouth 46 and each of the blades 12. Furthermore, in the modifications of the impeller 10M, the multi-blade fan 100M, etc., it is possible to reduce an increase in velocity of an air current in the gap between the bellmouth 46 and the blade 12, and thus reduce noise that is generated by the air current passing through the gap between the bellmouth 46 and the blade 12. Furthermore, by virtue of the above configuration, in the modifications of the impeller 10M, the multi-blade fan 100M, etc., it is possible to reduce the resistance during suction and reduce the generation of noise in the case where the motor 50 and the blade 12 are close to each other.

Furthermore, in the modifications of the impeller 10N, the multi-blade fan 100N, etc., step portions 12D are formed at end portions 12*u* of turbo blade portion beside the side plate 13. Because of formation of the step portions 12D, in the impeller 10N, the multi-blade fan 100N, etc., it is possible to widen the gap between the bellmouth 46 and each of the blades 12. Therefore, in the impeller 10N, the multi-blade fan 100N, etc., it is possible to reduce an increase in velocity of an air current in the gap between the bellmouth 46 and the blade 12, and thus reduce noise that is generated by the air current passing through the gap between the bellmouth 46 and the blade 12.

Embodiment 6

[Multi-Blade Fan 100G]

Figure 41:
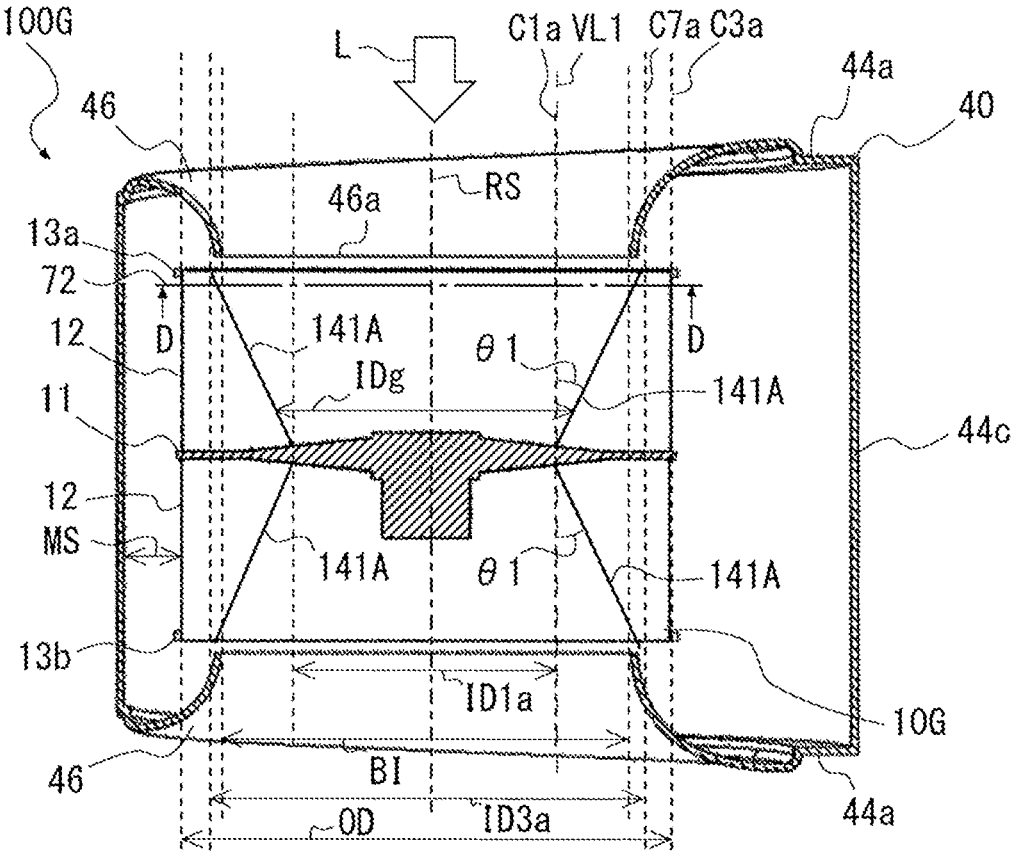
FIG. 41 is a sectional view schematically illustrating a multi-blade fan according to Embodiment 6.
Figure 42:
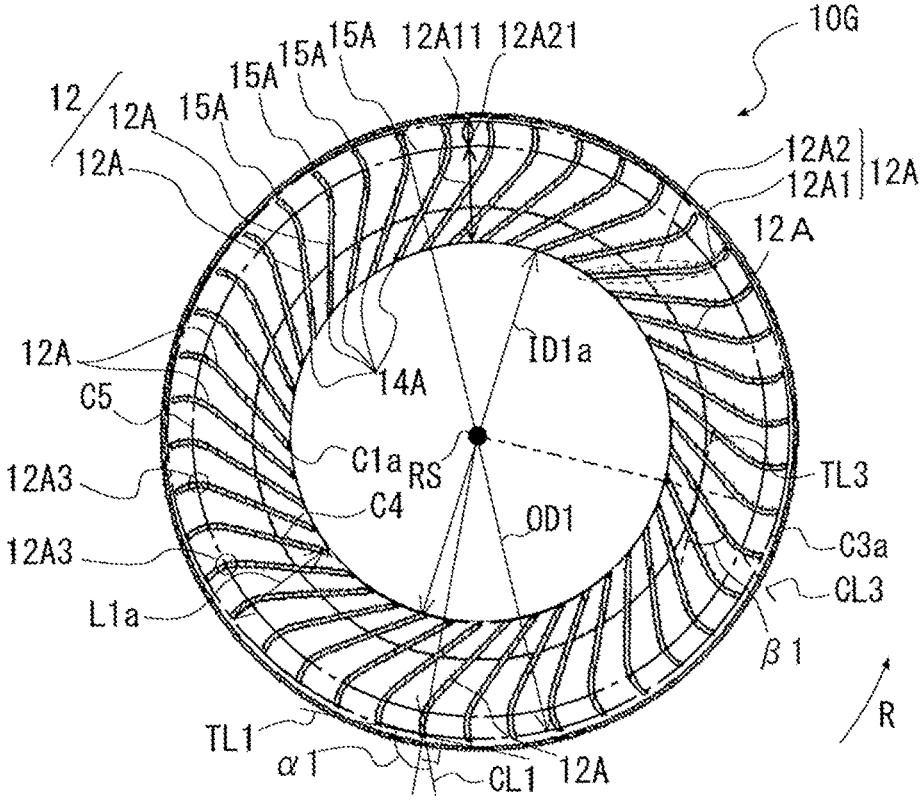
FIG. 42 is a schematic view of blades as viewed in the direction parallel to a rotation axis in the impeller as illustrated in FIG. 41.
Figure 43:
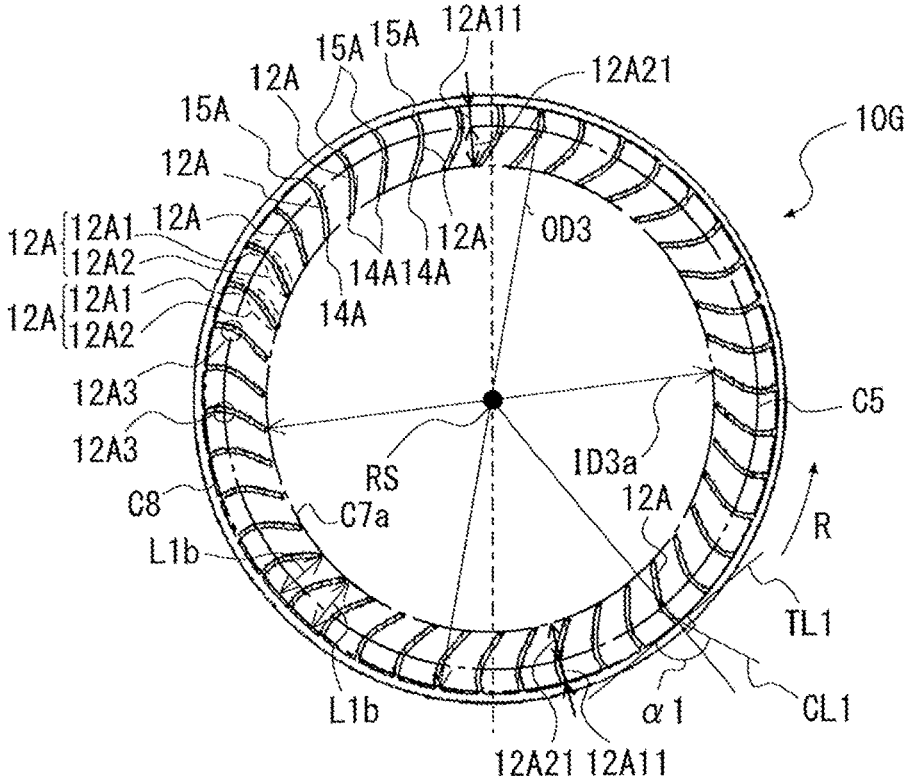
FIG. 43 is a schematic view of the blades in a section of the impeller that is taken along line D-D in FIG. 41.

FIG. 41 is a sectional view schematically illustrating a multi-blade fan 100G according to Embodiment 6. FIG. 42 is a schematic view illustrating blades 12 as viewed in a direction parallel to a rotation axis RS in an impeller 10G as illustrated in FIG. 41. FIG. 43 is a schematic view illustrating the blades 12 in a section of the impeller 10G that is taken along line D-D in FIG. 41. The multi-blade fan 100G according to Embodiment 6 will be described with reference to FIGS. 41 to 43. It should be noted that components and portions that the same configurations as those of the multi-blade fan 100, etc., as illustrated in FIGS. 1 to 40 will be denoted by the same reference signs, and their descriptions will thus be omitted.

As illustrated in FIGS. 41 to 43, in the impeller 10G of the multi-blade fan 100G according to Embodiment 6, all the blades 12 are first blades 12A. As illustrated in FIGS. 41 to 43, in the impeller 10G, forty-two first blades 12A are provided. However, the number of first blades 12A is not limited to 42; that is, it may be smaller or larger than 42.

Each of the first blades 12A satisfies the relationship "blade length L1*a*>blade length Lib". To be more specific, in each of the first blades 12A, the blade length decreases from the main plate 11 toward the side plate 13 in the axial direction of the rotation axis RS. In addition, as illustrated in FIG. 41, each of the first blades 12A is inclined such that a blade inside diameter IDg increases from the main plate 11 toward the side plate 13. To be more specific, the blades 12 have inclined portions 141A that are inclined such that in the direction from the main plate 11 toward the side plate 13, the distance between the inner circumferential ends 14A forming the leading edges 14A1 and the rotation axis RS gradually increases and the inside diameter IDg increases.

Each of the first blades 12A has a first sirocco blade portion 12A1 that is formed as a forward-swept blade portion and a first turbo blade portion 12A2 that is formed as a swept-back blade portion. Each of the first blades 12A is configured such that the first turbo region 12A21 is larger than the first sirocco region 12A11 in the radial direction of the impeller 10. The impeller 10 and each of the first blades 12A are configured such that in both the main-plate-side blade region 122*a* serving as the first region and the side-plate-side blade region 122*b* serving as the second region, in the radial direction of the impeller 10, the ratio of the first turbo blade portion 12A2 to the first sirocco blade portion 12A1 is higher than the ratio of the first sirocco blade portion 12A1 to the first turbo blade portion 12A2.

Where an inter-blade distance is the distance between any adjacent two of the blades 12 in the circumferential direction, the inter-blade distance increases from the leading edges 14A1 toward the trailing edges 15A1 as illustrated in FIGS. 42 and 43. Specifically, the inter-blade distance at the first turbo blade portions 12A2 increases from the inner circumferential side toward the outer circumferential side. In addition, the inter-blade distance at first sirocco blade portions 12A1 is greater than the inter-blade distance at first turbo blade portions 12A2 and increases the inner circumferential side toward the outer circumferential side.

As illustrated in FIG. 41, the inside diameter BI of the bellmouth 46 is larger than the inside diameter ID1*a* of portions of the first blades 12A that are closer to the main plate 11 and smaller than the inside diameter ID3*a* of portions of the first blades 12A that are closer to the side plate 13. That is, the inside diameter BI of the bellmouth 46 is larger than the blade inside diameter IDg of the portions of the blades 12 that are closer to the main plate 11 and smaller than the blade inside diameter IDg of the portions of the blades 12 that are closer to the side plate 13.

[Advantages of Impeller 10G and Multi-Blade Fan 100G]

The impeller 10G and the multi-blade fan 100G can obtain advantages similar to those of the multi-blade fan 100 and the impeller 10 according to Embodiment 1. For example, the impeller 10G and the multi-blade fan 100G are configured such that in any region between the main plate 11 and the side plate 13, in the radial direction of the main plate 11, the ratio of the first turbo blade portion 12A2 to the first sirocco blade portion 12A1 is higher than the ratio of the first sirocco blade portion 12A1 to the first turbo blade portion 12A2. In the impeller 10G and the multi-blade fan 100G, since the ratio of the turbo blade portion is high in any region between the main plate 11 and the side plate 13, sufficient pressure recovery can be achieved by the blades 12. Therefore, the impeller 10G and the multi-blade fan 100G can further improve the pressure recovery than an impeller or a multi-blade fan that does not have the above configuration. As a result, the impeller 10G can improve the efficiency of the multi-blade fan 100G. Furthermore, by virtue of the above configuration, the impeller 10G can reduce separation of an air current at the leading edge in a region closer to the side plate 13.

Embodiments 1 to 6 are described above by referring to by way of example a multi-blade fan 100 including a double-suction impeller 10 provided with a plurality of blades 12 formed on both sides of a main plate 11. However, Embodiments 1 to 6 are also applicable to a multi-blade fan 100 including a single-suction impeller 10 having a plurality of blades 12 formed only on one side of a main plate 11.

Embodiment 7

[Air-Conditioning Apparatus 140]

Figure 44:
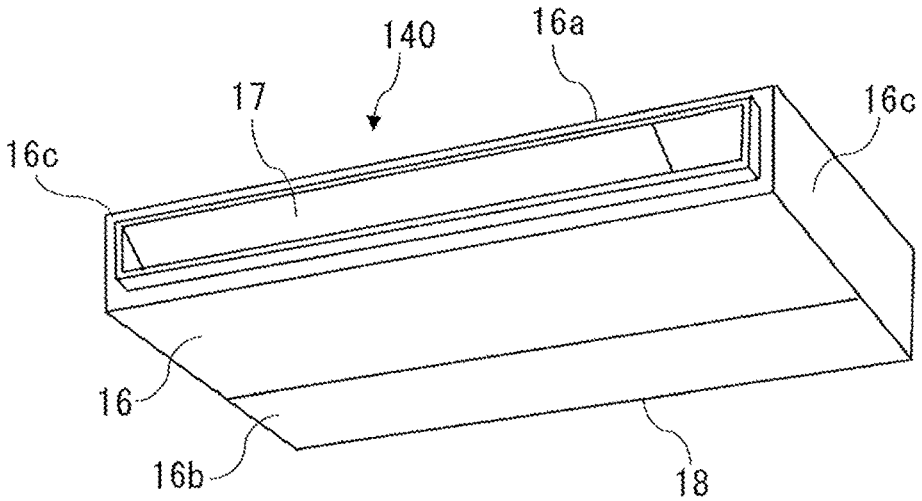
FIG. 44 is a perspective view of an air-conditioning apparatus according to Embodiment 7.
Figure 45:
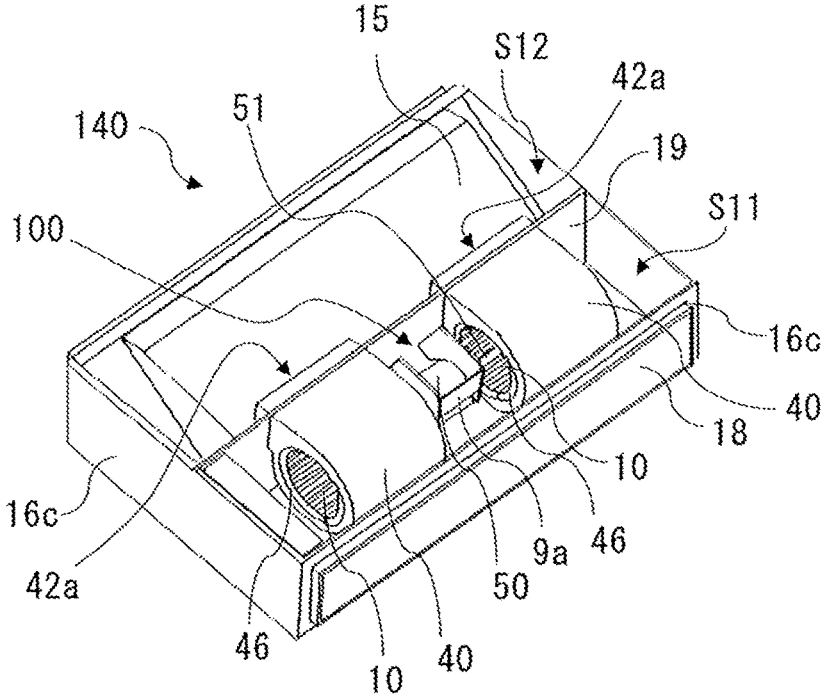
FIG. 45 is a diagram illustrating an internal configuration of the air-conditioning apparatus according to Embodiment 7.

FIG. 44 is a perspective view of an air-conditioning apparatus 140 according to Embodiment 7. FIG. 45 is a diagram illustrating an internal configuration of the air-conditioning apparatus 140 according to Embodiment 7. Regarding a multi-blade fan 100 used in the air-conditioning apparatus 140 according to Embodiment 7, components and portions that have the same configurations as those of the multi-blade fan 100, etc., as illustrated in FIGS. 1 to 43 will be denoted by the same reference signs, and their descriptions will thus be omitted. In order to illustrate the internal configuration of the air-conditioning apparatus 140, FIG. 45 omits illustration of an upper surface portion 16*a*.

The air-conditioning apparatus 140 according to Embodiment 7 includes any one or more of the multi-blade fans 100, etc., according to Embodiments 1 to 6 and a heat exchanger 15 provided to face a discharge port 42*a* of the multi-blade fan 100. Furthermore, the air-conditioning apparatus 140 according to Embodiment 7 includes a case 16 installed above a ceiling of a room to be air-conditioned. In the following description, the term "multi-blade fan 100" means any one of the multi-blade fans 100, etc., according to Embodiments 1 to 6. Furthermore, although FIGS. 44 and 45 illustrate a multi-blade fan 100 that includes a scroll casing 40 in the case 16, impellers 10 to 10G, etc., including no scroll casing 40 may be installed in the case 16.

(Case 16)

As illustrated in FIG. 44, the case 16 is formed in the shape of a cuboid an upper surface portion 16*a*, a lower surface portion 16*b*, and side surface portions 16*c*. The shape of the case 16 is not limited to the cuboid shape, and may be another shape such as a columnar shape, a prismatic shape, a conical shape, a shape having a plurality of corner portions, or a shape having a plurality of curved surface portions. One of the side surface portions 16*c* of the case 16 is a side surface portion 16*c* having a case discharge port 17 formed therein. The case discharge port 17 is formed in a rectangular shape as illustrated in FIG. 44. The shape of the case discharge port 17 is not limited to the rectangular shape, and may be another shape such as a circular shape or an oval shape. Another one of the side surface portions 16*c* of the case 16 is a side surface portion 16*c* that has a case air inlet 18 formed therein and that is located opposite to the side surface portion 16*c* having the case discharge port 17. The case air inlet 18 is formed in a rectangular shape as illustrated in FIG. 45. The shape of the case air inlet 18 is not limited to the rectangular shape, and may be another shape such as a circular shape or an oval shape. A filter configured to remove dust in the air may be provided at the case air inlet 18.

In the case 16, the multi-blade fan 100 and the heat exchanger 15 are housed. The multi-blade fan 100 includes an impeller 10, a scroll casing 40 having a bellmouth 46 formed therein, and a motor 50. The motor 50 is supported by a motor support 9*a* fixed to the upper surface portion 16*a* of the case 16. The motor 50 has a motor shaft 51. The motor shaft 51 is provided to extend parallel to the side surface portion 16*c* having the case air inlet 18 and the side surface portion 16*c* having the case discharge port 17. As illustrated in FIG. 45, the air-conditioning apparatus 140 has two impellers 10 attached to the motor shaft 51. The impellers 10 of the multi-blade fan 100 produces a flow of air that is sucked into the case 16 through the case air inlet 18 and blown into an air-conditioned space through the case discharge port 17. The number of impellers 10 that are provided in the case 16 is not limited to 2; that is, it may be 1 or larger than or equal to 3.

As illustrated in FIG. 45, the multi-blade fan 100 is attached to a partition plate 19 the partitions an internal space of the case 16 into a space S11 located on a suction side of the scroll casing 40 and a space S12 located on a blowing side of the scroll casing 40.

The heat exchanger 15 is provided in such a manner as to face the discharge port 42*a* of the multi-blade fan 100, and is provided in the case 16 and on an air passage for air to be discharged by the multi-blade fan 100. The heat exchanger 15 adjusts the temperature of air that is sucked into the case 16 through the case air inlet 18 and blown into the air-conditioned space through the case discharge port 17. As the heat exchanger 15, a heat exchanger having a well-known configuration can be applied. Regarding the location of the case air inlet 18, it suffices that the case air inlet 18 is provided at a location perpendicular to the axial direction of the rotation axis RS of the multi-blade fan 100. For example, the case air inlet 18 may be formed in the lower surface portion 16*b*.

When the impeller 10 of the multi-blade fan 100 is rotated, air in the air-conditioned space is sucked into the case 16 through the case air inlet 18. The air sucked into the case 16 is guided toward the bellmouth 46 and sucked into the impeller 10. The air sucked into the impeller 10 is blown outward in the radial direction of the impeller 10. After passing through the inside of the scroll casing 40, the air blown from the impeller 10*b* is blown from the scroll casing 40 through the discharge port 42*a*, and then supplied to the heat exchanger 15. When passing through the heat exchanger 15, the air supplied to the heat exchanger 15 exchanges heat with refrigerant that flows in the heat exchanger 15, and is thus controlled in temperature and humidity. The air that has passed through the heat exchanger 15 is blown to the air-conditioned space through the case discharge port 17.

The air-conditioning apparatus 140 according to Embodiment 7 includes any one of the multi-blade fans 100, etc., according to Embodiments 1 to 6. Therefore, the air-conditioning apparatus 140 can obtain advantages similar to those of any of Embodiments 1 to 6.

Each of Embodiment 1 to 7 can be put to practical use in combination with any of the others. Furthermore, the configurations described above regarding the embodiments are examples and may be each combined with another well-known technique, and part of the configurations can be omitted or changed without departing from the gist of the present disclosure. For example, regarding embodiments, the impeller 10, etc., that includes the main-plate-side blade region 122*a* serving as the first region and the side-plate-side blade region 122*b* serving as the second region is described above. The impeller 10 is not limited to the impeller including the first region and the second region solely. The impeller 10 may further have another region as well as the first region and the second region. For example, regarding in Embodiment 1, although each of the blades are shaped such that the blade length continuously changes from the main plate 11 toward the side plate 13, each of the blades may have, in some part between the main plate 11 and the side plate 13, a portion in which the blade length is constant, that is, a portion in which the inside diameter ID is constant and which is not inclined with respect to the rotation axis RS.

REFERENCE SIGNS LIST

9*a*: motor support, 10: impeller, 10A: impeller, 10C: impeller, 10D: impeller, 10E: impeller, 10F: impeller, 10G: impeller, 10H: impeller, 10J: impeller, 10K: impeller, 10L: impeller, 10M: impeller, 10N: impeller, 10P: impeller, 10*e*: air inlet, 11: main plate, 11*b*: shaft portion, 12: blade, 12A: first blade, 12A1: first sirocco blade portion, 12A11: first sirocco region, 12A2: first turbo blade portion, 12A21: first turbo region, 12A21*a*: first turbo region, 12A22: outer circumferential end portion, 12A2*a*: first turbo blade portion, 12A3: first radial blade portion, 12B: second blade, 12B1: second sirocco blade portion, 12B11: second sirocco region, 12B2: second turbo blade portion, 12B21: second turbo region, 12B21*a*: second turbo region, 12B2*a*: second turbo blade portion, 12B3: second radial blade portion, 12D: step portion, 12D1: side edge portion, 12D2: upper edge portion, 12R: outer circumferential region, 12*t*: end portion, 12*u*: end portion, 13: side plate, 13*a*: first side plate, 13*b*: second side plate, 14A: inner circumferential end, 14A1: leading edge, 14B: inner circumferential end, 14B1: leading edge, 14H: leading edge, 15: heat exchanger, 15A: outer circumferential end, 15A1: trailing edge, 15B: outer circumferential end, 15B1: trailing edge, 16: case, 16*a*: upper surface portion, 16*b*: lower surface portion, 16*c*: side surface portion, 17: case discharge port, 18: case air inlet, 19: partition plate, 40: scroll casing, 41: scroll portion, 41*a*: scroll start portion, 41*b*: scroll end portion, 42: discharge portion, 42*a*: discharge port, 42*b*: extension plate, 42*c*: diffuser plate, 42*d*: first side plate portion, 42*e*: second side plate portion, 43: tongue portion, 44*a*: side wall, 44*a*1: first side wall, 44*a*2: second side wall, 44*c*: peripheral wall, 45: suction port, 45*a*: first suction port 45*b*: second air inlet, 46: bellmouth, 46*a*: opening, 46*b*: inner circumferential end portion, 50: motor, 50A: motor, 50B: motor, 50*a*: end portion, 51: motor shaft, 52: outer peripheral wall, 52*a*: outer peripheral wall, 52*b*: outer peripheral wall, 71: first plane, 72: second plane, 100: multi-blade fan, 100A: multi-blade fan, 100B: multi-blade fan, 100C: multi-blade fan, 100D: multi-blade fan, 100E: multi-blade fan, 100F: multi-blade fan, 100G: multi-blade fan, 100H: multi-blade fan, 100J: multi-blade fan, 100K: multi-blade fan, 100L: multi-blade fan, 100M: multi-blade fan, 100N: multi-blade fan, 100P: multi-blade fan, 112*a*: first blade portion, 112*b*: second blade portion, 122*a*: main-plate-side blade region, 122*b*: side-plate-side blade region, 140: air-conditioning apparatus, 141A: inclined portion, 141A2: inclined portion, 141B: inclined portion, 141B2: inclined portion, 141C1: linear portion, 141C2: linear portion, 142: blade inclined region, 143: linear portion

The invention claimed is:

1. An impeller comprising:

a main plate configured to be driven to rotate;

an annular side plate provided opposite to the main plate; and a plurality of blades connected to the main plate and the side plate and arranged in a circumferential direction with respect to a rotation axis of the main plate, wherein each of the plurality of blades has an inner circumferential end located closer to the rotation axis in a radial direction from the rotation axis, an outer circumferential end located closer to an outer circumferential side than the inner circumferential end in the radial direction, a sirocco blade portion formed as a forward-swept blade portion, including the outer circumferential end, and having an outlet angle that is greater than 90 degrees, and a turbo blade portion formed as a swept-back blade portion and including the inner circumferential end, and wherein the plurality of blades include a first blade portion provided on one plate side of the main plate, and a second blade portion provided on an other plate side of the main plate, the impeller including a region in which a first inter-blade distance is greater than a second inter-blade distance, where an inter-blade distance is a distance between any adjacent two of the plurality of blades in the circumferential direction, the first inter-blade distance is the inter-blade distance of the first blade portion, and the second inter-blade distance is the inter-blade distance of the second blade portion, and wherein the inter-blade distance of the turbo blade portion increases from an inner circumferential side toward an outer circumferential side in the radial direction, and the inter-blade distance of the sirocco blade portion is greater than the inter-blade distance of the turbo blade portion, and increases from an inner circumferential side toward an outer circumferential side in the radial direction, wherein each of the plurality of blades has a first region located closer to the main plate than a middle position in an axial direction of the rotation axis, and a second region located closer to the side plate than the first region, the first inter-blade distance of the first region is greater than the second inter-blade distance of the first region, and the first inter-blade distance of the second region is greater than or equal to the second inter-blade distance of the second region.

2. The impeller of claim 1, wherein a blade length in the first region is longer than a blade length in the second region, and in the first region and the second region, a ratio of the turbo blade portion to the sirocco blade portion in the radial direction is higher than a ratio of the sirocco blade portion to the turbo blade portion in the radial direction, where the blade length is a length of each of the blades in the radial direction.

3. The impeller of claim 1, wherein each of the plurality of blades has a blade inclined region that is inclined such that a distance between the inner circumferential end and the rotation axis gradually increases in a direction from the main plate toward the side plate, the first inter-blade distance is an inter-blade distance of the blade inclined region of the first blade portion, and the second inter-blade distance is an inter-blade distance of the blade inclined region of the second blade portion.

4. The impeller of claim 3, wherein the blade inclined region is inclined at an angle that is greater than 0 degree and smaller than or equal to 60 degrees, relative to the rotation axis.

5. The impeller of claim 1, wherein the inter-blade distance of a region closer to the side plate is greater than the inter-blade distance of a region closer to the main plate.

6. The impeller of claim 1, wherein the plurality of blades has a region in which a ratio of a blade inside diameter of the plurality of blades that is a diameter of a circle drawn through the inner circumferential ends of the plurality of blades to a blade outside diameter of a plurality of blades that is a diameter of a circle drawn through the outer circumferential ends of the plurality of blades is lower than or equal to 0.7.

7. The impeller of claim 1, wherein the turbo blade portion linearly extends from the inner circumferential end toward the outer circumferential side in the radial direction.

8. The impeller of claim 1, wherein each of the plurality of blades has a radial blade portion that connects the turbo blade portion and the sirocco blade portion and has a blade angle of 90 degrees.

9. The impeller of claim 1, wherein the plurality of blades include a plurality of first blades and a plurality of second blades, in a first section of the plurality of blades that is taken along a first plane perpendicular to the rotation axis, each of the plurality of first blades has a blade length greater than a blade length of each of the second blades, and between any adjacent two of the plurality of first blades in the circumferential direction, at least associated one of the second blades is provided.

10. The impeller of claim 9, wherein the second blades has a region in which a ratio of an inside diameter of the second blades that is a diameter of a circle drawn through the inner circumferential ends of the second blades to an outside diameter of the second blades that is a diameter of a circle drawn through the outer circumferential ends of the second blades is lower than or equal to 0.7.

11. The impeller of claim 1, wherein the sirocco blade portions of the plurality of blades are formed such that at end portions closer to the side plate in an axial direction of the rotation axis, a ratio of a blade inside diameter of the plurality of blades that is a diameter of a circle drawn through the inner circumferential ends of the plurality of blades to a blade outside diameter of the plurality of blades that is a diameter of a circle drawn through the outer circumferential ends of the plurality of blades is higher than or equal to 0.7.

12. The impeller of claim 1, wherein the turbo blade portions and the sirocco blade portions of the plurality of blades are formed such that at end portions closer to the side plate in an axial direction of the rotation axis, a ratio of a blade inside diameter of the plurality of blades that is a diameter of a circle drawn through the inner circumferential ends of the plurality of blades to a blade outside diameter of the plurality of blades that is a diameter of a circle drawn through the outer circumferential ends of the plurality of blades is higher than or equal to 0.7.

13. A multi-blade fan comprising:

an impeller including a main plate configured to be driven to rotate, an annular side plate provided opposite to the main plate, and a plurality of blades connected to the main plate and the side plate and arranged in a circumferential direction with respect to a rotation axis of the main plate; and a scroll casing housing the impeller, and having a peripheral wall formed into a volute shape and a side wall including a bellmouth that forms an air inlet communicating with a space defined by the main plate and the plurality of blades, wherein each of the plurality of blades has an inner circumferential end located closer to the rotation axis in a radial direction from the rotation axis, an outer circumferential end located closer to an outer circumferential side than the inner circumferential end in the radial direction, a sirocco blade portion formed as a forward-swept blade portion, including the outer circumferential end, and having an outlet angle that is greater than 90 degrees, and a turbo blade portion formed as a swept-back blade portion and including the inner circumferential end, and wherein the plurality of blades include a first blade portion provided on one plate side of the main plate, and a second blade portion provided on an other plate side of the main plate, wherein the impeller includes a region in which a first inter-blade distance is greater than a second inter-blade distance, where an inter-blade distance is a distance between any adjacent two of the plurality of blades in the circumferential direction, the first inter-blade distance is the inter-blade distance of the first blade portion, and the second inter-blade distance is the inter-blade distance of the second blade portion, and wherein the plurality of blades are formed such that a blade outside diameter of the plurality of blades that is a diameter of a circle drawn through the outer circumferential ends of the plurality of blades is larger than an inside diameter of the bellmouth, and in portions of the plurality of blades that are located closer to the outer circumferential side, in the radial direction, than an inner circumferential side of the bellmouth that has the inside diameter of the bellmouth, a ratio of the turbo blade portion in the radial direction is higher than a ratio of the sirocco blade portion in the radial direction throughout the plurality of blades.

14. The multi-blade fan of claim 13, wherein the plurality of blades are formed such that a blade outside diameter of the plurality of blades that is a diameter of a circle drawn through the outer circumferential ends of the plurality of blades is larger than an inside diameter of the bellmouth, and each of the plurality of blades has a step portion formed at an end portion of the turbo blade portion that is closer to the side plate.

15. The multi-blade fan of claim 14, wherein the step portion is formed by a linear portion extending in an axial direction of the rotation axis and an inclined portion inclined with respect to an axial direction of the rotation axis.

16. The multi-blade fan of claim 13, wherein an inside diameter of the bellmouth is larger than a blade inside diameter of the plurality of blades that is a diameter of a circle drawn though the inner circumferential ends of the plurality of blades in a first region located closer to the main plate than a middle position in an axial direction of the rotation axis, and is smaller than a blade inside diameter of the plurality of blades that is a diameter of a circle drawn through the inner circumferential ends of the plurality of blades in a second region located closer to the side plate than the first region.

17. The multi-blade fan of claim 13, wherein a shortest distance between the plurality of blades and the peripheral wall throughout the plurality of blades is greater than twice a radial length of the sirocco blade portion.

18. The multi-blade fan of claim 13, wherein the plurality of blades are formed such that an outside diameter of the turbo blade portions that is a diameter of a circle drawn through outer circumferential end portions of the turbo blade portions is larger than an inside diameter of the bellmouth.

19. The multi-blade fan of claim 13, further comprising a motor including a motor shaft that is connected to the main plate and provided outside the scroll casing, an outside diameter of the motor is larger than a blade inside diameter of the plurality of blades that is a diameter of a circle drawn through portions of the plurality of blades that are closer to the main plate, and is smaller than a blade inside diameter of the plurality of blades that is a diameter of a circle drawn through portions of the plurality of blades that are closer to the side plate.

20. The multi-blade fan of claim 13, further comprising a motor having a motor shaft connected to the main plate, the motor being provided outside the scroll casing, an outside diameter of an end portion of the motor is larger than a blade inside diameter of the plurality of blades that is a diameter of a circle drawn through portions of the plurality of blades that are closer to the main plate, and is smaller than a blade inside diameter of the plurality of blades that is a diameter of a circle drawn through portions of the plurality of blades that are closer to the side plate.

21. An air-conditioning apparatus comprising the multi-blade fan of claim 13.

22. The multi-blade fan of claim 13, wherein each of the plurality of blades has a first region located closer to the main plate than a middle position in an axial direction of the rotation axis, and a second region located closer to the side plate than the first region, and a blade length in the first region is longer than a blade length in the second region, and in the first region and the second region, a ratio of the turbo blade portion to the sirocco blade portion in the radial direction is higher than a ratio of the sirocco blade portion to the turbo blade portion in the radial direction, where the blade length is a length of each of the blades in the radial direction.

23. The multi-blade fan of claim 13, wherein each of the plurality of blades has a blade inclined region that is inclined such that a distance between the inner circumferential end and the rotation axis gradually increases in a direction from the main plate toward the side plate, the first inter-blade distance is an inter-blade distance of the blade inclined region of the first blade portion, and the second inter-blade distance is an inter-blade distance of the blade inclined region of the second blade portion.

24. The multi-blade fan of claim 23, wherein the blade inclined region is inclined at an angle that is greater than 0 degree and smaller than or equal to 60 degrees, relative to the rotation axis.

25. The multi-blade fan of claim 13, wherein
each of the plurality of blades has
a first region located closer to the main plate than a middle position in an axial direction of the rotation axis, and
a second region located closer to the side plate than the first region,
the first inter-blade distance of the first region is greater than the second inter-blade distance of the first region, and
the first inter-blade distance of the second region is greater than or equal to the second inter-blade distance of the second region.

26. The multi-blade fan of claim 13, wherein the inter-blade distance of a region closer to the side plate is greater than the inter-blade distance of a region closer to the main plate.

27. The multi-blade fan of claim 13, wherein the plurality of blades has a region in which a ratio of a blade inside diameter of the plurality of blades that is a diameter of a circle drawn through the inner circumferential ends of the plurality of blades to a blade outside diameter of a plurality of blades that is a diameter of a circle drawn through the outer circumferential ends of the plurality of blades is lower than or equal to 0.7.

28. The multi-blade fan of claim 13, wherein
the inter-blade distance of the turbo blade portion increases from the inner circumferential side toward the outer circumferential side in the radial direction, and
the inter-blade distance of the sirocco blade portion is greater than the inter-blade distance of the turbo blade portion, and increases from the inner circumferential side toward the outer circumferential side in the radial direction.

29. The multi-blade fan of claim 13, wherein the turbo blade portion linearly extends from the inner circumferential end toward the outer circumferential side in the radial direction.

30. The multi-blade fan of claim 13, wherein each of the plurality of blades has a radial blade portion that connects the turbo blade portion and the sirocco blade portion and has a blade angle of 90 degrees.

31. The multi-blade fan of claim 13, wherein
the plurality of blades include a plurality of first blades and a plurality of second blades,
in a first section of the plurality of blades that is taken along a first plane perpendicular to the rotation axis, each of the plurality of first blades has a blade length greater than a blade length of each of the second blades, and
between any adjacent two of the plurality of first blades in the circumferential direction, at least associated one of the second blades is provided.

32. The multi-blade fan of claim 31, wherein the second blades has a region in which a ratio of an inside diameter of the second blades that is a diameter of a circle drawn through the inner circumferential ends of the second blades to an outside diameter of the second blades that is a diameter of a circle drawn through the outer circumferential ends of the second blades is lower than or equal to 0.7.

33. The multi-blade fan of claim 13, wherein the sirocco blade portions of the plurality of blades are formed such that at end portions closer to the side plate in an axial direction of the rotation axis, a ratio of a blade inside diameter of the plurality of blades that is a diameter of a circle drawn through the inner circumferential ends of the plurality of blades to a blade outside diameter of the plurality of blades that is a diameter of a circle drawn through the outer circumferential ends of the plurality of blades is higher than or equal to 0.7.

34. The multi-blade fan of claim 13, wherein the turbo blade portions and the sirocco blade portions of the plurality of blades are formed such that at end portions closer to the side plate in an axial direction of the rotation axis, a ratio of a blade inside diameter of the plurality of blades that is a diameter of a circle drawn through the inner circumferential ends of the plurality of blades to a blade outside diameter of the plurality of blades that is a diameter of a circle drawn through the outer circumferential ends of the plurality of blades is higher than or equal to 0.7.

35. An impeller comprising:
a main plate configured to be driven to rotate;
an annular side plate provided opposite to the main plate; and
a plurality of blades connected to the main plate and the side plate and arranged in a circumferential direction with respect to a rotation axis of the main plate,
wherein each of the plurality of blades has
an inner circumferential end located closer to the rotation axis in a radial direction from the rotation axis,
an outer circumferential end located closer to an outer circumferential side than the inner circumferential end in the radial direction,
a sirocco blade portion formed as a forward-swept blade portion, including the outer circumferential end, and having an outlet angle that is greater than 90 degrees, and
a turbo blade portion formed as a swept-back blade portion and including the inner circumferential end,
wherein the plurality of blades include
a first blade portion provided on one plate side of the main plate, and
a second blade portion provided on an other plate side of the main plate,
the impeller including a region in which a first inter-blade distance is greater than a second inter-blade distance, where an inter-blade distance is a distance between any adjacent two of the plurality of blades in the circumferential direction, the first inter-blade distance is the inter-blade distance of the first blade portion, and the second inter-blade distance is the inter-blade distance of the second blade portion, and
wherein the plurality of blades include a plurality of first blades and a plurality of second blades,
in a first section of the plurality of blades that is taken along a first plane perpendicular to the rotation axis, each of the plurality of first blades has a blade length greater than a blade length of each of the second blades,
between any adjacent two of the plurality of first blades in the circumferential direction, at least associated one of the second blades is provided, and
the plurality of second blades has a region in which a ratio of an inside diameter of the second blades that is a diameter of a circle drawn through the inner circumferential ends of the second blades to an outside diameter of the second blades that is a diameter of a circle drawn through the outer circumferential ends of the second blades is lower than or equal to 0.7.

36. An impeller comprising:

a main plate configured to be driven to rotate;

an annular side plate provided opposite to the main plate; and a plurality of blades connected to the main plate and the side plate and arranged in a circumferential direction with respect to a rotation axis of the main plate, wherein each of the plurality of blades has an inner circumferential end located closer to the rotation axis in a radial direction from the rotation axis, an outer circumferential end located closer to an outer circumferential side than the inner circumferential end in the radial direction, a sirocco blade portion formed as a forward-swept blade portion, including the outer circumferential end, and having an outlet angle that is greater than 90 degrees, and a turbo blade portion formed as a swept-back blade portion and including the inner circumferential end, wherein the plurality of blades include a first blade portion provided on one plate side of the main plate, and a second blade portion provided on an other plate side of the main plate, the impeller including a region in which a first inter-blade distance is greater than a second inter-blade distance, where an inter-blade distance is a distance between any adjacent two of the plurality of blades in the circumferential direction, the first inter-blade distance is the inter-blade distance of the first blade portion, and the second inter-blade distance is the inter-blade distance of the second blade portion, and wherein the sirocco blade portions of the plurality of blades are formed such that at end portions closer to the side plate in an axial direction of the rotation axis, a ratio of a blade inside diameter of the plurality of blades that is a diameter of a circle drawn through the inner circumferential ends of the plurality of blades to a blade outside diameter of the plurality of blades that is a diameter of a circle drawn through the outer circumferential ends of the plurality of blades is higher than or equal to 0.7.

37. An impeller comprising:

a main plate configured to be driven to rotate;

an annular side plate provided opposite to the main plate; and a plurality of blades connected to the main plate and the side plate and arranged in a circumferential direction with respect to a rotation axis of the main plate, wherein each of the plurality of blades has an inner circumferential end located closer to the rotation axis in a radial direction from the rotation axis, an outer circumferential end located closer to an outer circumferential side than the inner circumferential end in the radial direction, a sirocco blade portion formed as a forward-swept blade portion, including the outer circumferential end, and having an outlet angle that is greater than 90 degrees, and a turbo blade portion formed as a swept-back blade portion and including the inner circumferential end, wherein the plurality of blades include a first blade portion provided on one plate side of the main plate, and a second blade portion provided on an other plate side of the main plate, the impeller including a region in which a first inter-blade distance is greater than a second inter-blade distance, where an inter-blade distance is a distance between any adjacent two of the plurality of blades in the circumferential direction, the first inter-blade distance is the inter-blade distance of the first blade portion, and the second inter-blade distance is the inter-blade distance of the second blade portion, and wherein the turbo blade portions and the sirocco blade portions of the plurality of blades are formed such that at end portions closer to the side plate in an axial direction of the rotation axis, a ratio of a blade inside diameter of the plurality of blades that is a diameter of a circle drawn through the inner circumferential ends of the plurality of blades to a blade outside diameter of the plurality of blades that is a diameter of a circle drawn through the outer circumferential ends of the plurality of blades is higher than or equal to 0.7.

38. A multi-blade fan comprising:

an impeller including a main plate configured to be driven to rotate, an annular side plate provided opposite to the main plate, and a plurality of blades connected to the main plate and the side plate and arranged in a circumferential direction with respect to a rotation axis of the main plate;

a scroll casing housing the impeller, and having a peripheral wall formed into a volute shape and a side wall including a bellmouth that forms an air inlet communicating with a space defined by the main plate and the plurality of blades; and a motor provided outside the scroll casing and provided to face the first blade portion, wherein each of the plurality of blades has an inner circumferential end located closer to the rotation axis in a radial direction from the rotation axis, an outer circumferential end located closer to an outer circumferential side than the inner circumferential end in the radial direction, a sirocco blade portion formed as a forward-swept blade portion, including the outer circumferential end, and having an outlet angle that is greater than 90 degrees, and a turbo blade portion formed as a swept-back blade portion and including the inner circumferential end, wherein the plurality of blades include a first blade portion provided on one plate side of the main plate, and a second blade portion provided on an other plate side of the main plate, the impeller including a region in which a first inter-blade distance is greater than a second inter-blade distance, where an inter-blade distance is a distance between any adjacent two of the plurality of blades in the circumferential direction, the first inter-blade distance is the inter-blade distance of the first blade portion, and the second inter-blade distance is the inter-blade distance of the second blade portion.

39. A multi-blade fan comprising:

an impeller including a main plate configured to be driven to rotate, an annular side plate provided opposite to the main plate, and a plurality of blades connected to the main plate and the side plate and arranged in a circumferential direction with respect to a rotation axis of the main plate;

a scroll casing housing the impeller, and having a peripheral wall formed into a volute shape and a side wall including a bellmouth that forms an air inlet communicating with a space defined by the main plate and the plurality of blades, wherein each of the plurality of blades has an inner circumferential end located closer to the rotation axis in a radial direction from the rotation axis, an outer circumferential end located closer to an outer circumferential side than the inner circumferential end in the radial direction, a sirocco blade portion formed as a forward-swept blade portion, including the outer circumferential end, and having an outlet angle that is greater than 90 degrees, and a turbo blade portion formed as a swept-back blade portion and including the inner circumferential end, wherein the plurality of blades include a first blade portion provided on one plate side of the main plate, and a second blade portion provided on an other plate side of the main plate, the impeller including a region in which a first inter-blade distance is greater than a second inter-blade distance, where an inter-blade distance is a distance between any adjacent two of the plurality of blades in the circumferential direction, the first inter-blade distance is the inter-blade distance of the first blade portion, and the second inter-blade distance is the inter-blade distance of the second blade portion, and wherein the plurality of blades are formed such that a blade outside diameter of the plurality of blades that is a diameter of a circle drawn through the outer circumferential ends of the plurality of blades is larger than an inside diameter of the bellmouth, and each of the plurality of blades has a step portion formed at an end portion of the turbo blade portion that is closer to the side plate.

40. A multi-blade fan comprising:

an impeller an impeller including a main plate configured to be driven to rotate, an annular side plate provided opposite to the main plate, and a plurality of blades connected to the main plate and the side plate and arranged in a circumferential direction with respect to a rotation axis of the main plate;

a scroll casing housing the impeller, and having a peripheral wall formed into a volute shape and a side wall including a bellmouth that forms an air inlet communicating with a space defined by the main plate and the plurality of blades; and a motor provided outside the scroll casing and provided to face the first blade portion, wherein each of the plurality of blades has an inner circumferential end located closer to the rotation axis in a radial direction from the rotation axis, an outer circumferential end located closer to an outer circumferential side than the inner circumferential end in the radial direction, a sirocco blade portion formed as a forward-swept blade portion, including the outer circumferential end, and having an outlet angle that is greater than 90 degrees, and a turbo blade portion formed as a swept-back blade portion and including the inner circumferential end, wherein the plurality of blades include a first blade portion provided on one plate side of the main plate, and a second blade portion provided on an other plate side of the main plate, the impeller including a region in which a first inter-blade distance is greater than a second inter-blade distance, where an inter-blade distance is a distance between any adjacent two of the plurality of blades in the circumferential direction, the first inter-blade distance is the inter-blade distance of the first blade portion, and the second inter-blade distance is the inter-blade distance of the second blade portion, and wherein an inside diameter of the bellmouth is larger than a blade inside diameter of the plurality of blades that is a diameter of a circle drawn though the inner circumferential ends of the plurality of blades in a first region located closer to the main plate than a middle position in an axial direction of the rotation axis, and is smaller than a blade inside diameter of the plurality of blades that is a diameter of a circle drawn through the inner circumferential ends of the plurality of blades in a second region located closer to the side plate than the first region.

* * * * *